US008197324B2

(12) United States Patent
Walker et al.

(10) Patent No.: US 8,197,324 B2
(45) Date of Patent: Jun. 12, 2012

(54) CONTENT DETERMINATIVE GAME SYSTEMS AND METHODS FOR KENO AND LOTTERY GAMES

(75) Inventors: Jay S. Walker, Ridgefield, CT (US); Stephen C. Tulley, Monroe, CT (US); James A. Jorasch, Westport, CT (US); Daniel E. Tedesco, Huntington, CT (US); Russell P. Sammon, San Francisco, CA (US); Jeffrey Y. Hayashida, San Francisco, CA (US)

(73) Assignee: Walker Digital, LLC, Stamford, CT (US)

( * ) Notice: Subject to any disclaimer, the term of this patent is extended or adjusted under 35 U.S.C. 154(b) by 824 days.

(21) Appl. No.: 12/294,155

(22) PCT Filed: May 23, 2007

(86) PCT No.: PCT/IB2007/001319

§ 371 (c)(1),
(2), (4) Date: Oct. 22, 2008

(87) PCT Pub. No.: WO2007/107883

PCT Pub. Date: Sep. 27, 2007

(65) Prior Publication Data

US 2009/0131141 A1 May 21, 2009

Related U.S. Application Data

(60) Provisional application No. 60/784,990, filed on Mar. 23, 2006.

(51) Int. Cl.
*A63F 9/24* (2006.01)

(52) U.S. Cl. ..... 463/17; 705/57

(58) Field of Classification Search ..... 463/17; 705/57

See application file for complete search history.

(56) References Cited

U.S. PATENT DOCUMENTS

| | | | | |
|---|---|---|---|---|
| 4,339,798 | A | 7/1982 | Hedges et al. | |
| 4,582,324 | A | 4/1986 | Koza et al. | |
| 4,659,073 | A | 4/1987 | Leonard | 271/3 |
| 4,724,307 | A | 2/1988 | Dutton et al. | 235/455 |
| 5,110,129 | A | 5/1992 | Alvarez | |
| 5,192,076 | A | 3/1993 | Komori | 273/138 |
| 5,542,669 | A | 8/1996 | Charron et al. | |

(Continued)

FOREIGN PATENT DOCUMENTS

WO WO 03/089081 4/2003

OTHER PUBLICATIONS

Office Action for U.S. Appl. No. 11/160,410 mailed Jul. 9, 2008, 11 pp.

(Continued)

*Primary Examiner* — Pierre E Elisca

(74) *Attorney, Agent, or Firm* — Michael D. Downs; Fincham Downs, LLC

(57) ABSTRACT

Methods, systems and apparatus are described for producing wagering products and conducting wagering games. In one embodiment, a method for producing a lottery product comprises producing a play slip that includes an indication of at least one event that potentially occurs in a corresponding content (e.g., audio/video content) component of the lottery product. In one embodiment, a unit of the corresponding content is provided to a player along with a play slip.

25 Claims, 35 Drawing Sheets

U.S. PATENT DOCUMENTS 5,553,864 A 9/1996 Sitrick
5,604,542 A 2/1997 Dedrick
5,611,729 A 3/1997 Schumacher et al.
5,772,511 A 6/1998 Smeltzer
5,782,692 A 7/1998 Stelovsky
5,816,916 A 10/1998 Moody
5,816,918 A 10/1998 Kelly et al.
5,851,149 A 12/1998 Xidos et al.
5,909,875 A 6/1999 Weingardt ..... 273/269
5,984,779 A * 11/1999 Bridgeman et al. ..... 463/16
6,093,026 A 7/2000 Walker et al. ..... 434/322
6,113,495 A 9/2000 Walker et al.
6,135,884 A 10/2000 Hendrick et al.
6,190,256 B1 2/2001 Walker et al. ..... 463/25
6,203,428 B1 3/2001 Giobbi et al.
6,234,896 B1 5/2001 Walker et al.
6,302,790 B1 10/2001 Brossard ..... 463/20
6,331,143 B1 12/2001 Yoselof
6,346,043 B1 2/2002 Colin et al.
6,398,643 B1 6/2002 Knowles et al.
6,508,709 B1 1/2003 Karmarkar
6,554,703 B1 4/2003 Bussick et al.
6,569,018 B2 5/2003 Jaffe
6,592,457 B1 7/2003 Frohm et al. ..... 463/16
6,599,129 B2 7/2003 Jenkins et al.
6,645,077 B2 11/2003 Rowe
6,702,672 B1 3/2004 Angell et al. ..... 463/25
6,705,875 B2 3/2004 Lark et al.
6,722,980 B2 4/2004 Stronach
6,811,484 B2 11/2004 Katz
6,824,465 B2 11/2004 Luciano, Jr. ..... 463/18
6,895,166 B1 5/2005 Shriebman ..... 386/46
6,942,574 B1 9/2005 Lemay et al.
7,241,219 B2 7/2007 Walker et al.
7,393,280 B2 7/2008 Cannon
7,510,116 B2 3/2009 Robb et al.
7,544,129 B2 6/2009 Baerlocher
7,566,271 B2 7/2009 Hostetler et al.
7,918,738 B2 4/2011 Paulsen
2002/0147047 A1 10/2002 Letovsky et al.
2002/0175818 A1 11/2002 King et al. ..... 340/572.8
2002/0196342 A1 12/2002 Walker et al.
2003/0073490 A1 4/2003 Hecht et al.
2003/0073491 A1 4/2003 Hecht et al.
2003/0104865 A1 6/2003 Itkis et al.
2003/0211881 A1 11/2003 Walker et al. ..... 463/20
2003/0224854 A1 12/2003 Joao
2004/0005918 A1 1/2004 Walker et al.
2004/0043815 A1 3/2004 Kaminkow
2004/0053668 A1 3/2004 Baerlocher
2004/0054594 A1 3/2004 Forster et al. ..... 705/18
2004/0087357 A1 5/2004 Johnson
2004/0097283 A1 5/2004 Piper et al.
2004/0121834 A1 6/2004 Libby et al.
2004/0176154 A1 9/2004 Finnochio
2005/0027626 A1* 2/2005 Garcia ..... 705/35
2005/0037832 A1 2/2005 Cannon
2005/0054445 A1 3/2005 Gatto et al.
2005/0085289 A1 4/2005 Bozeman ..... 463/17
2005/0096125 A1 5/2005 LeMay et al. ..... 463/25
2005/0119052 A1 6/2005 Russell et al.
2005/0138668 A1* 6/2005 Gray et al. ..... 725/110
2005/0288096 A1 12/2005 Walker et al. ..... 463/25
2006/0015904 A1* 1/2006 Marcus ..... 725/46
2006/0040713 A1 2/2006 Kim
2006/0217178 A1 9/2006 Walker et al.
2007/0011718 A1* 1/2007 Nee, Jr. ..... 725/135
2007/0087808 A1 4/2007 Luciano et al.
2007/0129144 A1* 6/2007 Katz et al. ..... 463/30
2007/0208751 A1* 9/2007 Cowan et al. ..... 707/10
2007/0243934 A1 10/2007 Little et al.
2008/0059631 A1* 3/2008 Bergstrom et al. ..... 709/224
2010/0105454 A1* 4/2010 Weber et al. ..... 463/1

OTHER PUBLICATIONS

Office Action for U.S. Appl. No. 11/160,410 mailed Nov. 28, 2007, 10 pp.
Office Action for U.S. Appl. No. 11/970,888 mailed Jun. 19, 2009, 11 pp.
Office Action for U.S. Appl. No. 11/970,888 mailed Oct. 27, 2008, 9 pp.
Office Action for U.S. Appl. No. 11/423,629 mailed May 19, 2010, 9 pp.
International Search Report for PCT/US07/68571 completed Sep. 1, 2008, 3 pp.
Written Opinion for PCT/US07/68571 completed Sep. 1, 2008, 8 pp.
International Search Report for PCT/US07/64859 mailed Sep. 19, 2008, 4 pp.
Written Opinion for PCT/US07/64859 mailed Sep. 19, 2008, 8 pp.
Office Action for U.S. Appl. No. 11/423,629 mailed Nov. 17, 2008, 10 pp.
Office Action for U.S. Appl. No. 11/423,629 mailed Feb. 5, 2008, 7 pp.
Office Action for U.S. Appl. No. 11/423,626 mailed Oct. 17, 2008, 9 pp.
Office Action for U.S. Appl. No. 11/423,626 mailed Jan. 9, 2008, 8 pp.
Office Action for U.S. Appl. No. 11/423,610 mailed Nov. 20, 2009, 8 pp.
Office Action for U.S. Appl. No. 11/423,610 mailed Dec. 16, 2008, 9 pp.
Office Action for U.S. Appl. No. 11/423,610 mailed Mar. 31, 2008, 7 pp.
Notice of Allowance for U.S. Appl. No. 11/431,696 mailed Aug. 27, 2010, 6 pp.
Office Action for U.S. Appl. No. 11/431,896, mailed Dec. 28, 2009, 16 pp.
Office Action for U.S. Appl. No. 11/431,896 mailed Jul. 9, 2009, 17 pp.
Office Action for U.S. Appl. No. 11/431,896, mailed Sep. 3, 2008, 13 pp.
Gonzales, C.A. et al., "Requirements for motion-estimation search range in MPEG-2 coded video", IBM Journal of Research and Development, 1999, vol. 43, No. 4, (http //www research ibm com/journal/rd/434/Gonzales html), 10 pp.
"Computer Assisted Video Analyzes—Max-Planck-Institute for Psycholinguistics", (http //www mpi nl/world/tg/CAVA/CAVA html), download date: Jun. 9, 2005, 2 pp.
"Media Tagger: Macintosh-based video transcription", (http //www mpi nl/world/tg/CAVA/mt/MtandDB html), download date: Jun. 9, 2005, 2 pp.
"IGT—Mata Hari Slots", (http //www igt com/gaminggroup/games/game_detail asp?toggle=ovr&pid=5.113.120&type...), download date: Jun. 9, 2005, 2 pp.
"Video Transcription on PC—Max-Planck-Institute for Psycholinguistics", (http //www mpi nl/world/tg/CAVA/ted/ted html), download date: Jun. 9, 2005, 2 pp.
"Drinking games—Star Wars Drinking Game.", The Webtender (http //www webtender.com/handbood/games/starwars.game), download date Apr. 12, 200, 3 pp.
Keno Rules, (http//keno-info.com/keno_rules.html), download date Apr. 14, 2006, 3 pp.
Keno Bonus Card, Massachusetts State Lottery, Nov. 2005, 2 pp.
G-Tech Enterprise Series, Altura Family of Terminals, Sep. 2003, 2 pp.
Office Action for U.S. Appl. No. 11/970,888 notification date Dec. 7, 2011, 17 pp.
Final Office Action for U.S. Appl. No. 11/423,629 notification date Apr. 25, 2012, 10 pp.

* cited by examiner

500

| CONTENT IDENTIFIER 502 | CONTENT PROVIDER IDENTIFIER 504 | CONTENT DESCRIPTION 506 | CONTENT 508 |
|---|---|---|---|
| ABC123 | CP-001 | "EXECUTIVE DECISIONS" SEASON 1, EPISODE 1 | [EXECD_S1_E1.MPG2] |
| ABC123 | CP-001 | "EXECUTIVE DECISIONS" SEASON 1, EPISODE 2 | [EXECD_S1_E2.MPG2] |
| ABC123 | CP-001 | "EXECUTIVE DECISIONS" SEASON 1, EPISODE 3 | [EXECD_S1_E3.MPG2] |
| ABC987 | CP-999 | "AIRLINER" 1982 - AUDIO ONLY | [AIRLINER_1982.WAV] |
| ABC246 | CP-444 | "ACQUAINTANCES - SERIES FINALE" 2003 | [0987453_E26.MPG2] |

FIG. 5

600

| MEDIA UNIT IDENTIFIER 602 | CONTENT PROVIDER IDENTIFIER 604 | ACTIVATING/ PURCHASING TERMINAL IDENTIFIER 606 | ASSOCIATED PLAY SLIP IDENTIFIER(S) 608 | ELIGIBLE FOR >1 GAME INSTANCE? 610 |
|---|---|---|---|---|
| ABC123_01 | CP-001 | T01 | PS_01 | Y |
| ABC123_02 | CP-001 | T02 | PS_02 | Y |
| ABC987_96 | CP-999 | T23 | PS_03 | N |
| ABC246_53 | CP-444 | T39 | PS_04 | N |

FIG. 6

700

| PLAY SLIP IDENTIFIER 702 | CONTENT IDENTIFIER 704 | AWARD ATTRIBUTE 1 706 | PAYOUT FOR AWARD ATTRIBUTE 1 708 | AWARD ATTRIBUTE N 710 | PAYOUT FOR AWARD ATTRIBUTE N 712 |
|---|---|---|---|---|---|
| PS_01 | ABC123 | IF PHRASE [X] IS SPOKEN BY CHARACTER [Y] | $250,000.00 | IF PHRASE [X] IS SPOKEN BY CHARACTER [Z] | $5.00 |
| PS_02 | ABC123 | IF CHARACTER [A] APPEARS IN SETTING [B] | $100,000.00 | IF CHARACTER [C] APPEARS IN SETTING [D] | $25.00 |
| PS_03 | ABC987 | IF PHRASE [M] IS SPOKEN BY CHARACTER [N] | $250,000.00 | IF PHRASE [M] IS SPOKEN BY CHARACTER [O] | $5.00 |
| PS_04 | ABC246 | IF PROP [1] IS USED IN SCENE [2] | $100,000.00 | IF PROP [3] IS USED IN SCENE [4] | $2.00 |

FIG. 7

800

| PLAY SLIP IDENTIFIER 802 | REDEMPTION VALUE 804 | REDEMPTION STATUS 806 |
|---|---|---|
| PS_01 | $0.00 | N/A |
| PS_02 | $25.00 | REDEEMED |
| PS_03 | $0.00 | N/A |
| PS_04 | $100.00 | PENDING / OUTSTANDING |

FIG. 8

900

LOTTERY LOTTERY LOTTERY LOTTERY

DO NOT DISCARD THIS RECEIPT
NO PAYOUT WITHOUT RECEIPT
THURSDAY 12-29-05 10:46 EST

AMOUNT PAID - $20.00
DISK # DD54-4376003-DD23

TV SHOW..... CHEERS
SEASON..... 2
EPISODE..... 12
"DIANE'S BAD HAIR DAY"

PHRASE THAT PAYS!

"I'M OUTTA HERE"

| IF PHRASE IS SAID BY... | YOU WIN |
|---|---|
| NORM..... | $ 250,000 |
| COACH..... | $ 10,000 |
| SAM..... | $ 100 |
| DIANE..... | $ 50 |
| CARLA..... | $ 25 |
| FRASIER..... | $ 5 |

PRIZE REDEMPTION CODE

45667-09686-54577423

HERE'S HOW IT WORKS:

YOU MUST PRESENT THIS TICKET TO COLLECT YOUR WINNINGS. WATCH THE DVD EPISODE NAMED ON THIS TICKET. LISTEN FOR THE PHRASE THAT PAYS!

ALL DVDS OF EACH EPISODE ARE IDENTICAL, BUT EVERY TICKET HAS ITS OWN PHRASE AND PAYOUT VALUES. IF AFTER WATCHING THE EPISODE YOU ARE NOT SURE WHETHER YOU ARE A WINNER, ASK YOUR LOTTERY AGENT TO SCAN THE BARCODE OR ENTER YOUR TICKET NUMBER AT WWW.XYZLOTTERY.ORG

FIG. 9

CONTENT DETERMINATIVE GAME SYSTEMS AND METHODS FOR KENO AND LOTTERY GAMES

CROSS-REFERENCE TO RELATED APPLICATIONS

This application claims the benefit of priority of PCT Application No. WO2007/107883 filed May 23, 2007 entitled CONTENT DETERMINATIVE GAME SYSTEMS AND METHODS FOR KENO AND LOTTERY GAMES and U.S. Provisional Patent Application No. 60/784,990, filed Mar. 23, 2006, which are hereby incorporated by reference in its entirety.

This application is also related to U.S. patent application Ser. No. 11/160,410, filed Jun. 22, 2005, entitled METHODS AND APPARATUS FOR FACILITATING A PAYOUT AT A GAMING DEVICE USING AUDIO/VIDEO CONTENT; which claims the benefit of U.S. Provisional Application Ser. No. 60/582,377, filed Jun. 23, 2004 entitled GAMING DEVICE WITH OUTCOME COMPARISON FEATURE, both of which are hereby incorporated by reference in their entireties.

FIELD OF THE INVENTION

The present application relates generally to systems, devices, products and processes for producing and conducting games, including keno-based games and lottery games.

BRIEF DESCRIPTION OF THE DRAWINGS

FIG. 5 is a tabular representation of an exemplary content database according to an embodiment of the present invention.

FIG. 6 is a tabular representation of an exemplary media inventory database according to an embodiment of the present invention.

FIG. 7 is a tabular representation of an exemplary play slip content database according to an embodiment of the present invention.

FIG. 8 is a tabular representation of an exemplary redemption status database according to an embodiment of the present invention.

FIG. 9 is an illustrative representation of an exemplary play slip according to an embodiment of the present invention.

FIG. 11 is a flowchart illustrating an exemplary process for assigning payouts to content according to an embodiment of the present invention.

DETAILED DESCRIPTION OF THE INVENTION

Figure 1:
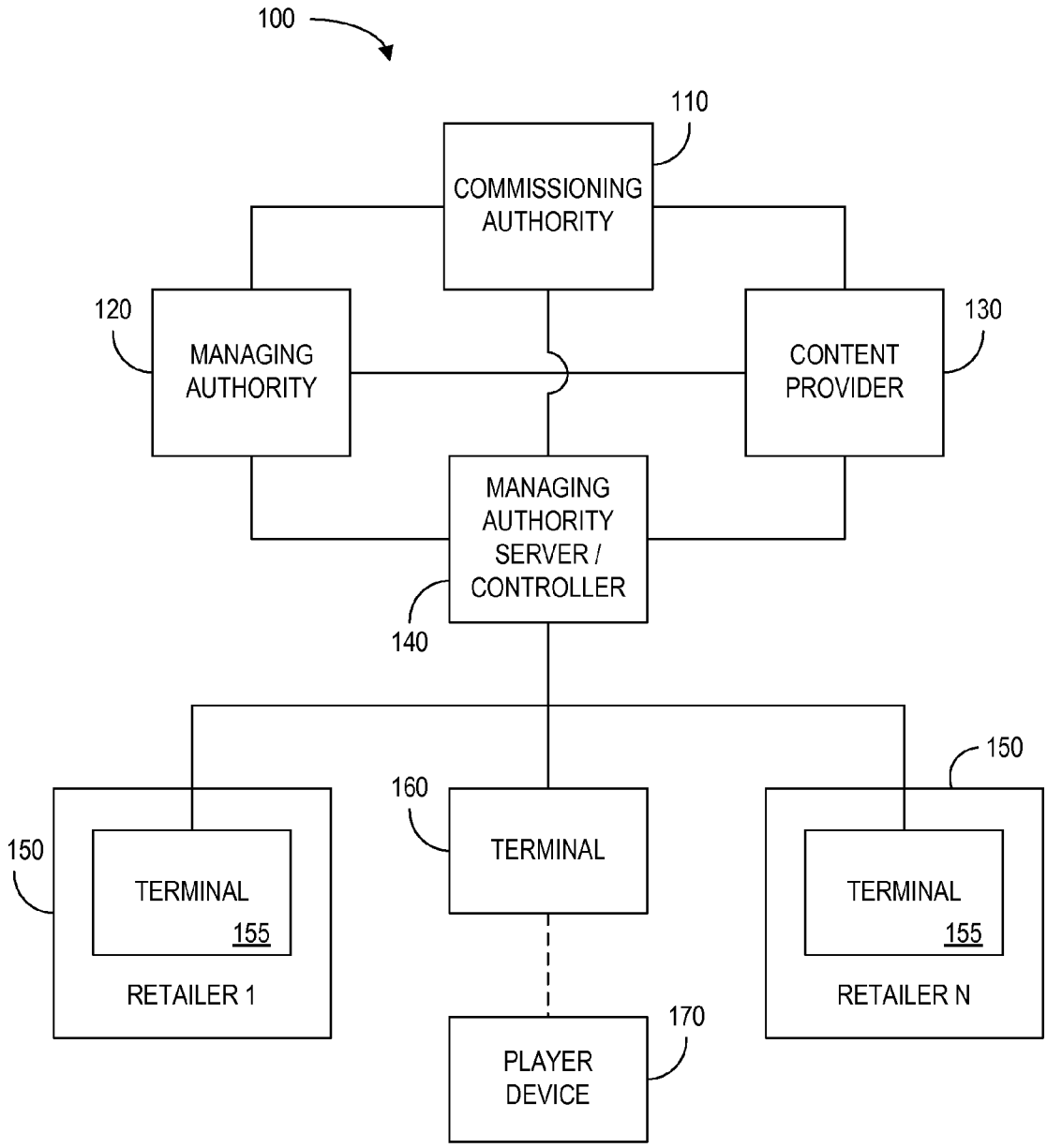
FIG. 1 is a block diagram overview of an exemplary system according to an embodiment of the present invention.

Advantages and features of the invention will become apparent upon reading the contents of this document, and the nature of the various aspects of the invention may be more clearly understood by reference to the following detailed description of exemplary embodiments of the invention, the appended claims and to the drawings attached hereto.

Many copyrighted works languish with no venue in which they may be displayed, viewed, or otherwise experienced. That is, despite the proliferation of television series DVD releases, numerous channels dedicated to seemingly every genre of entertainment, many books, stories, television shows, movies, songs, and other recordings remain idle and do not generate income for the owners. Even in those instances where a venue does exist to replay these works, most copyright owners are always interested in exploring new opportunities with which to generate more revenue.

People have a history of using audiovisual works for different types of games. Simple games such as buzzword bingo are prevalent on college campuses throughout the United States. Such games usually revolve around drinking and a favorite movie. The movie is begun, and the players imbibe of an adult beverage when certain specific events happen in the movie. For example, the venerable movie trilogy STAR WARS® has generated the "Star Wars Drinking Game" where players consume their beverage when, inter alia, an onscreen character exclaims that they have "a bad feeling about this".

Some aspects of the present invention serve to use various types of previously produced entertainment content in wagering games such as lottery games and keno games. The content may or may not be adapted or modified for use in such games, as deemed appropriate for a particular implementation. Thus, some embodiments of the present invention provide for wagering games which are significantly more entertaining than traditional prior art lottery and keno games. Moreover, some embodiments of the present invention serve to complement, leverage, enhance and/or repurpose entertainment media that might otherwise go unused.

The following discussion addresses some lottery-related embodiments and keno-based embodiments in separate sections. However, it will be readily understood that features discussed with respect to a particular keno embodiment for example, may be utilized where practical or desirable with respect to one or more lottery-related embodiments. For example, although the use of cues and edited content is discussed primarily with respect to keno-based games, cues and/or edited content may be utilized in one or more of the described lottery embodiments.

A. Lottery Games

1. Introduction to Embodiments Related to Lottery Games

Lotteries are an important source of revenue for states or other entities seeking to augment their tax base in order to fund civic initiatives (e.g. infrastructure improvements and/or education initiatives). Accordingly, lottery operators seek new ways to appeal to the broadest range of potential lottery players.

In a typical instant lottery game, players purchase instant lottery tickets that may include one or more concealed play areas (e.g. "scratch-off" latex coated areas) that must be removed in order to reveal potential prize values and/or other game symbols. Certain combinations of symbols or values (such as alphanumeric indications of money amounts) correspond to prizes, thereby enabling players of instant lottery games to determine fairly quickly whether or not they are entitled to a payout or other award (e.g., goods or services). Other types of lottery games provide for "instant" outcomes via an online-based system for generating tickets or receipts (e.g., on demand).

Lottery operators are also seeking ways to get new players to play lottery games, and to retain lottery players. Some of the embodiments described in this disclosure provide advantageous ways to provide lottery products and processes that appeal to a wide range of potential lottery players. For instance, as noted above, play of a typical instant lottery game does not usually take most players very long (e.g., the brief time it takes to remove all of the concealing latex on a scratch-off lottery ticket). Some types of current and potential players may find play of typical instant games uninteresting and/or too fast, and may find it appealing to be able to play a lottery game that increases the entertainment value of a lottery product to the player.

The present disclosure provides, among other things, methods, systems, and apparatus that may be useful for producing and/or conducting lottery games.

As used in this disclosure, in accordance with some embodiments, a value (e.g., a redemption value) of a lottery product, a play slip, or a lottery game may refer to, for example and without limitation, a payout, prize, cash award, a score, a number of points, a product, a service, or a discount for which a lottery product or game may be redeemable (e.g., $2, a free admission to an amusement park, thirty points). In a preferred embodiment, the redemption value of a lottery product is zero or greater than zero in terms of monetary value (e.g., every play slip produced in accordance with a lottery game may be redeemed for at least $3). In accordance with some embodiments, the value of a lottery game may be negative (e.g., −20 points, a loss of $2), zero, or positive (e.g., $5). An outcome of an instant game may be used to refer to any indicia revealed by playing the game (e.g., three symbols revealed by scratching off a concealing layer of latex on a scratch-off lottery ticket) and/or may be used to refer to a value (e.g., a cash award) of the instant game.

As used in this disclosure, referring to a product, outcome, value, or game as redeemable or redeemed does not imply that the corresponding redemption value is not zero. For example, a losing play slip may be considered redeemable in the sense that it may be presented for redemption or redeemed, even though the redemption value is zero.

As used in this disclosure, a product generally refers to an individual product available for retail sale (as discussed in this disclosure, such a product may comprise one or more components that may or may not be integral or physically connected). A lottery product may comprise two or more components (e.g., a play slip and a presentation content medium).

According to some embodiments of the present invention, a lottery product may be associated with a plurality of sub-payouts. In one embodiment, the lottery product has a total redemption value that is based on the plurality of sub-payouts. In one embodiment, the lottery product comprises a plurality of different criteria, each associated with a respective prize or value, and the redemption value of the lottery product equals, for example, a sum of the respective monetary values or a total value of the respective prizes. In some embodiments, different values may be combined, multiplied, etc., in order to determine a redemption value of the lottery product. In some embodiments, the lottery product includes a representation of the redemption value (or multiple possible redemption values) of the lottery product (e.g., a removable concealing layer covers up the text "$5" that indicates the redemption value of the entire lottery product; or a listing or table is provided of different criteria corresponding to different redemption values).

In some embodiments, a lottery system according to the present invention allows for retailers to sell to players play slips that reference an event or events that possibly may occur in a corresponding television show, movie, magazine, book or other content corresponding to the play slip. For each portion of content referenced on the play slip, an indication of a corresponding payout amount may be provided. For example, a play slip may indicate that if the character "Mrs. Smith" say's "See you later" on "page 12" of a certain book, or during the "car chase scene" of a certain movie, the play slip would entitle the holder to a $5 prize.

Described below are non-limiting configurations of general-purpose components that may include hardware, software, middleware, and/or software processes and/or steps that may be employed to form a lottery system or portions thereof. The lottery system may include one or more databases stored in memory of one or more devices, and components configured to perform various functions in accordance with one or more embodiments described in this disclosure.

As used in discussing various embodiments, a managing authority may refer to an entity primarily responsible for the operation and oversight of various hardware, software, data and/or systems that may be useful for implementing embodiments of the present invention. Typically, though not necessarily, a commissioning authority may establish a contractual relationship with a managing authority for the purposes of operating and administering various aspects of the games described herein. For example, GTECH Corp. of West Greenwich, R.I. may be one example of such a managing authority.

As used in discussing various embodiments, a commissioning authority may refer to a governmental, private or semi-private entity or agency that is primarily responsible for selecting and/or contracting a managing authority and for establishing the general operational duties of the managing authority, as generally described above. For example, the New York State Lottery may be one example of a commissioning authority.

As used in discussing various embodiments, a content provider may refer to an originator, provider, proprietor and/or source of media and/or content that may be presented to players of wagering games (and that may or may not be, as discussed in this disclosure, edited or modified for such purpose). For example, a copyright holder such as a producer, production company or television studio may be one example of a content provider.

As used in discussing various embodiments, a retailer may refer to an entity or establishment responsible for the retail sale and/or redemption of media, content, and associated play slips (e.g., an agent, a lottery agent, a sales agent). Typically, a retailer or sales agent is authorized to offer for sale and redeem media, lottery products, and/or play slips via a formal arrangement between the agent, a managing authority and/or commissioning authority.

As used in discussing various embodiments, a controller may refer to one or more computing device(s) (e.g., a central controller, a server) operatively configured to receive, transmit, store, output and/or manage data relating to various aspects of the embodiments described herein, including data associated with one or more of: keno or lottery game instances; sales agents; sales (e.g. statistics); content; media; payout instances; redemption instances; accounting functions; and/or other aspects of the invention as described herein.

As used in discussing various embodiments, a terminal may refer to one or more computing device(s) (e.g., a point of sale (POS) terminal, a retailer terminal, a POS) operatively configured to receive and transmit data to/from a controller on behalf of a retailer or agent. Such data may include, for example: data identifying a content medium (e.g., a bar code that identifies a particular unit of content media); data associated with content; identifying data associated with a game player and/or a player device; identifying data associated with one or more play slip(s); redemption request data; and/or payout data. For example, the ALTURA® lottery terminal manufactured by GTECH Corp. of West Greenwich, RI may be one example of a suitable terminal.

As used in discussing various embodiments, a player device may refer to one or more devices operatively configured to output content to a player. For example, where presentation media is embodied as a digital video disc or digital versatile disc (DVD), an appropriate player device may comprise or include a DVD player. Similarly, where content is embodied as an electronic file (e.g., an audio file based on MPEG-3 compression (an mp3 file)), a player device may comprise or include hardware and/or software operable to execute and/or output content associated with the media. Exemplary player devices may comprise or include e.g., televisions, liquid crystal displays (LCDs), personal digital assistants (PDAs), wired or wireless (e.g. "3G") telephones and/or proprietary hardware/software (e.g. a SONY PlayStation Portable (PSP), APPLE iPod video viewer, etc.). Other examples of player devices suitable for presenting content to players are discussed in this disclosure (e.g., with respect to particular keno-related embodiments).

As used in discussing various embodiments, a play slip may refer to a record of information (e.g., a claim certificate, a game ticket, a receipt) associated with a given instance of game play, media and/or content associated with a lottery game. According to one embodiment, a play slip may be embodied as a printed physical record or receipt, issued from a retailer terminal and provided to a player. According to another embodiment, a play slip may be embodied as a game piece including concealed (revealable) information relating to game play. The play slip may include information associated with media purchased by the player, such as information identifying the purchased media (e.g., a DVD); information identifying, corresponding to or describing one or more potential content events and their associated payout(s); information for use in identifying, determining and/or redeeming any payout associated with the play slip; and/or instructions or other general information associated therewith.

As used in discussing various embodiments, medium, content medium, and presentation medium may be used to refer to the physical and/or digital embodiment or carrier associated with content used in wagering games described in this disclosure. For example, where content comprises an episode of a television show rendered onto DVD, the presentation medium may comprise the physical disc and its associated packaging. Similarly, where the relevant content comprises an episode of a television show programmed or compiled as a computer-executable or computer-readable file (e.g. using an IPOD™ by APPLE®), the presentation media may comprise the file itself and/or means for file storage. According to some embodiments, the presentation media may comprise or include printed media. According to some embodiments, the printed media may be used in comparison to one or more play slip(s) in order to allow a player to discern whether he/she is entitled to a payout or other prize.

As used in discussing various embodiments, content or presentation content may be used to refer to any content (or portion thereof) that may be accessible via and/or included in or on a presentation medium. In one example, content may comprise the perceptible output of the presentation media. For example, according to some embodiments, presentation content may comprise or include humanly perceptible audio/video information. As used in discussing various embodiments, audio/video content may refer to content that has only an audio component, has only a video component, or has both an audio component and a video component. For example, the presentation content may include all or a portion of a television episode, (e.g. an episode of a situation comedy), music (e.g., a show's theme song or a song from a soundtrack of a movie) sporting event (e.g. an actual or simulated game of baseball) or a feature film (e.g. an action movie). Other examples of content are described in this disclosure, and still others will be readily apparent in light of this disclosure. According to some embodiments, content may include printed content such as, for example, an illustrated booklet including pictures and/or text.

As used in discussing various embodiments, content event or presentation content event may refer to a perceptible portion of the content associated with a wagering game (e.g., a lottery game). A content event may be defined, for example, by one or more of the following: a word, phrase, sentence, monologue or dialogue; the appearance and/or actions of a character or player; the appearance of one or more sets(s) and/or props; and/or the contextual occurrence of one or more actions or happenings within the presentation content (e.g., a double-play in a simulated or actual game of baseball, a particular line or phrase spoken in a situational comedy, the appearance or use of a character, prop, word, line and/or scene in a film or printed booklet, etc.). Other examples of events are discussed in this disclosure (e.g., with respect to particular keno-based embodiments). According to some embodiments, the occurrence of various presentation content events (within associated presentation content) may entitle a player to receive a payout. According to some embodiments, a description of such presentation content events may be provided to a player via a play slip, in exchange for a wager/purchase by or on behalf of a player. In accordance with such embodiments, such descriptions may represent or define one or more criteria or attributes, which further define one or more rules that may be satisfied in order to qualify a player to receive a payout, as described further in this disclosure.

As used in discussing various embodiments, a wager may refer to consideration (typically pecuniary consideration) provided by a player to a retailer or agent in exchange for the potential or actual right to redeem a payout associated with one or more presentation content events, presentation media, and/or play slip(s). As used herein, a wager may or may not include a price to purchase presentation media containing presentation content. For example, presentation media may have a first price associated therewith (e.g. $8.00). In addition to the first price, payment of a second price (e.g. $12.00) may or may not be required to fund a wager of a lottery game associated with the presentation media. Alternatively, each of the presentation media and the requisite wager associated therewith may be associated with a combined price (e.g. each of the presentation media and the wager may be funded in exchange for a single payment of twenty dollars ($20) by or on behalf of a player). According to some embodiments, presentation media may be provided for free with the purchase with of one or more play slip(s)/game ticket(s). According to other embodiments, a retailer may present a wager opportunity to a customer in response to a customer's requested purchase or rental of presentation media (e.g. a video rental store may provide a customer with an "upsell" offer comprising a wager opportunity when the customer proceeds to rent a movie, in which case the wager opportunity may correspond to the rented movie).

As used in discussing various embodiments, a payout or prize may refer to an award (typically a financial award) provided to a player contingent upon the satisfaction of one or more criteria associated with: (i): content; and (ii): one or more content events. According to some embodiments of the present invention, a player may be entitled to a payout based on whether one or more content event(s) occurs in the corresponding content. Further, a player's entitlement to a payout may be determined based on one or more of: (i): a request or instruction from a retailer terminal (e.g., to a controller); (ii): the purchase of a generic unit of media (e.g., one copy of a thousand copies of a particular television episode) by or on behalf of a player; (iii): the purchase of a specific unit of media by or on behalf of a player; (iv) one or more payout determination process(es); (v) randomly (e.g. via a random distribution of presentation media and/or play slips); and/or (vi) any other appropriate manner.

According to some embodiments of the present invention, a lottery game is provided wherein information provided to a player via play slip is compared to pre-authored content, such as a pre-recorded episode of a television show, movie, or the like, in order to allow the player to determine a redemption value associated with the play slip. For example, according to one embodiment, a play slip includes information identifying or otherwise defining (i) a line, phrase, sentence or word occurring within the pre-authored content; (ii) one or more characters, actors, props or scenes appearing or occurring within the pre-authored content; and/or (iii) one or more payouts that may be provided if the pre-authored content corresponds to the information provided on the play slip (e.g. in accordance with one or more rule(s) of the lottery game).

According to some embodiments of the present invention, a player may acquire content (e.g., audio/video content) and a play slip from a retailer/retailer terminal. The player may then compare information from the play slip/game ticket to information contained in the content in order to determine (i) whether the player is entitled to a payout; and (ii) the amount of the payout, if any. Information associated with the play slip may be created, updated and/or stored by a controller and/or retailer terminal at the time of purchase, and may be subsequently accessed as part of a play slip generation and/or redemption procedure.

According to some embodiments of the present invention, a play slip may be generated (e.g., printed) at the time of purchase based on one or more predetermined outcome(s) associated with content. For example, where the content comprises an episode of a television show (e.g., in audio/video form), information provided on the play slip may include (i) a list of characters associated with the particular episode (or the television show in general); (ii) a phrase, line, word or prop that may or may not occur within the pre-authored content; and (iii) one or more payout descriptors associated with (i) and/or (ii). According to embodiments where the presentation content is embodied as printed media, the information provided on a play slip may include one or more descriptions of portions of the printed content, including e.g. one or more words, phrases, characters, props, visual descriptors, etc.

As discussed with respect to various embodiments, the information included on a play slip may be compared (e.g., by a player playing the lottery game) to the information contained in (or embodied by) the presentation media corresponding to the play slip in order to enable a player to ascertain whether the player is entitled to a payout. For example, a play slip may include a description of a phrase that may (or may not) be included within a unit of content (e.g., provided to or purchased by the player), along with a list of characters (e.g. where the presentation media comprises or includes an episode of a television show). The player may be entitled to a first payout (e.g. $100) if the phrase is associated with a first character within the presentation content, and the player may be entitled to a second payout (e.g. $25) if the phrase is associated with a second character within the presentation content.

Alternatively or in addition, the player may be entitled to a payout (e.g. $50) if a word, phrase or symbol occurs within (or is associated with) a designated or identified portion of the content. For example, the play slip may advise the player that he or she is entitled to a $50 payout if a particular word or phrase appears on a particular page (or with respect to a particular character) within printed presentation media (e.g., a comic book).

According to some embodiments of the invention, presentation media for a lottery product may be mass-produced such that each instance of presentation media is substantially identical (e.g., the content presented to the player is substantially identical, even if the individual media may have respective differences such as unique encoded identifiers that may or may not be perceptible to the player). Further, according to some embodiments of the invention, each content event may be associated with more than one payout value. For example, each of two play slips/game tickets may describe or reference the same presentation content event, with each play slip/game ticket being associated with different payout values for that same event.

According to some embodiments, a play slip may include encoded information corresponding to a play slip and any associated payout. For example, a play slip may include a bar code or other unique identifier that may be used by a player, retailer terminal and/or controller in order to determine, award and/or receive a payout.

These and other embodiments are discussed further below with respect to the accompanying figures.

2. Lottery Communications Network

FIG. 1 illustrates a network environment 100 that includes a commissioning authority 110, a managing authority 120, a content provider 130, a managing authority server/controller 140, a plurality of lottery retailers 150 and terminals 155 and 160, and a player device 170 (optionally in communication with terminal 160), in communication via suitable data communications links (e.g. LAN, WAN, proprietary network, etc.). Generally, any or all of the terminals 155 and 160 may operate to: (i) receive information associated with one or more lottery products including such data as: (a) product identifier(s), (b) content identifiers, (c) media identifiers, (d) content criteria, and (e) redemption values; (ii) transmit any or all of the received information to the controller 140; and (iii) output information including such data as: (a) information identifying lottery products and (b) information associated with one or more redemption values or benefits.

In general, each terminal 155 shown in FIG. 1 will correspond to (or be associated with) a particular lottery retailer 150 (e.g., retailer 1 or retailer N, respectively). It should be understood that any number of lottery retailer terminals might be employed in a system 100, along with any number of corresponding controllers 140.

The controller 140 may operate to: (i) receive and store information associated with one or more lottery products; (ii) determine at least one redemption value associated with a lottery product; and (iii) receive a redemption request associated with a lottery product.

In some embodiments, a retailer terminal 155 of FIG. 1 may be configured to perform some or all of the functions of the controller 140. Thus, in some embodiments, the controller 140 and the lottery retailer terminal 155 (or another given retailer terminal and controller pairing) may be considered as the same "device".

In accordance with some embodiments of the invention, a content provider 130 may provide (e.g., transmit) content and/or content media to one or more of (i) a commissioning authority 110; (ii) a managing authority 120, and/or (iii) one or more controller(s) 140.

For example, a content provider 130 may provide digitized files and/or media comprising, for example, a television show to one or more of the managing authority 120 and/or commissioning authority 110. Alternatively, a content provider 130 may provide content via pre-recorded, and/or pre-printed media directly to one or more of retailers 1-N 150 for subsequent sale and/or distribution by the retailer. Various other forms and manners in which content (e.g., audio/video content) may be provided as necessary for use in producing, conducting, and/or selling lottery games are discussed in this disclosure (e.g., with respect to particular keno-based embodiments).

Although only one content provider 130 is shown in FIG. 1, it should be understood that any number of content providers 130 may participate in a system for providing lottery games. For example, a first content provider may administer the creation and distribution of a first type of content (e.g., television shows), and another content provider may administer the creation and distribution of another type of content (e.g., feature films, mp3 files, video downloadable over the Internet, printed media, etc.).

Similarly, although only one managing authority 120 and one controller 140 is shown in FIG. 1, any number of managing authorities may operate within the illustrated system 100. For example, a first managing authority may administer the operation of a first type of game on behalf of a commissioning authority. Further, a second (e.g., separate) managing authority may administer the operation of a second type of game with respect to the same commissioning authority. Also, any number of managing authority servers/controllers may be used. For example, each of multiple managing authorities may communicate with the same server/controller, at least one managing authority may be in communication with more than one server/controller, each managing authority may communicate with its own respective server/controller, or a system may include any combination of the foregoing examples (e.g., there may be any combination of at least one shared server/controllers and at least one server/controller in communication with only one respective managing authority).

As shown in FIG. 1, according to some embodiments, a retailer terminal 160 may be provided independent of an actual retail facility. For example, the retailer terminal may comprise a player-operated and/or automated device (e.g., a vending machine and/or kiosk) for implementing various aspects of the present invention. Further, any one of the retailer terminals 1-N may or may not communicate with a player device 170. For example, according to one embodiment, a player device 170 may be configured to receive and/or to output content from a retailer terminal 150 or 160, controller 140, or other dedicated device (e.g., a player could download a pdf, mp3, or video file from a Web server for output using his home computer). According to other embodiments, the player device of FIG. 1 may operate to output content derived from one or more types of content media, such as e.g., DVD, CD, CD-ROM, tape, etc.

Generally, the network of FIG. 1 may comprise or include one or more local and/or wide-area network(s), proprietary and/or public network(s) (e.g., the Internet) for facilitating two-way data communications between the illustrated entities. The entities may communicate directly or indirectly, via a wired or wireless medium such as the Internet, a local area network (LAN), a wide area network (WAN), an Ethernet, a Token Ring, a proprietary network, a telephone line, a cable line, a radio channel, an optical communications line, a satellite communications link, or via any appropriate communications means or combination of communications means. Any number and type of devices may be in communication with the lottery controller, and communication between the lottery retailer terminals and the controller 140 may be direct or indirect, such as over the Internet through a Web site maintained by computer on a remote server, or over an online data network including commercial online service providers, bulletin board systems and the like. In some embodiments, the devices may communicate with one another and/or the computer over RF, cable TV, satellite links and the like. A variety of communications protocols may be part of any such communications system, including but not limited to: Ethernet (or IEEE 802.3), SAP, ATP, Bluetooth™, and TCP/IP.

Those skilled in the art will understand that devices in communication with each other need not be continually transmitting to each other. On the contrary, such devices need only transmit to each other as necessary, and may actually refrain from exchanging data most of the time. For example, a device in communication with another device via the Internet may not transmit data to the other device for days or weeks at a time. In some embodiments, a server computer may not be necessary and/or preferred. For example, in one or more embodiments, methods described herein may be practiced on a stand-alone device and/or a device in communication only with one or more other devices. In such an embodiment, any functions described as performed by a computer or data described as stored on the computer may instead be performed by or stored on one or more devices.

3. Controller

Figure 2:
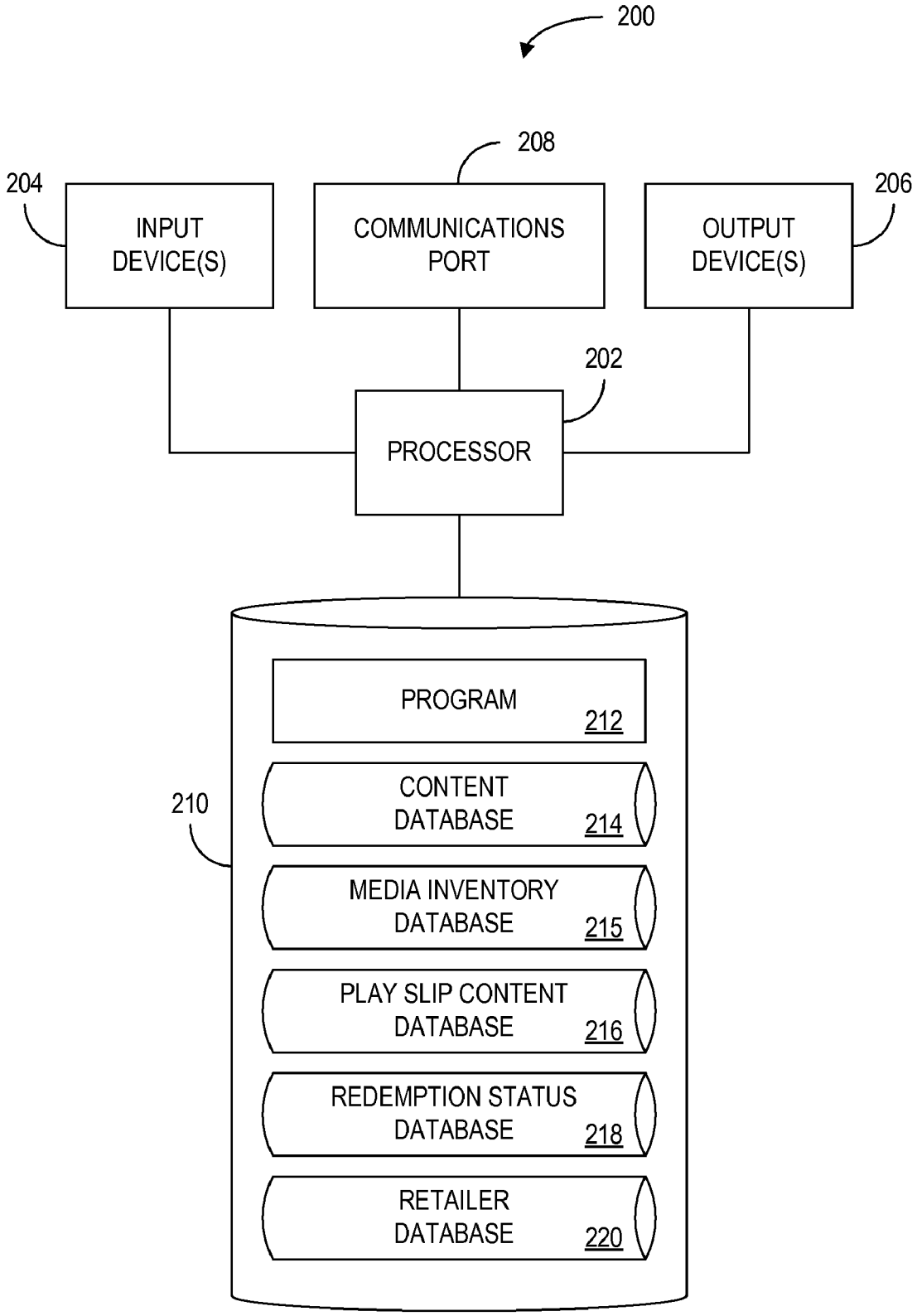
FIG. 2 is a block diagram overview of an exemplary controller according to an embodiment of the present invention.

FIG. 2 is a block diagram illustrating an embodiment of the components of a controller 200. The controller 200 may include one or more processor(s) 202 such as the PENTIUM® processor manufactured by INTEL Corporation, or the AMD Athlon® processor manufactured by the Advance Micro Devices company. Such a processor 202 functions to process instructions, and in particular, to operate in accordance with various methods described herein. For example, the processor 202 may operate to allow the controller 200 to transmit data to (and receive data from) the lottery retailer terminal 300 shown in FIG. 3. More specifically, the controller processor 202 may enable the transmission of data defining or identifying a lottery product, as well as information defining one or more payout(s) associated with that lottery product to a specific one of the lottery retailer terminals shown in the network 100 of FIG. 1. Thus, the controller may be implemented as a system controller, a dedicated hardware circuit, an appropriately programmed general-purpose computer, or any other equivalent electronic, mechanical or electromechanical device. In various embodiments, a controller may comprise, for example, a personal computer (e.g., which communicates with a remote lottery sales terminal) or mainframe computer.

The controller 200 may further include one or more input device(s) 204. Examples of such input devices include a keypad, a mouse, a touch-screen, a random number generator, a microphone, and other digital or analog input devices. According to some embodiments, the controller input device(s) 204 may comprise or include a clock. As described above, the clock may be employed to derive time and/or date information for use by the lottery controller 200 to (i) generate a data record corresponding to play slips, lottery tickets or lottery entries purchased at the lottery retailer terminal 200, and/or (ii) determine redemption time and/or date information associated with play slips, lottery tickets and/or lottery entries.

The embodiment of the controller 200 further includes one or more output device(s) 206. Example of output devices 206 include a monitor or other display for outputting information to a user of the controller (e.g., for displaying information such as statistical or sales data, win and loss information and/or payout amounts), a printer for producing a physical record (e.g., a report, a paper slip, a voucher, a coupon, a ticket) of such data, and the like. In addition, the controller 200 may include one or more communications ports 208, such as a serial port, modem or the like, operable to facilitate two-way data communications between (i) the operator controller 200 and (ii) one or more lottery retailer terminals 200, as described above with respect to FIGS. 1 and 2.

The controller 200 may also include a data storage device 210 (e.g., a hard disk or hard drive, a media-based (removable) memory, or the like). In some embodiments, the controller data storage device 210 stores at least one software program 212, which includes a program to enable the processor 202 to perform some or all of the various steps and functions of at least one implementation of the methods described in detail herein. In addition, the controller data storage device 210 may operate to store a content database 214, a media inventory database 215, a play slip content database 216, a redemption database 218, and a retailer database 220.

In some embodiments, the controller may include a lottery product server device that is located at a lottery product production facility, and may also function to manage the production process. The controller may also function to develop a lottery game matrix (e.g., determining payouts, content, content events, criteria, attributes, etc.) and to match content for a lottery game with secure paytable (or payout distribution) data. In some embodiments, a printer device for use in such lottery systems may utilize the game matrix information from the lottery server and may apply it to the secure paytable data.

4. Lottery Retailer Terminal

Figure 3:
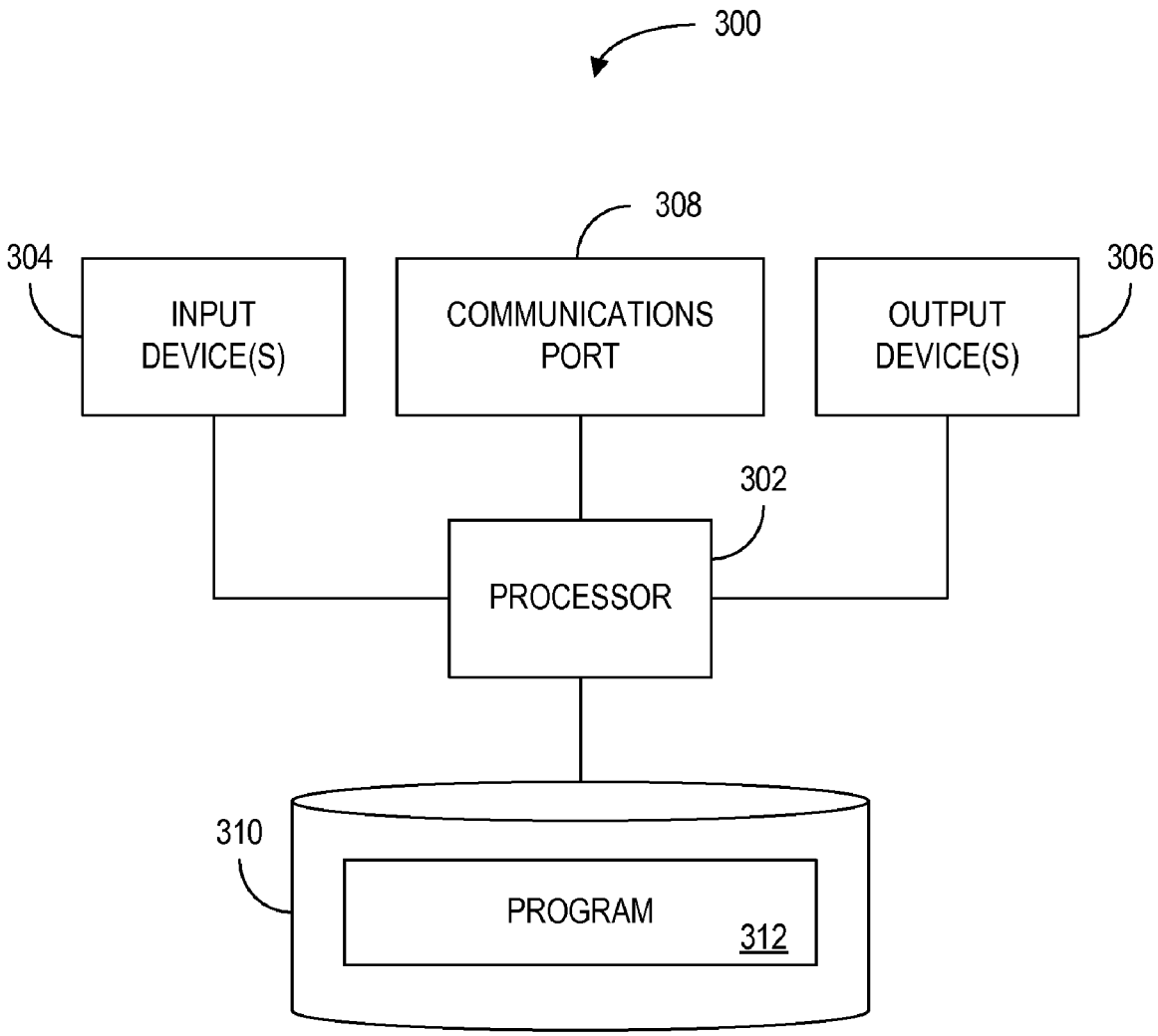
FIG. 3 is a block diagram overview of an exemplary retailer terminal according to an embodiment of the present invention.

FIG. 3 is a block diagram 300 of some exemplary components of a lottery retailer terminal. The lottery retailer terminal 300 may include one or more processor(s) 302 such as the PENTIUM® processor, manufactured by INTEL Corporation, or other processors manufactured by other companies, such as the AMD Athlon® processor manufactured by the Advance Micro Devices company. Generally, the processor 302 is operative to perform or process instructions, and in particular, to operate in accordance with the various methods described herein. For example, the processor 302 may be operable to allow the lottery retailer terminal 300 to transmit data to (and receive data from) the controller 140 of FIG. 1. More specifically, the processor 302 may enable the transmission of data defining or identifying a lottery product (e.g., a play slip).

Accordingly, the lottery retailer terminal 300 may further include one or more input device(s) 304. The input devices may include components such as an optical scanner and/or a barcode scanner, for reading and/or for deriving information associated with a lottery entry (e.g., a play slip). For example, a lottery product may include registration marks, authenticity data, various codes, micro-printed indicia, one or more sense marks, and/or other lottery indicia that must be read, for example, to distinguish between one or more play slips. Examples of additional input devices include, but are not limited to, a keypad, a mouse, an image capturing device (e.g., an optical character recognition (OCR) device), a biometric reader, a portable storage device (e.g., a memory stick), and the like.

According to some embodiments, the lottery retailer terminal input device(s) 304 may comprise or include a clock. The clock may be employed to detect, derive and/or append time and/or date information for use by the controller 140 to: (i) create a data record corresponding to lottery products purchased at the lottery retailer terminal 300, and/or (ii) to determine redemption time and/or date information associated with lottery products.

The lottery retailer terminal 300 of FIG. 3 may further include one or more output device(s) 306. Such output device(s) 306 may include such components as a display for outputting information to a lottery player or to a terminal operator (e.g., win/loss information and/or payout amounts), one or more benefit output devices (e.g., a cash drawer, a currency dispenser), a printer for producing a physical record (e.g., paper slip, receipt, ticket, voucher, coupon, etc.) that defines a lottery product, audio/video output device(s), and the like.

The lottery retailer terminal 300 may also include one or more communications port(s) 308, such as a serial port, modem or the like. Generally, the communications port 308 may be operable to facilitate two-way data communications between (i) the lottery retailer terminal 300 and (ii) the controller 140 shown in FIG. 1. In accordance with some embodiments, the communications port 308 may operate to facilitate the transmission of information between the lottery retailer terminal 300 and a player device such as a personal digital assistant (PDA), cell phone and/or a dedicated (e.g., a proprietary) device.

The lottery retailer terminal 300 may further include a data storage device 310 such as a hard disk, optical or magnetic media, random access memory (RAM) and/or read-only memory (ROM), or the like memory device. Generally, the lottery retailer terminal data storage device 310 stores a software program 312, the software program 312 enabling the processor 302 of the retailer terminal 300 to perform various functions including some or all of the various steps described herein. For example, as noted above with respect to FIG. 1, in accordance with some embodiments, the retailer terminal 300 may be configured to perform some or all of the functions of the controller (and vice versa) such that the controller 140 and the lottery retailer terminal 300 (or, referring to FIG. 1, a given lottery terminal and controller pairing) may be considered as the same "device". An example retailer terminal available in the marketplace is the EXTREMA® clerk-operated lottery terminal, distributed by Scientific Games Corporation of Alpharetta, Ga.

In some embodiments, a lottery sales device may be utilized in place of a lottery retailer terminal 300. Such a lottery sales device may be implemented as a system controller, a dedicated hardware circuit, an appropriately programmed general-purpose computer, or any other equivalent electronic, mechanical or electromechanical device. Thus, in various embodiments, a lottery sales device may comprise, for example, a Video Lottery Terminal that may include a touch sensitive screen for use by a player, a personal computer (e.g., which communicates with a remote lottery server), a telephone, or a portable handheld device (e.g., a device similar to a personal digital assistant (PDA) or other analog or digital communications device). The lottery sales device may comprise any or all of the devices of the aforementioned systems. In some embodiments, a user device such as a PDA, cell phone, and/or portable gaming unit (e.g. the Playstation™ Portable (PSP), distributed by Sony Corporation) may be used in place of, or in addition to, some or all of the device components.

5. Player Device

Figure 4:
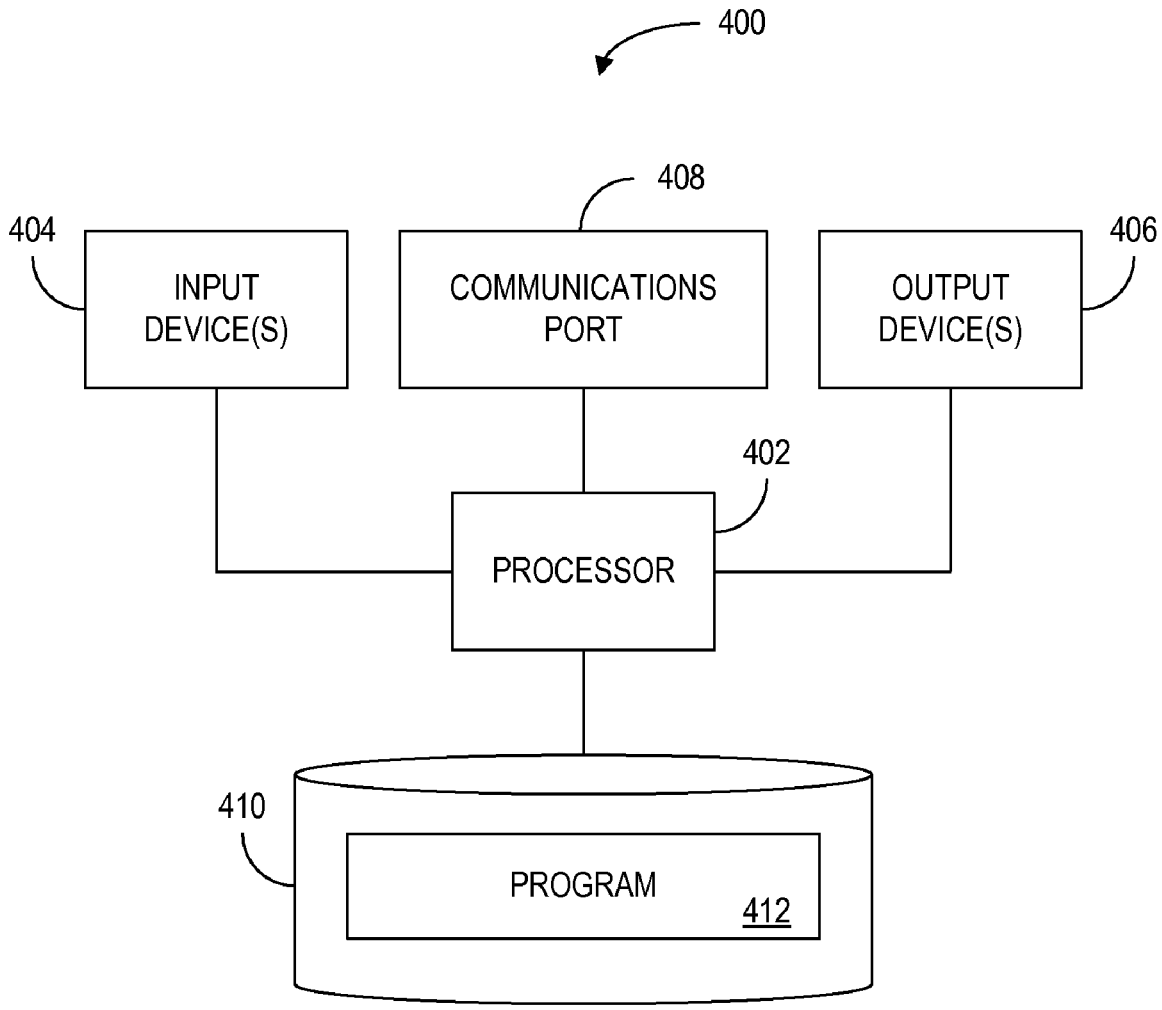
FIG. 4 is a block diagram overview of an exemplary player device according to an embodiment of the present invention.

FIG. 4 is a block diagram 400 of some exemplary components of a player device that may be used in one or more embodiments of the present invention. The player device 400 may include one or more processor(s) 402 such as the PENTIUM® processor, manufactured by INTEL Corporation, or other processors manufactured by other companies, such as the AMD Athlon® processor manufactured by the Advance Micro Devices company. Generally, the processor 402 is operative to perform or process instructions, and in particular, to operate in accordance with the various methods described herein. For example, the processor 402 may be operable to allow the player device 400 to transmit data to (and receive data from) the controller 140 and/or retailer terminal 150 of FIG. 1. More specifically, the processor 402 may enable the transmission of data defining or identifying content or other aspects of a lottery product (e.g., a play slip identifier).

Accordingly, the player device 400 may further include one or more input device(s) 404 such as, but not limited to, a keypad, a mouse, an image capturing device (e.g., an optical character recognition (OCR) device), a biometric reader, a portable storage device (e.g., a memory stick), and the like.

The player device 400 of FIG. 4 may further include one or more output device(s) 406. Such output device(s) 406 may include such components as a display for outputting information to a lottery player or to a terminal operator (e.g., win/loss information and/or payout amounts); a printer for producing a physical record (e.g., a copy of a play slip) that identifies a lottery product, audio/video output device(s) for presenting audio/video content, and the like.

The player device 400 may also include one or more communications port(s) 408, such as a serial port, modem or the like. Generally, the communications port 408 may be operable to facilitate two-way data communications between (i) the player device 400 and (ii) the controller 140 and/or retailer terminal 160 shown in FIG. 1.

In accordance with some embodiments, a player device may comprise a personal digital assistant (PDA), cell phone, a dedicated (e.g., a proprietary) device, a mobile terminal, cellular phone, wristwatch, alphanumeric pager, CD player, mp3 player, IPOD® player by APPLE, DVD player, portable gaming unit (e.g. the Playstation™ Portable (PSP), distributed by Sony Corporation), laptop computer, set-top device, television, or the like. Some other examples of player devices that may be useful for receiving and/or outputting content associated with a lottery game (e.g., audio/video content) are discussed further below with respect to some of the keno-based embodiments.

The player device 400 may further include a data storage device 410 such as a hard disk, optical or magnetic media, random access memory (RAM) and/or read-only memory (ROM), or the like memory device. Generally, the player device data storage device 410 may store a software program 412, the software program 412 enabling the processor 402 of the player device 400 to perform various functions described herein. For example, as noted above with respect to FIG. 1, in accordance with some embodiments, the player device 400 may be configured to receive content (e.g., via a retailer terminal 160).

According to some embodiments, for example, where presentation content associated with a lottery game comprises audio/video content (e.g., digital audio/video content), the player device may be configured or otherwise equipped to output such content. Note that in some embodiments, a player device may not be required in order to enable a player to receive certain types of presentation content. For example, according to some embodiments, a presentation content medium may be embodied as printed content or printed materials (e.g. as an illustrated booklet), in which case, a dedicated device may not be required in order to enable a player to perceive or otherwise receive the presentation content.

6. Other Devices

In some embodiments, a kiosk (not shown) or other device may be configured to execute or assist in the execution of various lottery game processes. In an implementation, a kiosk may comprise a processor and a storage device or memory as described above. A kiosk may also comprise various input devices (e.g., a keyboard, a mouse, buttons, an optical scanner for reading barcodes or other indicia, a CCD camera, and the like), output devices (e.g., a display screen, audio speakers), benefit output devices (e.g., a coin tray, a currency dispenser), communications ports, and the like. A kiosk may be configured to communicate with a lottery controller or lottery server. In some embodiments, kiosks may execute or assist in the execution of various lottery functions, as described herein.

In some embodiments, a media server (such as the video server discussed below with respect to some keno-based embodiments) may be used to deliver content to a player and/or to a retailer.

In some embodiments, players may use one or more computing devices to obtain more information about lottery games, and/or the specific lottery game that the player is playing. For example, a player may utilize a personal computer to access a website that contains or offers access to content associated with a lottery game (e.g., downloadable video), lottery game hints, lottery game instructions, winning lottery product payout information that includes redemption value information (if applicable), and the like.

7. Content Database

It should be understood that the various database examples described herein include illustrative accompanying data as shown in the drawings. Consequently, the data appearing in the databases is exemplary in nature, and such data entries are not limiting with regard to functionality or to the types of data that may be stored therein.

FIG. 5 is a tabular representation of one embodiment 500 of a content database 214 that may be utilized by a controller. Content database 500 stores data associated with one or more types or instances of content (e.g., a particular episode of a television program, a particular movie, a particular song, or a particular podcast). In general, the content database 500 stores information that may be used (e.g., by the controller) to determine content events, criteria, attributes, and the like for a lottery product associated with the content. Generally, the content database may store content data that may be useful for creating presentation media and/or associating one or more content providers with specific presentation content. For example, where the presentation content is embodied as a digitally recorded episode of a television show, a television studio or other production entity may be associated with that particular show. Similarly, where presentation content is embodied as printed material (e.g. an illustrated booklet), the associated content provider may include a publisher, author, clearinghouse, copyright or trademark holder, etc.

The database 500 includes a content identifier field 502 that identifies the content. The content identifier field may store, for each record in the content database, a unique identifier that identifies the content of the corresponding record. The unique identifier may be any numeric, alphanumeric or other type of code that uniquely identifies the presentation content associated with the corresponding record.

A content provider identifier field 504 is also included for storing information identifying a particular content provider that provided the corresponding content. Such information may be useful, according to some embodiments, for providing a payment (by the managing or commissioning authority) in exchange for use of the content for a lottery game. For each instance of content identified by an entry in the content identifier field, a content provider identifier field may store data representing a provider of the associated content. As mentioned above, the associated content provider may include a publisher, copyright or distribution rights holder, etc. For example, where the content is embodied as a digitally recorded feature film, the information stored in the content provider identifier field may correspond to a production studio associated with the particular feature film. According to some embodiments, the information stored in the content provider identifier field may correspond or index to further information regarding the content provider in a separate content provider table or database. For example, the information stored in the content provider identifier database may correspond to contact information and/or billing/account information associated with the content provider of the corresponding record.

Content description field 506 includes an indication of a description of the corresponding content (e.g., an indication of the name of a television show, a particular episode, a broadcast date). For each instance of content identified by an entry in the content identifier field, a content description field may store data representing a generic description of the associated content. For example, where the content is embodied as a digitally recorded episode of a television show, the information stored in the content description field may comprise a written description of the particular episode instance (e.g. the season in which the episode originally aired, the name or other identifier of the episode, etc.).

Content field 508 may include an embodiment of the content or, for example, a pointer to a location where the content is stored. For example, the content field 508 may store a video or audio file for use with a lottery game. The content may be used, for example, for determining potential events or attributes for use in a lottery game and/or for producing units of the content (e.g., for creating DVDs). For each instance of content identified by an entry in the content identifier field, a content field may store data representing the actual content associated with the corresponding record. For example, where the presentation content is embodied as digitally recorded audio/video content, the information stored in the content field may include a file for storing the content in appropriate format (e.g. .mpg2). Similarly, where content is embodied as printed material(s), the information stored in the content field may include one more appropriate file(s) for storing information that may be used to produce the printed material(s), including e.g. text files, pdf files, graphic files, etc.

Some additional examples of content are discussed elsewhere in this disclosure (e.g., many examples of video content, content events, content embodiments, attributes, etc. are discussed below with respect to some embodiments focusing particularly on keno games).

8. Media Inventory Database

FIG. 6 is a tabular representation of one embodiment 600 of a media inventory database 215 that may be utilized by a controller. Media inventory database 600 stores data associated with one or more units of media (also sometimes referred to herein as a unit of content). In general, the media inventory database 600 stores information relating to actual units of media distributed to players, sold to players, and/or available for sale or distribution. According to some embodiments of the present invention, media may be made available (e.g., by a managing authority via lottery retailers) for viewing or other consumption by viewers, player, or purchasers. The media may (or may not) be associated with a sale price. For example, in some embodiments, units of media may be freely distributed.

The database 600 includes a media unit identifier field 602 that identifies a unit of media. For each unit of media inventory represented by a record in the media inventory database, a media unit identifier field may store an identifier that corresponds to one of: (i) a specific unit of presentation media inventory and/or (ii) a generic unit of presentation media inventory of a specific type. For example, the information stored in the media unit identifier field may identify one specific unit of inventory corresponding to the associated record (e.g., a specific DVD of a television episode (for which there may be many substantially identical DVDs)). Alternatively, or in addition, the information stored in the media unit identifier field may identify a general class, category or type of media. For example, the information may identify all units of presentation media corresponding to a particular brand, type or subset of presentation content (e.g., all units of a particular episode of a television show, all units of any episode of a particular television show, all units of a given volume of published (printed) presentation content, etc.).

The database 600 further includes a content provider identifier field 604. For each instance of presentation content inventory identified by an entry in the media unit identifier field, a content provider identifier field may store data representing a provider of the associated content. As mentioned above with respect to the content database 500, the information stored in the content provider identifier field may operate to identify one or more content provider(s), which may include e.g. a publisher, copyright or distribution rights holder, etc. According to some embodiments, the information stored in the content provider identifier field 604 of FIG. 6 may index to information stored in the content provider identifier field 504 of FIG. 5.

The database 600 further includes an activating/purchasing terminal identifier field 606. For each instance of content inventory identified by an entry in the media unit identifier field, an activating/purchasing terminal identifier field may store data representing a particular retailer terminal from which a given unit of presentation media was purchased and/or at which such media was activated for use in accordance with the present invention. According to some embodiments, the activation and/or purchase of a given unit of media inventory may trigger the controller to issue a particular (predetermined) play slip. That is, according to some embodiments, the activation and/or purchase of a given unit of media inventory may correspond to the entitlement of a particular payout to the activating purchaser/player, as will be explained further in this disclosure.

The database 600 further includes an associated play slip identifier(s) field 608. For each instance of content inventory identified by an entry in the media unit identifier field, an associated play slip identifier(s) field may store data representing one or more play slip(s) associated with the unit or type of media defined by the corresponding record. According to some embodiments, each instance of media may be associated with a predetermined play slip and/or payout.

According to some embodiments, a unit of media inventory may be associated with more than one play slip. For example, a unit of audio/video content may be associated with more than one play slip, each of which may be utilized in a multiplayer game. Depending on the format of the multiplayer game, none, one or more than one of the associated play slips may be redeemable for a payout. For example, where three play slips are associated with a given unit of media inventory, only the play slip having the highest redemption value of all three may be redeemed. Alternatively, each of the three play slips may be redeemable for separate (e.g., unique) redemption values/payouts, or two or more of the three play slip/game tickets may be redeemed for matching values (e.g. all three may be redeemed for the highest redemption value of any one play slip of the group). Other multiplayer game embodiments are discussed in this disclosure (e.g., with respect to redemption database 800 of FIG. 8).

In accordance with other embodiments, the information to be stored in the play slip identifier(s) field may be determined at the time of the purchase and/or activation of a unit of media inventory. For example, presentation media of a particular type may be associated with a plurality of payouts and/or play slips. At the time of purchase or activation of a unit of that type of presentation media, a corresponding payout may be determined (e.g., by the controller or retailer terminal accessing a payout database associated with the presentation media type). For example, the inventory of presentation media may comprise one hundred DVD copies of a particular episode of a television show, and the particular television show (i.e., type of content) may be associated with one hundred predetermined payouts. Each of the predetermined payouts may be randomly issued to players via play slips, for example, upon purchase and/or activation of each unit of presentation media, by accessing a centralized database (e.g., stored at the controller) storing information associated with each of the one hundred predetermined payouts.

Database 600 further includes a field 610 indicating whether the media unit is eligible for more than one game instance. For each instance of content inventory identified by an entry in the media unit identifier field, a field may store data representing whether or not the play slip(s) associated with a given unit of presentation media inventory is eligible for one (or more than one) game instance, as will be explained further below.

9. Play Slip Database

FIG. 7 is a tabular representation of one embodiment 700 of a play slip content database 216 that may be utilized by a controller. Play slip content database 700 stores data associated with one or more play slips. Generally, the play slip content database may operate to store information for use in generating (e.g., printing) play slips and for enabling their use by players in order to determine whether they are entitled to a payout based on (i) media content and (ii) information contained on or embodied by the play slip (e.g., attributes or criteria for a winning play slip).

For example, as contemplated by some embodiments of the present invention, information from a play slip may be compared to information from a medium in order to enable a game player/purchaser to determine whether he or she is entitled to a payout. For example, where the medium is embodied as a digitally recorded episode of a television show on a DVD, the play slip may include information identifying and/or describing one or more attributes or criteria that must be contained within the television show in order for the player to be entitled to an associated payout (e.g. a particular character must speak a specific phrase, a particular character, prop and/or scene must appear, etc.). Of course, it will be readily understood it may not be necessary for the player (or a retailer) to determine that the content meets the criteria by actually watching the television show. Instead, the play slip may be associated with the appropriate payout and the player may be provided the payout upon, for example, presenting a valid play slip to a retailer.

Where the presentation media is embodied as printed material (e.g., an illustrated booklet), the play slip may include information identifying and/or describing one or more attributes or criteria that must be contained within the printed material in order for the player to be entitled to an associated payout (e.g., a particular word or phrase must appear on a given page, a particular character, icon or scene must be depicted at some juncture, etc.)

Database 700 includes a play slip identifier field 702 that identifies a play slip. Each play slip corresponding to an associated entry in the play slip content database may be identified via an entry in the play slip identifier field. According to some embodiments, the information stored in the play slip identifier field 702 of database 700 may correspond to or index to information stored in the play slip identifier(s) field 608 of FIG. 6.

Database 700 further includes a content identifier field 704. For the play slip corresponding to an entry in the play slip content database, a content identifier field may store information identifying the particular content associated with that play slip. According to some embodiments, the information stored in the content identifier field 704 of FIG. 7 may correspond to or index to information stored in the content identifier field 504 of FIG. 4 and/or content identifier field 604 of FIG. 6, as described above.

Database 700 further includes award attribute 1-N and payout for award attribute 1-N fields 706, 708, 710, and 712. Generally, for each play slip corresponding to an associated entry in the play slip content database, a first award attribute field may operate to store information describing or otherwise identifying a first criteria, condition, or (potential) content event associated with the presentation content that must be satisfied in order to entitle a player to a corresponding payout (e.g., as indicated in field 708). In some embodiments, as indicated in database 700, the attribute field may indicate a template attribute (e.g., with variables for which values may be provided from other stored information.

For example, where the content is embodied as a digitally recorded episode of a television show, the first award attribute field may store data indicating that if phrase [X] is spoken by character [Y], the corresponding award would be $250,000,000, where [X] and [Y] may be replaced, in generating a play, with appropriate values (e.g., based on the corresponding content and/or payout assigned to the play slip, as discussed further in this disclosure. It will be understood that the indicated character and/or phrase may (or may not) actually occur within the presentation content (i.e., the attribute may indicate a potential content event, but not an actual content event). Thus, a player may purchase a unit of presentation media (e.g., a DVD) and receive a play slip bearing information that may be compared by the player to the DVD content, enabling the player to determine whether they are entitled to receive a payout, and potentially enhancing the entertainment value for the player of both the lottery game and the content.

Similarly, for each play slip corresponding to an associated entry in the play slip content database, another Nth award attribute field may operate to store information describing or otherwise identifying an Nth criteria associated with the content that might be satisfied by the content and entitle a player to a payout, where N represents an integer greater than 1. For example, where the corresponding content is embodied as a digitally recorded episode of a television show, the first award attribute field may store data identifying, for instance, a character and/or phrase that may (or may not) occur within the presentation content and an Nth award attribute field may store data identifying, for instance, a prop or scene that may occur within the presentation content. Thus, a player may purchase a unit of content (e.g. a DVD) and receive a play slip bearing information that may be compared to the content in more than one way, in order to enable the player to determine whether they are entitled to receive a payout.

As shown in FIG. 7, each award attribute 1-N may correspond to an associated payout, information identifying which may be stored in a corresponding payout for award attribute field 1-N. Generally, payouts associated with award attributes may be in the form of cash or equivalent; however, such payouts may further (or alternatively) include merchandise, services, etc.

10. Redemption Status Database

FIG. 8 is a tabular representation of one embodiment 800 of a redemption status database 218 that may be utilized by a controller. Redemption status database 800 stores data associated with one or more play slips. Generally, the redemption status database 800 may store data relating to play slips, including a respective redemption value of each play slip, and whether such play slips have been presented for redemption by players/purchasers.

Database 800 includes a play slip identifier field 802 that uniquely identifies the play slip corresponding to the entry in the database, as described above with respect to FIGS. 6 and 7.

Redemption value field 804 includes an indication of the redemption value for that corresponding particular play slip. For each play slip corresponding to an associated entry in the redemption status database, the redemption value field may store information defining a final or total payout associated with the play slip identified in the corresponding record. According to some embodiments, the information stored in the redemption value field of the redemption status database may correspond to the sum of one or more payout(s) for award attributes, as described above with respect to FIG. 7.

For example, where, in accordance with some embodiments, the associated content meets more than one award attribute, the information stored in the redemption value field 804 of FIG. 8 may correspond to the sum of all such attributes 1-N. Alternatively, an instance of media may be associated with only one award attribute, the payout for which may be represented in the corresponding redemption value field 804 of FIG. 8.

For each play slip represented by a record in the redemption status database 800, a redemption status field 806 may operate to store data representing the status of the associated play slip of the corresponding record. For example, redemption status field 806 may include an indication of whether the value of a play slip or lottery product has been redeemed (e.g., whether a player has submitted a redemption request to request the redemption value; whether a player has actually been provided the value corresponding to the lottery product). In one embodiment, the redemption status field may store information representing whether or not an available payout associated with the given product has been issued, claimed or awarded.

Some types of statuses that may be indicated in the redemption status field may include, for example, (i) PENDING or OUTSTANDING, whereby a play slip has been issued to a player/purchaser, but has yet to be presented for the purpose of collecting any associated payout(s), (ii) REDEEMED, whereby a play slip has been presented (e.g., to a retailer or other agent) for the purpose of collecting any payout(s) associated therewith; and/or (iii) N/A, UNSOLD, or AVAILABLE, whereby a play slip has not yet been issued to a player/purchaser. Other types of indications may be appropriately utilized for the desired implementation.

In one embodiment, a redemption request to redeem a lottery product is received, and then a determination is made as to whether the lottery product is a winning product (e.g., whether the lottery product is associated with a positive monetary value or other redemption value). For example, a player presents his play slip to a clerk who scans a barcode on the play slip into a lottery retailer terminal, and then a server/controller provides information about that lottery product, which is displayed to the clerk (e.g., via a display of the retailer terminal). The lottery product identifying information may be transmitted from the lottery retailer terminal to the controller, which then compares the product identifier and/or other indicia to data that may be stored in one or more databases. For example, the controller 140 shown in FIG. 1 may receive a redemption request from any of the retailer terminal(s) 150 and 160 and then verify that the lottery product corresponds to a winning product in a product database for a lottery game (e.g., that has not expired).

Typically, if a lottery product is not a winning product then no payout is made to the player. However, if the lottery product is a winning product, then the corresponding payout is authorized. In some embodiments, the lottery controller authorizes the issuance of a lottery payout by transmitting information associated with the determined payout to the appropriate lottery retailer terminal. Such information may then be used to instruct a lottery terminal operator (such as a retail store clerk or cashier) to confer the payout to the player (e.g., a display associated with the terminal may output and/or display an indication to the operator to pay the player an amount of cash).

In accordance with some embodiments, after authorizing the issuance of a payout or other redemption value (e.g., by transmitting information to the appropriate lottery terminal), the controller then updates the appropriate field(s) in the redemption status database 800 to reflect that the lottery product has been redeemed.

Several methods are contemplated by which one or more players may learn (i) which players are winning players for a unit of content (e.g., a DVD), and (ii) amounts of winnings that one or more players may be entitled to claim. For example, such may be evident to one or more players viewing a multiplayer game DVD (e.g., it is evident from watching a television episode on the DVD that a first player wins $20 and a second player wins nothing based on the players' respective criteria for winning). In other embodiments, players may utilize other resources in making such determinations. For example, indications of which players are winning players and/or amounts of winnings associated therewith may be made available via a network such as the Internet (e.g., a player may provide an identifier associated with a presentation medium, such that the player may view such information online). In further embodiments, such information may be encoded or otherwise printed on a purchase receipt of the present invention (e.g., such that a player need not watch a DVD or read a book associated with the game, but rather may ascertain winnings by viewing a ticket or other type of receipt).

Various methods are contemplated whereby players may redeem or claim winnings associated with multiplayer games. Several such methods will now be described in some detail.

In some embodiments, presentation content (e.g., a DVD) may be purchased or otherwise provided that may be experienced by a plurality of players (e.g., by watching and/or listening to the content, as a group or individually). For example, a DVD of a feature film may be purchased by a first individual for $40, who may then receive $10 each from three friends, such that each of the four individuals may have equally contributed to toward the purchase price of the DVD (e.g., each player spent $10). The four individuals may then view the film (e.g., four friends simultaneously watch a television set connected to a DVD player), such that one or more winning players and/or an amount of winnings may be determined (e.g., one of the players is associated with a "phrase that pays" that was spoken by a designated character in the film, and thus is entitled to claim a prize of $50).

In some embodiments, only one player may be entitled to claim an amount of winnings (e.g., in a "winner-takes-all" format). Thus, in some embodiments, a player may redeem a play slip or receipt, by for example, providing a code or identifier associated with a unit of content, such as a code or identifier indicated on the unit (e.g., a barcode and/or text imprinted upon the non-readable side of the disc), on the unit packaging (e.g., a barcode and/or text imprinted upon liner material inserted into a jewel case), a purchase receipt (e.g., a barcode and/or text imprinted upon the receipt), a ticket, and so on.

In one example, a group of players collectively purchasing and/or experiencing presentation content may agree to provide a winning player with such necessary materials (e.g., the winner gets to hold on to a purchase receipt, such that the next time the winner is in a location where the receipt may be redeemed, the winner may present the receipt and claim a prize). A winning player may present an appropriate identifier or code when claiming such a prize. An amount of winnings payable to such a player may be determined in a variety of manners as described in this disclosure (e.g., a lottery retailer scans a barcode or otherwise enters a code or identifier using a terminal, and a database such as a redemption database 800 of FIG. 8 is accessed so as to determine an amount of winnings associated with the unit of content, play slip, the player, or the like).

In some embodiments, such materials may be designed so as to facilitate such redemption. For example, in some embodiments, one or more purchase receipts provided in conjunction with the sale of a lottery chance may comprise a plurality of codes or identifiers (e.g., a plurality of bar codes), each barcode associated with (or that could be associated with) a particular player. For example, if a four-player DVD is sold, a single receipt may comprise four barcodes (e.g., which may be separated by perforation such that they may be detached and distributed), each labeled in association with a particular player (e.g., adjacent to a barcode is text indicating "Player #1").

In another example, four separate purchase receipts may be issued, each one in association with a particular player or chance in the game. Thus, in some embodiments, various methods are contemplated for providing a plurality of identifiers or codes which players may then use when redeeming winnings associated with a multiplayer game (e.g., one or more such receipts may be required during redemption).

In an alternate embodiment, one or more players purchasing entries in a multiplayer game may provide various information (e.g., name, address, etc.) when purchasing such a disc, such that the information may be recorded (e.g., in association with the purchased disc and/or session(s) thereof). Accordingly, when redeeming an amount of winnings associated with such a disc, one or more players may provide (e.g., by requirement) a form of identification (e.g., for verifying that the player is associated with the purchase and/or unit of content and/or play slip and is authorized to redeem winnings). In some embodiments, such a form of identification (e.g., a driver's license, a player tracking card number) may be utilized when determining an amount of winnings payable to a player (e.g., a database is accessed based on a driver's license number).

In some embodiments, more than one player may be entitled to claim an amount of winnings associated with a multiplayer game. For example, a four-player version of lottery game may pay the "best two players" (e.g., the players with the two highest corresponding redemption values may claim those redemption values), and thus two or more players may desire to claim winnings associated with the same unit of presentation content. Accordingly, in some embodiments, a total amount of winnings (e.g., the sum of the first player's winnings and second player's winnings) may be provided to any player presenting one or more codes and/or indicia (e.g., a barcode, a numeric "Prize Claim Code," etc.). In other embodiments, as described, each player must present a code and/or identifier (e.g., barcode) associated with that player in particular (e.g., the player who selected or was assigned to "Play Slip #1" presents his barcode, the player associated with "Play Slip #2" presents his barcode), such that a redemption value associated with the particular player may be accessed (e.g., scanning of a barcode prompts a controller to access a database and determine an amount of winnings payable to a particular player). Of course, alternative methods other than presenting barcodes when redeeming such winnings are contemplated (e.g., players call a particular phone number and provide such a code, provide such a code in another electronic manner, and so on).

Thus, various embodiments are contemplated whereby one or more players may share in the experience of the same presentation content (even the same unit of content), (optionally) determine which players are winners, and then redeem an amount of winnings associated with the one or more winning players.

It should also be noted that, in some embodiments, it is envisioned that a plurality of play slips may be provided for a multiplayer game, but the content is viewed and/or the play slip(s) redeemed by only one player.

11. Exemplary Lottery Products

FIG. 9 is an illustrative representation of a play slip 900 that, in accordance with one embodiment of the present invention, includes information about particular content. The example play slip 900 includes information pertaining to a DVD recording of a particular episode of a television show. In particular, the play slip indicates an identifier that identifies a particular unit of content ("DISK # DD54-4376003-DD23") and identifies the particular content by the name of the television show, the season number, the episode number, and the title of the title of the episode.

The play slip 900 also includes a "PHRASE THAT PAYS!" that indicates one common attribute of a plurality of potential content events. In particular, the play slip 900 indicates a particular phrase ("I'M OUTTA HERE"), a list of characters, and a corresponding list of potential payouts if the respective character speaks the indicated phrase. Thus, play slip 900 indicates a plurality of potential content events, each potential content event having at least two characteristics: a phrase (which is common to all the content events) and a specific character.

The particular criteria that appear on the example play slip 900, and the corresponding indicated payout amounts, may be determined in various ways discussed in this disclosure.

The indicia on a play slip may be used by the player, along with the corresponding content, to discern whether the particular play slip or chance is a winner, in a manner readily understood by those skilled in the art (e.g., whether the corresponding television episode has the "phrase that pays" spoken by a specified character). Of course, as will also be understood, many types of instant games may be redeemable without being played (e.g., without the player actually resolving or determining what the redemption value should be himself), by providing a product identifier (e.g., a barcode for a play slip) to a lottery retailer for verification.

According to some embodiments, in a first edition of a lottery product, a player may be provided with a first redemption value based on a character speaking a particular word or phrase, but in a second edition of the lottery product (e.g., one that includes the same story but uses a different set of winning words or phrases to determine values) a player (the same or a different player) may be provided with a second redemption value that is different from the first redemption value upon the same character speaking the same line.

Figure 14A:
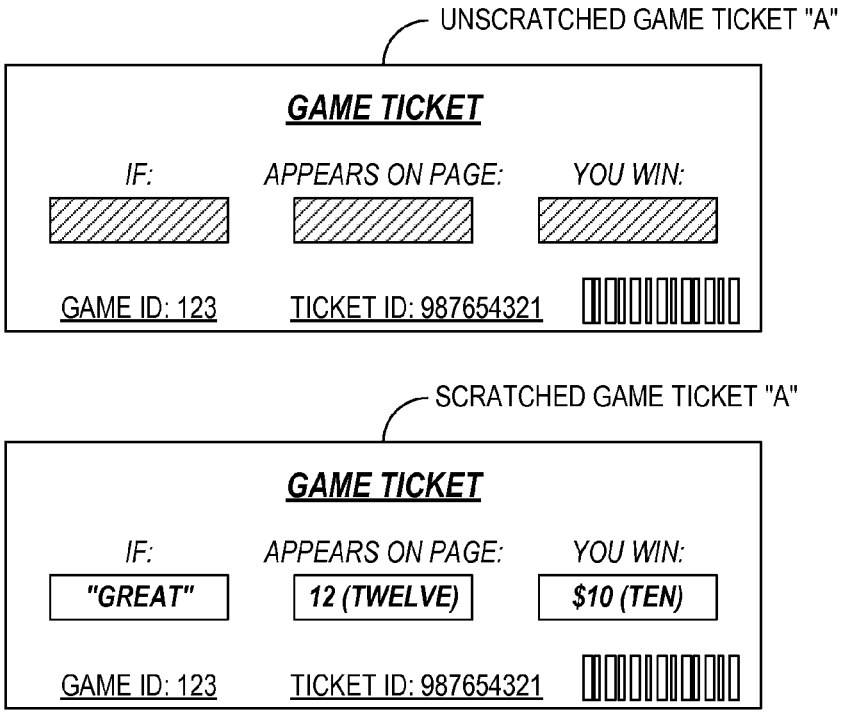
FIGS. 14A and 14B are respective plan views of exemplary game tickets according to embodiments of the present invention.
Figure 14B:
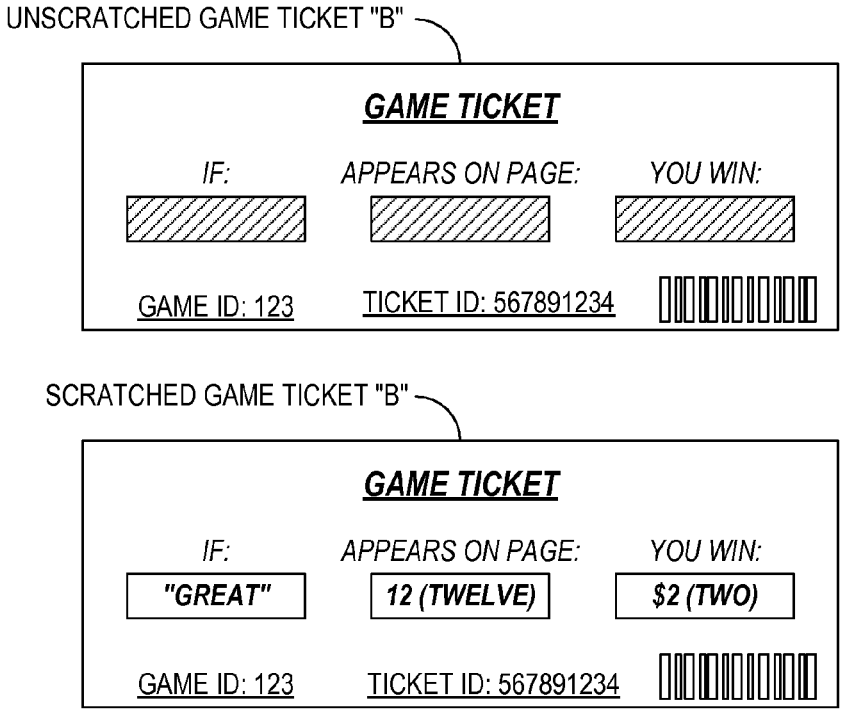

FIGS. 14A and 14B illustrate example game tickets in accordance with one embodiment of the present invention, in which identical criteria (for the same content) may be associated with different payout amounts or redemption values. As illustrated in FIG. 14A, a game ticket ("9876543221") may be provided that includes initially concealed, revealable indicia of an award attribute and a corresponding payout ("$10 (TEN)). As illustrated in FIG. 14B, for the same lottery game ("123"), a different game ticket ("567891234") may be associated with a different payout.

Other embodiments of lottery products are discussed in this disclosure, and various processes for producing such lottery products will be readily understood by those skilled in the art in light of the present disclosure.

12. Processes

Figure 10:
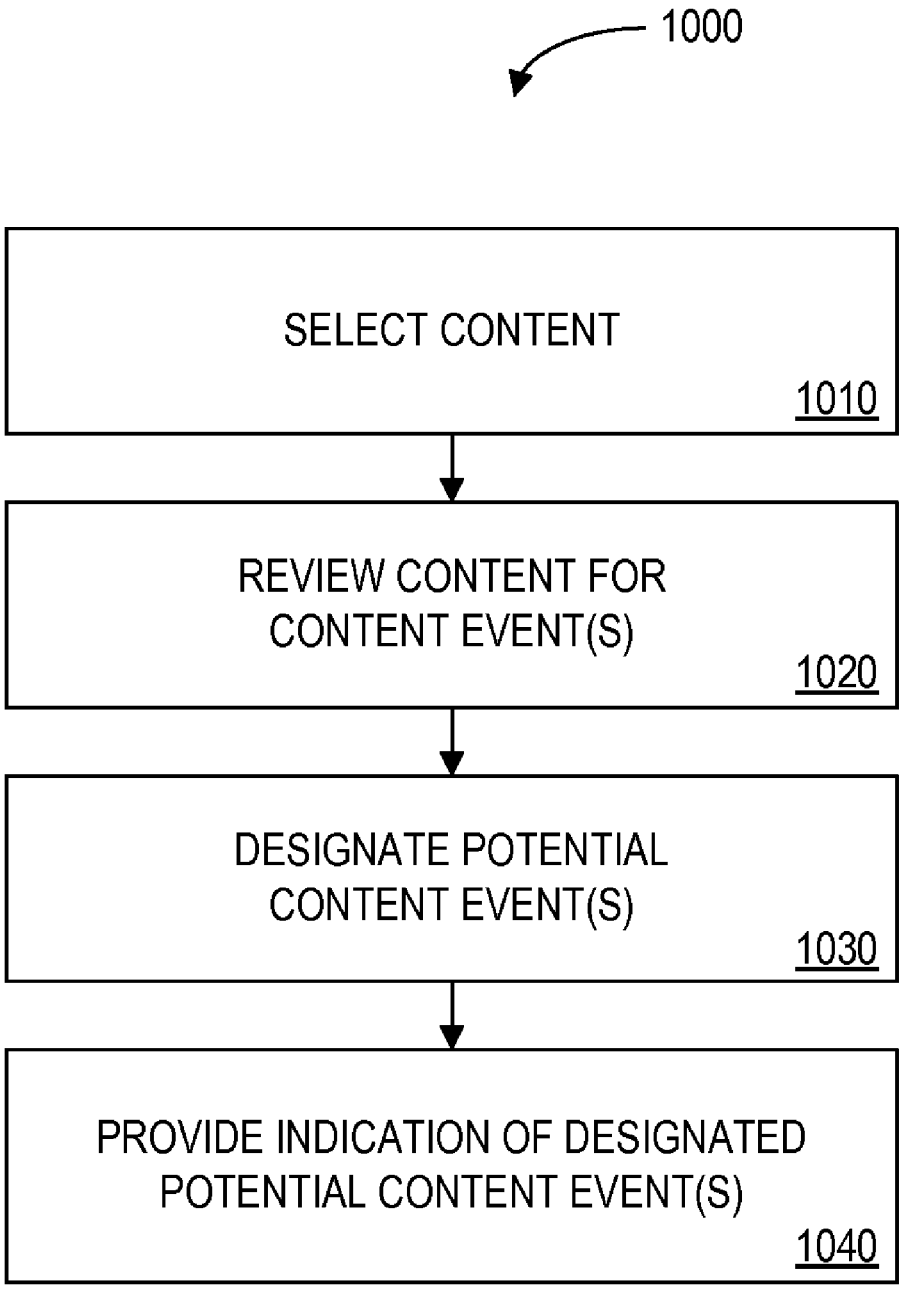
FIG. 10 is a flowchart illustrating an exemplary process according to an embodiment of the present invention.

FIG. 10 is a flowchart of a process 1000 according to one embodiment described in this disclosure. Process 1000 may be performed, for example, by or on behalf of a lottery authority (e.g., a managing or commissioning authority) who contracts with a manufacturer to produce lottery products for one or more lottery games, as will be readily understood by those skilled in the art.

The process 1000 begins with the selection of appropriate content (step 1010). Almost any content can be adapted for use with various embodiments of the present invention, but for convenience discussion here will focus primarily on audio/video content. Embodiments of the present invention contemplate the following non-exclusive list of sources for audio/video content: feature films, including theatrical, extended director's cuts, and edited for television versions; reruns of television or radio shows of any genre; current radio or television shows of any genre, including first run and live broadcasts; sporting events, including live, delayed, and reruns; animated cartoons; situational comedies; syndicated television or radio shows (including satellite radio programming); reality television shows; news; weather; cable television channel programs; short films, including music videos, animated shorts, art house films, and the like; screen captured recordings of massively multiple online role playing games; casino footage of table top game play; nature shows; cooking shows; weather shows; educational documentaries; historical documentaries; music or spoken word tracks; audiobooks; podcasts; and the like. Another possibility, as discussed further below, that could be used as audio/video content is a slide show of photographs or photomontages. In short, almost any video or audio that contains changing imagery and/or dialogue can be selected.

While in some embodiments content comprises single episode style sources of content (e.g., a single episode of a television program, or a single song track), content may include, for example, montages, trailers, teasers, medleys, song mixes, multiple episodes, multiple audio tracks, and similar amalgamations from multiple sources. For example, segments from multiple episodes of a television series may form video content. Similar montages of a sport team's season or history may form video content. A mix of current Top songs (or portions thereof could form suitable audio content).

The audio/video content may be in any executable audio/video programming file such as an MPEG2, MPEG, AVI, MOV, WAV, DivX, MP3, AAC, WMA, or other similar file (with or without digital rights management) as is known in the art. Likewise, the content may be stored in any sort of memory device such as compact disc, digital versatile disc (DVD), optical disc, video home system (VHS) tape, universal serial bus (USB) memory device, hard drive, zip drive, or the like as is well understood, although a portable or transmittable combination of formats and storage systems facilitates use of the present invention.

The content is then reviewed for content events (step 1020). As noted above, a content event is an event that occurs in the content (in contrast to a potential content event, discussed further below). Preferably, at least one actual content event is identified for use in a lottery game. Preferably (but not necessarily) the event is distinctive enough to be recognizable by a player viewing/listening to the content. In some embodiments it may be preferred to identify at least one more obscure event, such that players may find it entertaining to notice the "hidden" event. Exemplary content events may include, but are not limited to: a character entering a scene (perhaps in a distinctive manner), a character leaving a scene, a character delivering a memorable line or quip, the presence of an object, creature, prop, symbol, or landmark in the scene or background, the presence of a particular product, an explosion, a gunfight, an argument, a kiss, the revelation of a secret identity, laugh tracks, a romantic encounter, a reference to a particular company or product (e.g., the event may be related to a product placement in a film or television show), a particular song lyric, particular background music, and the like. Some exemplary content events from an example television series suitable for use in lottery and keno games are discussed below with respect to keno games.

Once at least one content event is determined, at least one potential content event (or, in some embodiments, at least one potential characteristic or attribute of an event) is designated (step 1030). Potential content events may include only events that actually occur in the content, but preferably include at least one content event that does not occur in the content. In other words, it is useful in accordance with some embodiments to identify an event that does not take place, as this information may be used in building a store of information for outputting with various lottery products (e.g., in accordance with a preferred prize matrix or distribution of outcomes).

Having designated at least one potential content event within particular audio/video content, an indication of the designated potential content event(s) are provided (step 1040). For example, such information may be stored in content database 214 and/or play slip content database 216 (e.g., as different award attributes). In another example, the designated potential content event(s) may be output (e.g., on a play slip pre-printed or generated in response to a player's request to purchase a chance in a lottery game).

In some embodiments, as discussed further with respect to keno games below, actual content events may be highlighted as such (e.g., so that they may be more easily recognizable by players). In an exemplary embodiment, the highlighting is done through the use of a cue capable of being perceived by a player. There are numerous types of cues that could be used with content for lottery games; some are discussed further below with respect to keno games, and others will be readily apparent in light of the present disclosure.

In some embodiments, some of the selected content may be removed or altered in an editing process, such as, for example, commercials, mature content, and/or generally abridging the video content to meet time constraints.

In one exemplary embodiment, the selected audio/video content is delivered to an authority (e.g., a commissioning or managing authority) for distribution to lottery retailers. Various ways of delivering content for use in wagering games are discussed in this disclosure. In a first exemplary embodiment, audio/video content is packaged in traditional packaging and delivered (for example, a DVD with the video content is delivered in traditional DVD cases or jewel cases). In a second exemplary embodiment, the audio/video content is an electronic file sent to the intended recipient without a specific storage medium (for example, a file could be attached or embedded in an email or the file could be transmitted wirelessly or over a wire medium to the intended recipient). In this case, the packaging is the delivery mechanism (email, streamed video or audio, and the like as needed or desired). The intended recipient could then store the file in a hard drive or other memory device as needed or desired.

Figure 11:
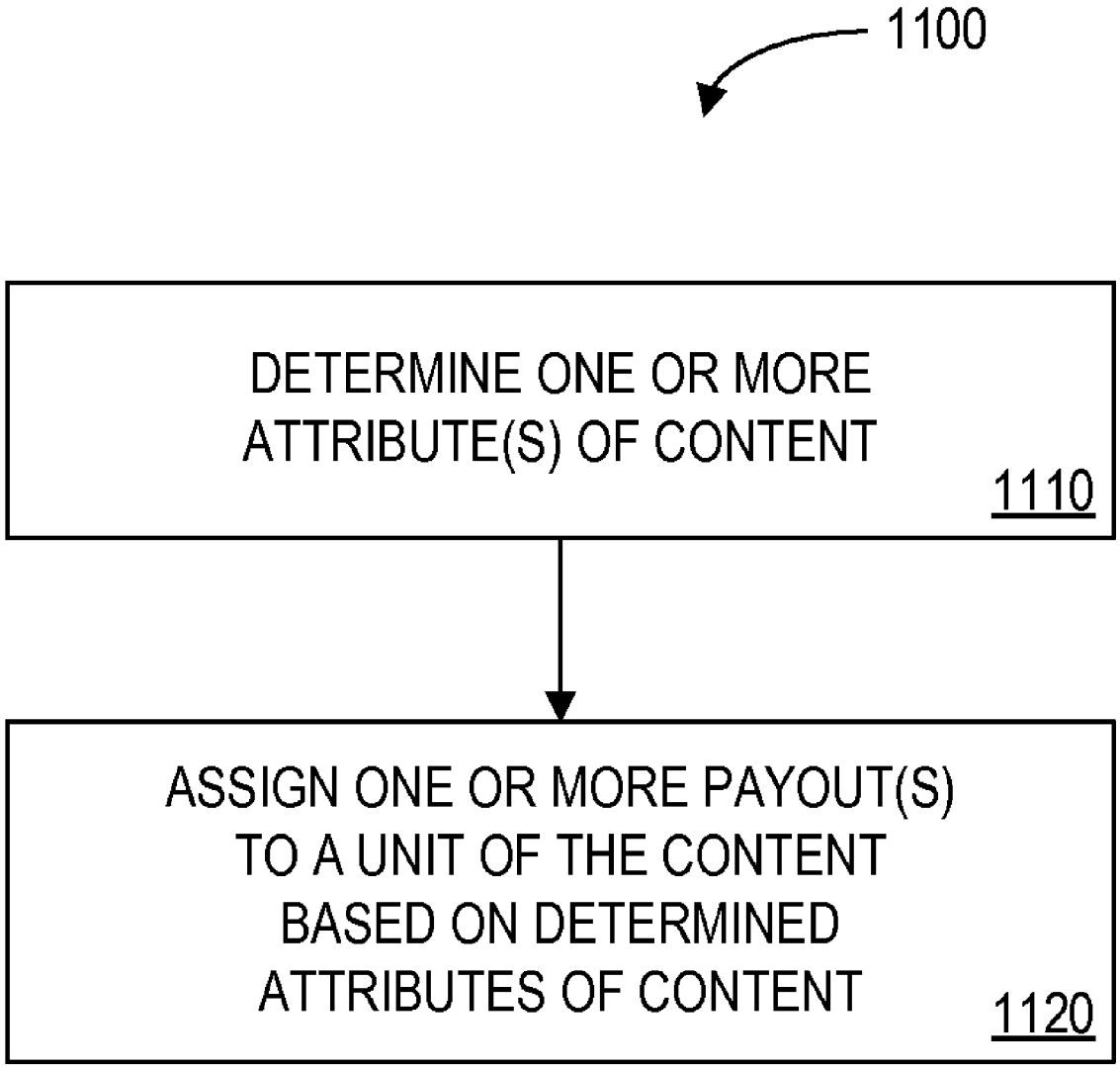
FIG. 11 is a flowchart illustrating an exemplary process for analyzing content according to an embodiment of the present invention.

FIG. 11 is a flowchart depicting one embodiment of a method 1100 of content analysis and payout assignment based on the content analysis, as may be performed by one or more entities (e.g., a game administrator, a managing authority), according to an embodiment of the present invention. The process 1100 starts with identifying or otherwise determining one or more attributes of content (step 1110). Some examples of determining attributes of content are discussed above with respect to process 1000. As discussed in this disclosure, almost any type of printed, audio, or video content can be utilized. In one embodiment, the determined attributes describe only actual content events of the content. One or more payout(s) are assigned to a unit of the content based on the determined attributes of the content (step 1120). Various ways of assigning one or more payout(s) to a particular unit of content based on the determined attributes of the content are discussed in this disclosure, and still others will be readily apparent after consideration of this disclosure.

In one embodiment, assigning a payout to a unit of content comprises assigning one or more payouts to the type of content or generically to all units of that content (e.g., all of the DVDs for a particular television episode).

Figure 12:
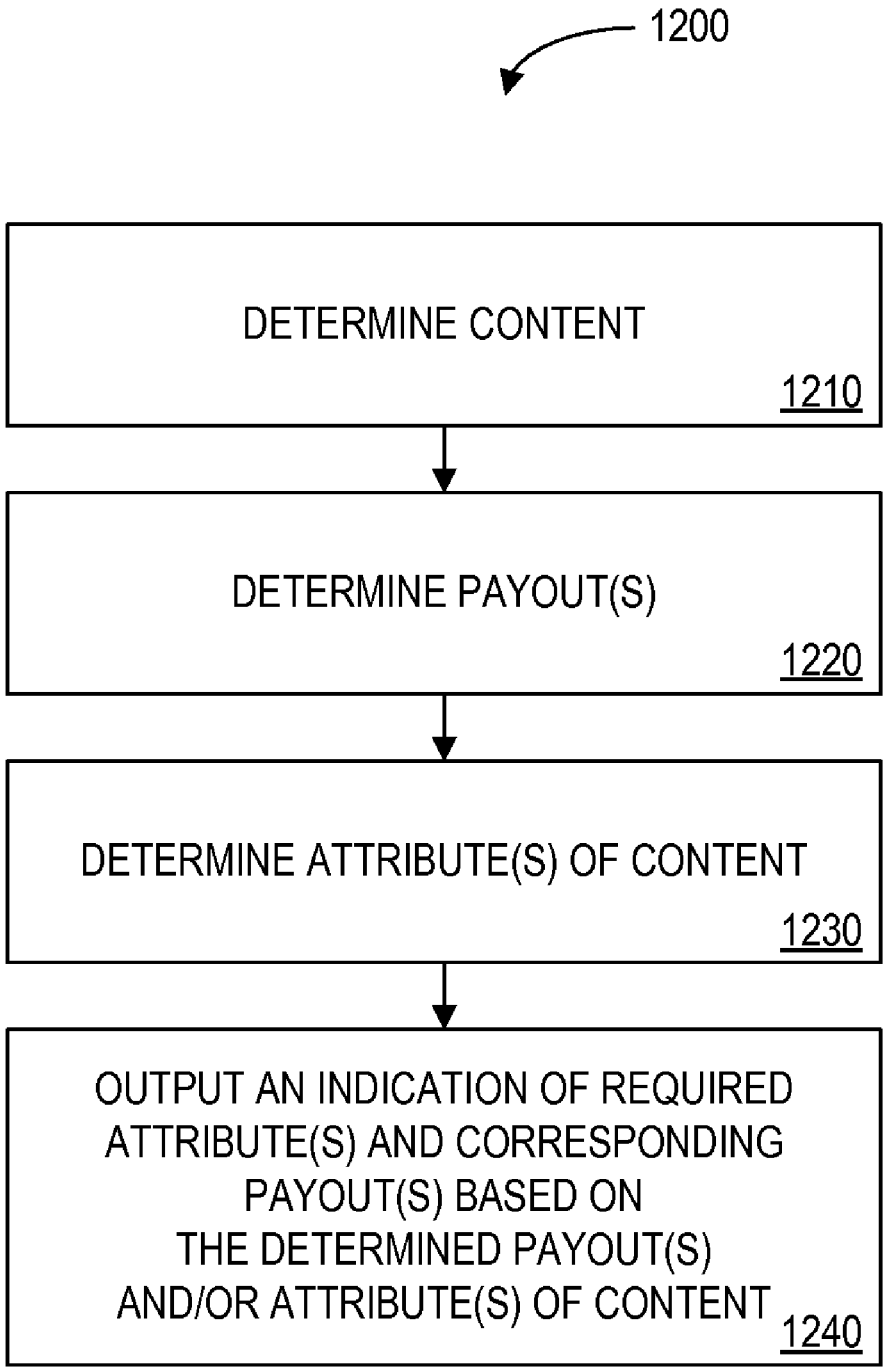
FIG. 12 is a flowchart illustrating an exemplary process for determining attributes of content according to an embodiment of the present invention.

FIG. 12 is a flowchart depicting one example method 1200 for conducting a lottery game in accordance with one embodiment of the present invention. Content (e.g., audio/video content) is determined (step 1210) and one or more payout(s) are determined (step 1220). For example, a managing authority may establish a prize matrix or desired distribution of payouts. One or more attributes of the content are determined (step 1230). Various types of attributes and ways for identifying such attributes are discussed in this disclosure. The one or more determined attributes may include actual attributes of the content, may include fictitious attributes of the content (e.g., dialogue, characters, or combinations of such, that do not make an appearance in the content), or may include both actual and fictitious attributes. As discussed in this disclosure, information about events that do not occur may be useful in creating game play information (e.g., for outputting on play slips).

At step 1240, an indication of at least one required attribute and corresponding payout(s) is output, based on the determined payout(s) and/or the determined attribute(s) of the content. In one embodiment, the indication comprises a potential content event, award attribute, or criteria that a player may compare with the corresponding content to play the game while enjoying the content. For example, required attributes may comprise a "phrase that pays" indicated along with a corresponding payout if the content includes the phrase.

Figure 13:
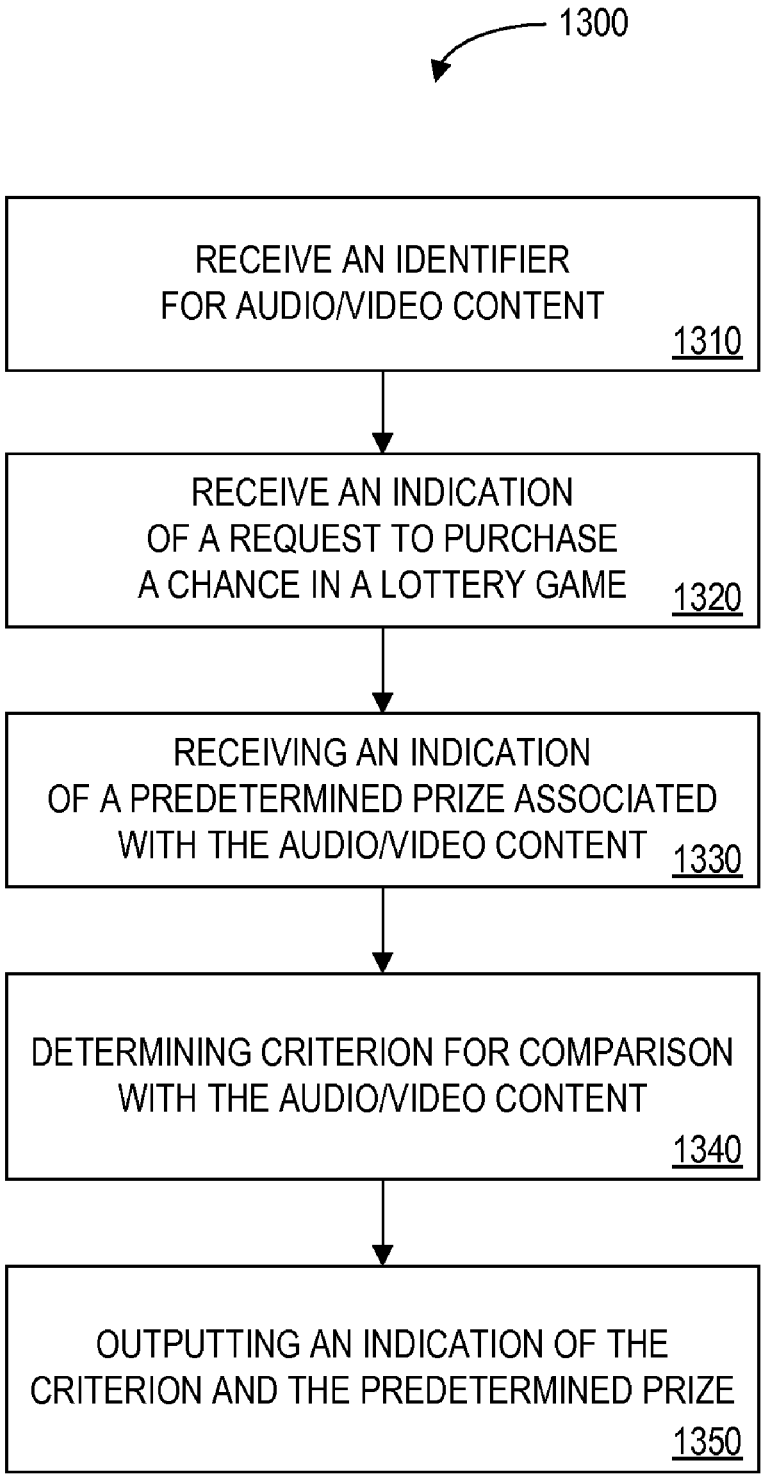
FIG. 13 is a flowchart illustrating an exemplary process for outputting information for a lottery game according to an embodiment of the present invention.

FIG. 13 is a flowchart depicting one example method 1300 for facilitating a lottery game in accordance with one embodiment of the present invention. An identifier for audio/video content is received (step 1310). For example, an identifier uniquely identifying a DVD including a movie may be received by a lottery retailer by scanning the DVD. In another example, the identifier is received by a controller and used in updating a media inventory database.

An indication is received of a request to purchase a chance in a lottery game (step 1320). Such an indication may be received, for example, by a controller or lottery retailer terminal, in response to a customer approaching a lottery retailer terminal and requesting a play slip for a lottery product.

An indication of a predetermined prize associated with the audio/video content is received (step 1330). In some embodiments, a prize pool may be pre-assigned to a particular type of content, such that when a chance is requested in the associated lottery game, a prize is determined from the pre-assigned prize pool (e.g., randomly or sequentially from a randomized prize list (the "next prize due")). Thus, the prize may be associated with the requested chance in a manner independent of the specific unit of content. Alternatively, each individual unit of the content may be pre-assigned a particular prize.

At least one criterion is determined for comparison with the audio/video content (step 1340). As discussed in this disclosure, the at least one determined criterion may assist the player in determining whether the purchased chance is a winner (e.g., by watching a television episode and noting whether they have been assigned the "phrase that pays").

An indication of the determined at least one criterion and the predetermined prize is output (step 1350). For example, the information is displayed to a player on a display device of a lottery terminal, or printed on a play slip that is then provided to the player purchasing the chance in the lottery game.

Some embodiments of the present invention provide for a game product and method for producing the game product, and systems and processes for redeeming such game products. In one embodiment, the game product comprises an instant game and audio/video content. The instant game includes one or more indicia that indicate a predetermined value of the instant game and at least one criterion for comparison with the audio/video content to play the instant game.

In some embodiments, the lottery product comprises a plurality of instant games. In some embodiments, audio/video content provides a story (or a portion, issue, or episode of a multi-part series). In some embodiments, each of the plurality of games of a lottery product includes a respective portion of the story. In one embodiment, each scene of audio/video content is associated with a respective instant game.

In one embodiment, dialog, text, scenes, props, figures, characters, sounds, or other types of elements depicted in audio/video content may be used in play of an instant outcome game. For example, the occurrence of a predetermined word (or words) in the dialog of a television show may correspond to a respective payout for a game associated with that show. In some embodiments, some or all of the dialog or other elements used for criteria (e.g., potential content events) in play of an instant game in a lottery product may be concealed initially. For example, a player may be able to scratch off a latex layer covering one or more of the concealed indicia to reveal play criteria.

In accordance with one embodiment, particular content may be associated with multiple arrangements for the provision of various outcome values or various combinations of values corresponding to the content. For example, a specific episode of a television series may be associated with multiple payout tables (e.g., each character may be associated with one or more pay tables), one or more of which may be selected (e.g., randomly) by a publisher of the book, a lottery agent, a lottery authority, and/or a player at the outset of play or at another time. For instance, a player may be able to select a payout table corresponding to his favorite character.

According to some embodiments, a player may earn an outcome value for each time a character of a story speaks a particular line, phrase or type of phrase. Additionally or alternatively, a player may earn an outcome value each time a particular prop or type of prop is shown or used, etc. Of course, in embodiments for lottery products that are instant-win or instant lottery games, such as many of the lottery game embodiments described in this disclosure (and in contrast to some of the keno game embodiments described below), whether a play slip or chance is a winner may be determined before or at the time of purchase. A winning instant-type lottery product may typically be redeemed for a prize immediately, and without the player actually "playing" the game (e.g., without reviewing any audio/video content associated with the lottery product). Thus, although it may be entertaining for the player, as discussed herein, it may not be necessary, for purposes of redemption, to determine each specified occurrence that may be associated with a respective outcome value. For example, the play slip corresponding to the lottery product may simply be associated with a total redemption value (e.g., in a redemption status database) that accounts for all of any individual sub-payouts that may be achieved in playing the game.

B. Keno Games

Keno has been around in one form or another for approximately two millennia. Popular wisdom indicates that Chinese emigrants working on the railroads introduced Keno to the United States, and its popularity has waxed and waned according to the whims of popular fashion. In current years, Keno has seen its popularity wane dramatically, in part because of alternate entertainment options available to gamblers, and in part because Keno, is, at its core, not a glamorous or even an intrinsically entertaining game. In contrast, casinos and gaming establishments have invested millions of dollars in presenting glamorous alternatives for visitors. Instead of waiting for a number to appear on a keno monitor, potential players are distracted by flashier machines, seeing shows with large production budgets, shopping, eating, or otherwise being entertained.

However, Keno remains a game in which the house advantage is large, typically around twenty to thirty percent, or more. As such, Keno, would, if its audience base could be expanded, remain a lucrative part of a gaming establishment's gaming stable. Thus, there is a need to revitalize Keno and make Keno more attractive to potential players.

At least some embodiments of the present invention tie events in video content to a keno game such that the events of the video content determine winning outcomes in an associated keno game. In place of the traditional stream of numbers being posted to alert players of winning outcomes, embodiments of the present invention display video content to the players. Certain events within the video content are marked with a cue in such a manner as to alert the players that the certain event is an outcome determinative event. By way of analogy, the outcome determinative event corresponds to a drawn number in a more conventional keno game. If a player matches enough pay events marked with a cue in the video content with pay events selected on their keno receipt, the player receives a benefit.

Before addressing the particulars of the embodiments relating to keno games, a more detailed discussion of conventional Keno is provided with reference to FIGS. 1-5B. The discussion of the present invention begins below with FIG. 6. In its simplest form, traditional keno resembles a type of lottery. Players usually pick up a keno ticket 10, such as that illustrated in FIG. 1. The keno ticket 10 has several fields 12, 14, 16, and 18 as well as instruction lines 20 and perhaps a logo 22. The first field 12 has spot indicia 24 that allow a player to indicate a quantity of numbers that the player can select. The numbers are frequently called "spots" in the gaming industry. The second field 14 has bet indicia 26 that allow the player to indicate the amount that is wagered. The third field 16 has game indicia 28 that allow the player to indicate over how many games the numbers and wagers are to be maintained. Finally, the fourth field 18 has number indicia 30 that allow the player to select the numbers or spots on which the wager is placed. Thus, for example, if the player has indicated that they desire a three-spot game, three number indicia 30 would be marked in the fourth field 18.

The player takes the keno ticket 10 to a keno booth where the attendant uses a keno terminal, such as keno terminal 32 illustrated in FIG. 2, to scan in the keno ticket 10 and accept payment of the wager. In particular, the attendant may insert the keno ticket 10 into an input 34. The input 34 could correspond to the data reading apparatus of U.S. Pat. No. 4,659,073, which is hereby incorporated by reference in its entirety, or equivalent device. Data may be read from the keno ticket through a device such as the marked card reader of U.S. Pat. No. 4,724,307, which is hereby incorporated by reference in its entirety, or equivalent device. Relevant information may appear on the display 36 and a printer (not shown explicitly) may print a receipt that is output at printer port 38. Alternatively, the keno ticket 10 may be regurgitated at the input 34 as is taught in the previously incorporated '073 patent. If necessary, the attendant may use keypad 40 or other input to create or modify the data that appears on a keno ticket 10 and/or the receipt. The attendant then provides the player with a keno receipt that has indicia thereon proving the player's selections. For some keno terminals 32, the keno receipt is the regurgitated keno ticket 10, perhaps with some additional markings thereon or one from which a unique bar code or other identifying characteristic has been read such that the keno ticket 10 is known to the keno terminal 32.

It is possible that keno terminal 32 has an associated cash drawer that the attendant uses to accept wagers and make change, or the attendant may use an associated cash register (not shown explicitly, but well understood in the industry) for the cash handling purposes.

Alternatively, some establishments have moved to more self-serve keno kiosks, such as keno kiosk 42 shown in FIG. 3. The self-serve keno kiosk 42 includes a display 44, which is usually a touch-screen display having instructions and fields through which the information on the traditional keno ticket 10 may be input to the self-serve keno kiosk 42. The self-serve keno kiosk 42 also usually has one or more payment acceptors such as a magnetic card reader 46 and/or a cash acceptor 48. Once payment for the wager has been made and the appropriate selections made, a keno receipt 50 is generated at printer port 52.

Exemplary conventional keno terminals 32 and self-serve keno kiosks 42 are sold by SCIENTIFIC GAMES Corporation of 750 Lexington Avenue, New York, N.Y. 10022, as the PROBE XL series multi-function gaming system and by GTECH Corporation of 55 Technology Way, West Greenwich, R.I. 02817 as the ALTURA system.

The player then locates a keno monitor 54 (FIG. 4) and watches numbers be drawn. The keno monitor 54 usually has a split display with a game designating field 56 and a number field 58. A typical keno monitor 54 may be, for example, fifty-two inches (~132 cm) wide by forty-seven inches (~119 cm) tall. The number field 58 allows individual numbers to be illuminated so as to indicate which numbers have been drawn. For the exemplary keno monitor 54 of FIG. 4, the current game is game four hundred fifty-six; number seventy-one has been drawn and is illuminated (60); but element seventy-two has not been drawn, and so is not illuminated (62).

Typically, each minute a number is drawn and illuminated on the keno monitor 54. Once twenty numbers have been drawn (from amongst the possible eighty), the game ends. Players win if enough of their selected spots match the drawn numbers. Odds and payouts vary depending on the establishment, but a typical payout for a one dollar wager on a five spot selection might be $450 if all five spots are matched, $20 if four of the five are matched, $2 if three of the five are matched, and nothing if only one or two match.

If the player has a winning outcome, the player returns to the keno booth with the keno receipt. The attendant confirms the winning outcome and provides the payout to the player. Again, cash handling duties may be handled with the keno terminal 32 or an associated cash register as needed or desired. One way in which the keno receipt may be confirmed is by inserting the keno receipt into the input 34 and allowing the keno terminal 32 to scan the data thereon. As noted, the keno receipt may be valid for more than one game if the player has made the appropriate designation and paid the appropriate wager with the keno ticket 10.

In some self-serve keno kiosks 42, there is no need for the player to use a keno monitor 54 because the display 44 serves this purpose. In this instance, the keno player may not receive a keno receipt, but the player's selections are stored in the self-serve keno kiosk 42 and the redemption occurs immediately without having to interface with a keno attendant. Such self-serve keno kiosks 42 are well understood in the industry. One example of a complete self-serve kiosk is a video keno terminal (not shown explicitly). Video keno is an individual video version of the regular casino Keno. The game is begun by placing a wager (coins or tokens) into the machine's slot. Then, just as is in regular Keno, the player is presented a screen (display 44) with eighty numbers, one through eighty. The player then simply picks the number he or she wishes to play—as few as one, as many as twenty. The machine then randomly selects twenty numbers. Players are paid based on how many of their numbers match those selected by the machine. An example of such a video keno terminal is disclosed in U.S. Pat. No. 5,192,076, which is hereby incorporated by reference in its entirety.

For more information on the rules of a traditional keno game, the interested reader is referred to the incorporated patents and http://www.keno-info.com/keno_rules.html, a copy of which is filed concurrently with this disclosure.

Keno is a reasonably hardware intensive game and may involve more initial expenditures than small operations are willing to incur. Likewise, because keno is a form of gambling, some areas may subject all keno games for money value to strict oversight controls or mandate that the keno games be run through a centralized authority who may subsidize placement of the hardware in exchange for a portion of the proceeds or other deferred compensation. Alternatively, large gambling establishments may have their own internal keno management system. In either case, there is usually centralized control of the keno games. These two situations are illustrated in FIGS. 5A and 5B respectively.

In FIG. 5A, a keno authority 70 may have a central office 72 that manages all the keno operations for a particular jurisdiction or entity. In particular, the central office 72 may include a controller with a random number generator (not shown explicitly) that draws numbers for keno games in a secure manner. The central office 72 communicates with site hardware 74 through a wide area network (WAN). The WAN may be wire based, wireless, terrestrial, satellite-based, dedicated transmission media, shared transmission media, public, proprietary, or the like as needed or desired, although a secure communication link is likely to be required to prevent unauthorized communication thereon.

The keno authority 70 may be operated by the beneficiary 76 or may report to the beneficiary 76 to which all the proceeds are eventually paid. For example, a state lottery commission may be the beneficiary of a statewide keno game. The state lottery commission may directly run the keno game or contract with an entity that manufacturers the keno hardware such as SCIENTIFIC GAMES or GTECH to handle the day-to-day operations of the keno game. In the former case the state lottery commission doubles as the keno authority 70, and in the latter case, the state lottery commission is the beneficiary 76, but the third party entity is the keno authority 70. Differing contractual obligations may modify or blur these distinctions somewhat, but these distinctions provide a convenient conceptual framework within which to discuss embodiments of the present invention.

The site hardware 74 may be the keno terminal 32, the self-serve keno kiosks 42, the keno monitors 54 or other equipment as is well understood, and this equipment is positioned in a number of keno gaming establishments such as a restaurant 78, a bar 80, a gas station 82 or the like as needed or desired. Employees of the keno gaming establishments act as the keno attendants, accepting wagers and keno tickets 10 from players, dispensing keno receipts, and handling keno payouts as appropriate. The keno authority 70 services the site hardware 74, handles the drawing of the numbers, providing the drawn numbers to the keno gaming establishments, accounting for all keno proceeds, and paying larger keno winners as is well understood.

Certain casinos and other larger scale operations that are not subject to state lottery commission oversight may run their own keno games as illustrated in FIG. 5B. Casino 84 has its own central office 86 akin to the central office 72, but typically located on the premises of the casino 84. The central office 86 communicates with keno booths 88 and keno monitors 90 through a local area network (LAN). The LAN may be wireless or wirebased and use any appropriate communication method as needed or desired, although again a secure communication link is likely to be required.

Against the backdrop of traditional Keno, embodiments of the present invention provide an exciting alternative that adds video content to the game. However, before providing an explanation of the embodiments of the present invention, a few terms are defined. As used herein, the term "keno authority" means the entity that is responsible for facilitating a keno game across one or more machines. The term keno authority thus encompasses the casino's central office 86 and/or the entity that runs statewide keno games and the like.

The term "keno gaming establishment" means a location that allows keno gaming to take place therein. Exemplary keno game establishments are casinos, restaurants that offer keno games while you dine, bars with keno games, gas stations with keno games, convenience stores with keno games, and the like. It is expected that in some jurisdictions, the keno gaming establishment must be an age-restricted establishment, but not every jurisdiction has such requirements, so such is not a prerequisite for inclusion as a keno gaming establishment.

"Video content" means a series of images, moving or still, presented in a changing sequence to an audience, but specifically does not include progressive, selective indication of keno numbers that is devoid of further content, such as is done on a prior art keno monitor as described with reference to FIG. 4. Exemplary video content may be a film or television show. Many further examples of appropriate video content are provided below. Specifically excluded from this definition are conventional keno monitors that selectively illuminate drawn numbers and video keno game displays that have a series of images whose function is to convey which of the possible numbers have been drawn in a traditional keno game. While these might loosely be considered a changing sequence of images, this level of change is not sufficient to be video content for the purposes of the present invention.

A "video clip" is video content that is stored in some manner. In every possible stored embodiment of the video clip there is some physical element associated with the storage. That physical element may be a reel of edited film, a DVD, a VHS tape, or more esoterically, the electric or magnetic charges in a computer readable memory device or other transmission medium that contain the binary data forming the information that, when read by a playback device forms the images of the video content. All of these possible storage media are included within the concept of a video clip. A video clip may include audio data.

An "event" is a scene, element within a scene, or activity within a scene of video content that is capable of being differentiated from another scene, element within a scene, or activity within a scene of the video content. The differentiation may be thematic or otherwise as needed or desired.

A "pay event" is an event within video content that is used in some manner by the video content determinative keno game. Numerous sub-categories of pay events are contemplated and described below.

A "potential pay event" is a pay event that can be used in the keno game (e.g., by an entity facilitating the keno game) to determine an outcome of the game, but it is as of yet uncertain whether that particular pay event is an outcome determinative pay event. A potential pay event is analogous to one of the numbers one through eighty from which winning numbers are drawn in traditional Keno.

An "outcome determinative pay event" or a "drawn pay event" is a pay event that dictates the outcome of the keno game. In this regard, an outcome determinative pay event or drawn pay event is analogous to the numbers drawn in traditional Keno.

A "pay event marked with a cue" is an outcome determinative pay event that has a cue added to it in some fashion such that a keno player or person viewing the video content is informed of the fact that the pay event is an outcome determinative pay event.

A "selected pay event" is a potential pay event that is selected by the player or the keno terminal from amongst the set of potential pay events and on which the player is gambling that the outcome of the keno game is determined. A selected pay event is analogous to a number that a player selects on her keno ticket 10 when making a wager in traditional Keno.

A "video based keno game" is a keno game whose outcome is determined at least in part by video content. The term video based keno game specifically excludes conventional keno games such as video keno.

The present invention energizes the somewhat static and luctual keno game by replacing the drawing and display of numbers with the display of video content. In particular, events within the video content replace (and/or complement) the traditional numbers. Instead of wagering on whether a particular number will be drawn, the players wager on whether potential pay events are present and marked with a cue in the video content. As the video content is presented, the content of the video presents one or more of the potential pay events. One or more of the potential pay events are marked with a cue so as to indicate its impact on game play. If the player's receipt has enough selected pay events corresponding to pay events marked with a cue within the video content, the player may receive a benefit. Numerous variations exist on the manner of designating pay events, selecting pay events, and the playback of the video content, all of which will be discussed in greater detail below.

Turning to FIG. 6, a process in accordance with some embodiments of the present invention begins with the selection of appropriate video content (block 100). Almost any video content can be adapted for use with the present invention. Embodiments of the present invention contemplate the following non-exclusive list of sources for video content: feature films, including theatrical, extended director's cuts, and edited for television versions; reruns of television shows of any genre; current television shows of any genre; sporting events, including live, delayed, and reruns; animated cartoons; situational comedies; syndicated television shows; reality television shows; news; weather; cable television channel programs; short films, including music videos, animated shorts, art house films, and the like; screen captured recordings of massively multiple online role playing games; casino footage of table top game play; nature shows; cooking shows; weather shows; educational documentaries; historical documentaries; and the like. Another possibility that could be used as video content is a slide show of photographs. For example, recent JIMMY BUFFETT® concerts have been preceded by a five to ten minute montage of photographs taken the day of the concert by Mr. Buffett and his entourage in and around the town in which the concert is to take place. Also included are photographs from the festivities in the parking lot from immediately before the concert and a few crowd shots taken as the audience is entering the concert venue. Similar sorts of photograph slide shows detailing daily candid shots in and around a particular venue could be created for keno hosts such as cruise ship, casinos, and the like. For the purposes of the present invention such photomontages are included within the definition of video content. In short, almost any video that contains changing imagery or dialogue can be selected. While the previous recitation assumes single episode style sources of video content, the present invention's concept of video content includes montages, trailers, teasers, and similar amalgamations from multiple sources. For example, segments from multiple episodes of a television series may form video content. Similar montages of a sport team's season or history may form video content. For the purposes of explanation, the single season of the discontinued television series SPACE ABOVE AND BEYOND™ is selected at block 100.

The video content may be in any executable audio/video programming file such as an MPEG2, MPEG, AVI, MOV, WAV, DivX, or other similar file as is known in the art. Likewise, the video content may be stored in any sort of memory device such as compact disc, digital versatile disc (DVD), optical disc, video home system (VHS) tape, universal serial bus (USB) memory device, hard drive, zip drive, or the like as is well understood, although a portable or transmittable combination of formats and storage systems facilitates use of the present invention.

The video content is then reviewed for potential pay events (block 102). As noted above, a potential pay event is an event that occurs in the video content that is distinctive enough to be recognizable as a potential pay event by a keno player. Exemplary pay events include, but are not limited to: a character entering a scene (perhaps in a distinctive manner), a character leaving a scene, a character delivering a memorable line or quip, the presence of an object, creature or landmark in the scene or background, the presence of a particular product, an explosion, a gunfight, an argument, a kiss, the revelation of a secret identity, laugh tracks, a romantic encounter, particular background music, and the like. Exemplary potential pay events from the example television series might include the presence of Commodore Glen Van Ross, the presence of the Commodore's guitar Rosalyn, Lieutenant Colonel McQueen's pithy comeback "Yes you would sir. But we'll talk about your mother when I get back", the presence of the Chaplain, the playing of a twentieth century audio recording by a character, the presence of Chiggy Von Richtofen, Lt. Wang kissing Lt. Damphousse, the identification of a character as an InVitro, a space fight, the death of a marine, Lt. Hawkes firing a pistol, the presence of a silicate, and the like.

Once all the potential pay events are identified, the potential pay events may be internally designated as such (block 104). In an exemplary embodiment, potential pay events are internally designated as potential pay events by tags. A tag is information stored in association with the video content that is separate from the portion of the video content that is output to a keno player. While it is expected that the tag will be stored in some form of auxiliary channel ascertainable by a video playback device, the present invention is not so limited. One exemplary tag is information identifying the potential pay event stored in the vertical blanking interval of the video content. One exemplary technique for using the vertical blanking interval is described in U.S. Pat. No. 6,895,166, which is hereby incorporated by reference in its entirety. Thus, in the example television series, each of the above-mentioned potential pay events is tagged in the vertical blanking interval of the video content.

Having designated the potential pay events within a particular video clip, the potential pay events that are actually going to be the drawn pay events may be highlighted as such. In an exemplary embodiment, the highlighting is done through the use of a cue capable of being perceived by a player. There are numerous types of cues that could be used, including, but not limited to: broadly: audible and visual cues, with more specific examples being: a pop-up bubble, instant messenger messages, overlaid text, overlaid graphics, inserted video clips; inserted audio clips, picture-in-picture alerts, a ticker running across or beside the video content with text alerts thereon, a sidebar, a header, a footer, a voice-over, a pause in the video, closed-caption text, or the like. From amongst the various types of cues available, the editor chooses a type of cue that is desired for drawn pay events (block 106). Cues do not have to be uniform throughout the video content, although they may be for trade dress, branding, or general aesthetic purposes. Note that it is also possible that some third party instructs the editor on what type of cue to use. For example, a television studio may license its works only on the condition that particular types of cues are to be used, or a keno authority 70 may desire all its video content to be marked with similar cues for branding or trade dress purposes. It may be possible to tie the cues thematically to the video content. For example, the physical, slapstick humor of the THREE STOOGES™ is well suited to overlaid graphics exclaiming "POW! PAY EVENT!" or "BONK! PAY EVENT!" or the like. Conversely, a show of a different genre, such as CHARMED™ might be more amenable to closed-caption text or a discrete bell-tone. In the example of SPACE: ABOVE AND BEYOND™, the cue selected is a pop-up bubble shaded white to contrast with the heavy blacks and grays of the video content.

Having chosen a desired cue (or cues), certain ones of the potential pay events are marked with or associated with a cue (block 108). That is, appropriate information is added to the video content such that when the video content is displayed, the cues are readily ascertainable by the viewing public. If tags are being used, the information from the tag is associated with the cue such that the occurrence of the appropriate tag causes the cue to be presented. Alternatively, the information in the tags associated with the drawn pay events is changed to reflect that not only is the event a potential pay event, but the potential pay event is also a drawn pay event and a cue should be presented. As yet another alternative, if tags are not used (and they are not required by the present invention), the video content may be directly edited to present the cue. In an exemplary embodiment, software such as ADOBE® INDESIGN® sold by Adobe Systems Incorporated, 345 Park Avenue, San Jose, Calif. 95110-2704, or MACCAPTION™ and/or CCAPTION™ sold by CPC Computer Prompting and Captioning Co. of 1010 Rockville Pike, Suite 306 Rockville, Md. 20852, could be used to add the cues to the video content. Other hardware or software could be used if needed or desired, and the software identified herein is by way of example only. In addition to the cues of embodiments of the present invention, additional editing to include voiceovers or add video to the video content may be performed. These may be game instructions, endorsements such as "I am Bob Dole, and I approved this video content,", casino promotions, other advertisements, or the like as needed or desired. Additionally, some material may be removed during editing, such as, for example, commercials, mature content, and/or generally abridging the video content to meet time constraints. In the example television series, the drawn pay events are: the presence of Rosalyn, the presence of the Chaplain, a character being revealed as an InVitro, the death of a marine, the presence of a silicate, the presence of Commodore Van Ross, Lt. Colonel McQueen making a quip, Lt. Hawkes firing a pistol, a kiss, and a space fight, and thus these potential pay events are the pay events marked with cues.

The number of possible cues makes differentiating between the various cues potentially problematic. A first solution is to make the text of the cues sufficiently distinct from each other. A second solution is to have a short hand way to describe a particular cue that is sufficiently distinct from other short hand descriptors. Such short hand descriptors are sometimes referred to herein as identifiers. The cue may contain these identifiers or not as needed or desired. Thus, the previous paragraph's examples of drawn pay events are, in effect, a recitation of identifiers of the drawn pay events. More esoteric identifiers could be used. An identifier could be a unique alphanumeric string associated with a cue (e.g., 8AD97J52F5) or a phrase that describes the pay event (e.g., the identifier for the pay event 1977 FORD MUSTANG could be the phrase "1977 Ford Mustang"). Video content editors, video based keno players, keno game establishments, and the like may all use identifiers as needed or desired, and their use remains optional.

The edited video content is then delivered (block 110). In an exemplary embodiment, the edited video content is delivered to a keno authority 70 for redistribution to keno game establishments. To the extent that many keno authorities 70 are also manufacturers of keno terminals, delivery may be made to manufacturers of keno terminals. Even if the manufacturer of keno terminals is not a keno authority 70, edited video content may be delivered to such entities so that they may sell a complete package of keno terminals and video content. In another alternate embodiment, the edited video content is delivered directly to the keno game establishments. In still another alternate embodiment, the edited video content is then made available for sale to whomever might wish to purchase the edited content. Such an offering for sale is also within the scope of delivery of content as used herein.

The delivery of the video content may take different forms. In a first exemplary embodiment, a video clip formed from a memory device with the video content stored thereon is packaged in traditional packaging and delivered (for example, a DVD with the video content, tags, and cues is delivered in traditional DVD cases or jewel cases). In a second exemplary embodiment, the video clip is an electronic file sent to the intended recipient without a specific storage medium (for example, a file could be attached or embedded in an email or the file could be transmitted wirelessly or over a wire medium to the intended recipient). In this case, the packaging is the delivery mechanism (email, streamed video, and the like as needed or desired). The intended recipient could then store the file in a hard drive or other memory device as needed or desired.

While the process of FIG. 6 has been described as taking place in a particular order and linear style, it should be appreciated that a different sequence of events occurring sequentially or concurrently may be implemented as well. For example, the tagging and marking with cues could occur concurrently with the identification of the potential pay events, or the decision on which cues are to be used could occur before the potential pay events are identified. Other variations are also possible. Likewise, while the procedures set forth in relation to FIG. 6 are contemplated as being done before distribution to keno game establishments, as will be described below, there are numerous other ways to edit the video content and insert the cues. The discussion of some of these alternate techniques occurs after the discussion of FIGS. 20A & 20B.

Conceptually, the distribution of the video content is illustrated in FIG. 7, wherein the video content is created in the traditional fashion (block 120) (e.g., a person with a camera films a location and/or person with or without voice to create the video content). This video content is delivered in any video clip format to either a keno authority 70 or a video content editor 124. The keno authority 70 may then send the video content to the video content editor 124 or may have an in house video content editor 126 perform the video editing to secure video content with the desired cues. The video content editors 124/126 may have a wide latitude in identifying potential pay events and marking drawn pay events with cues, or, the video content creator or the keno authority 70 may provide explicit instructions on which events are potential pay events and which events are drawn pay events that need to be marked with a specific cue. The degree of freedom afforded the video content editors 124/126 is a continuum, and the precise place on the continuum is not critical to the present invention. Once the video content is edited to include the pay events marked with cues, it is delivered back to the keno authority 70 as a video clip. The delivery of the video clip with the edited video content back to the keno authority 70 may be done through any suitable medium 128, including, but not limited to: memory disc 128A, tape 128B, an electronic file delivered over the internet 128C, a recording sent through a wireless network 128D (UHF, VHF, RF, and the like), through a dedicated wirebased transmission medium 128E (such as the Public Switched Telephone Network (PSTN)), or the like. The keno authority 70 then provides the edited video content to the keno game establishment 130 under the terms of the contracts with the keno game establishments 130. Alternatively, the video content editor 124 may provide the edited video content directly to the keno game establishment 130. Note that delivery to the keno game establishment 130 includes delivery to site hardware 74 controlled by the keno authority 70.

The keno player is likely to be oblivious to the manner in which the video content is created, edited, and delivered, and is much more interested in the end result: an exciting, dynamic, engaging keno game. To this end, the keno game establishment 130 installs or has installed site hardware 74 suitable for facilitating embodiments of the present invention on its premises and invites customers to partake of the keno game of the present invention. As illustrated in a flowchart in FIG. 8, the process of the game is as follows, interrupted by an explanation of the new elements in subsequent Figures. The keno player arrives at the keno game establishment 130 and secures a keno ticket 140 (block 150). The keno ticket 140 is illustrated in FIG. 9.

The keno ticket 140 is similar to the conventional keno ticket 10 with a few important differences. The keno ticket 140 may include a first field 12 and second field 14 with spot indicia 24 and bet indicia 26 respectively. The keno ticket 140 may also include instruction lines 20 and a logo 22. The logo 22 may be tied to the keno authority 70, to the video content around which the keno game is being played, a combination, or other logo as needed or desired. For example, the logo 22 could state "SPACE: ABOVE AND BEYOND™ KENO brought to you by ULTRAKENO!!!" or some such appropriately flashy and catchy logo. This logo or other indicia on the keno ticket 140 may indicate precisely which video content is covered by the keno ticket 140, including when the video content will be displayed, what channel, how long the video content will last, any repeat showings that may be made, or other information as needed or desired. Additional instructions on how to play, odds, payouts, and the like may also be provided.

In place of the fourth field 18 and number indicia 30, the keno ticket 140 has new instruction line 142, event field 144 and potential pay event indicia 146. The new instruction line 142 asks players to select potential pay events from those presented by the potential pay event indicia 146. The potential pay event indicia 146 indicate potential pay events in the keno game of the present invention. The potential pay event indicia 146 may refer to the potential pay events by their respective identifiers if appropriate, especially if the identifier is reasonably descriptive of the potential pay event. In the exemplary embodiment, the potential pay events of the guitar Rosalyn being present, the Chaplain being present, a character being revealed as an InVitro, a space fight, a marine dying, a silicate being present, Commodore Van Ross being present, McQueen making a quip, Lt. Hawkes firing a pistol, and a kiss are the potential pay events identified by the potential pay event indicia 146. While only ten potential pay events are illustrated, more or fewer may be present if needed or desired. In FIG. 9, the potential pay event indicia 146 are textual and readily ascertainable by the keno player. Braille indicia, alternate language indicia, or other ascertainable indicia are all within the scope of the present invention. While it is assumed in the previous discussion that the keno ticket 140 is paper or cardstock, the keno ticket 140 could take some alternate physical form such as a self-adhesive sticky note (e.g., POST-IT®), sticker, refrigerator magnet, or the like, or, as discussed later, an electronic form.

While keno ticket 140 is provided by way of example, variations on the form or content of a keno ticket are also within the scope of the present invention. For example, a third field 16 with game indicia 28 may be present; a quick pick option may be present; more or fewer instruction lines 20 may be provided; and the arrangement of the elements may be changed without departing from the scope of the present invention. Likewise, as will be discussed below, variations in the game may dictate variations in the keno ticket 140.

The keno player selects pay events from the possible pay events identified by the potential pay event indicia 146 on the keno ticket 140 (block 152). This selection may be done in any number of conventional ways, but is, in an exemplary embodiment, effectuated by making a dark mark in the appropriate blocks 148 as illustrated by mark 148A (FIG. 9). The player then returns with the keno ticket 140 to the keno booth, and the keno game establishment 130 sells the keno ticket to the keno player (block 154). In an exemplary embodiment, the present invention uses a keno terminal 200 illustrated in block diagram format in FIG. 10.

The keno ticket 140 may be valid during only one showing. Alternatively, the keno ticket 140 may be valid for multiple video content showings. In one example, the multiple showings are components of multi-episode story arc or the like and the potential pay events are cumulative throughout the multiple episodes. In a second example, the keno ticket 140 may recite potential pay events generic enough to be valid across any episode of the video content. Time stamps or the like may determine on which episode the wager was made. Such generic pay events may be useful in situations where each game is played with different video content. For example, a player could fill out one keno ticket 140 for all the episodes in a season of a television series, where each episode forms a different game, but the player is wagering on the same potential pay events for each of the episodes. Alternatively, the keno ticket 140 may have separate columns with identical potential pay events for each of the episodes. This embodiment would allow the player to customize her wager for each episode, but space constraints on the keno ticket 140 may make this embodiment less practical.

The keno terminal 200 has an input 202 into which the keno ticket 140 is inserted. An optical sensor 204 reads the markings and indicia from the keno ticket 140 and provides this information to the controller 206. Information relating to the keno ticket 140 may be presented to the player and/or the keno attendant on a display 208 and the attendant may use a keypad 210 to provide additional information if needed or desired. The attendant may accept cash or other monetary input from the player with a money acceptor 212. The money acceptor 212 may be incorporated into the keno terminal 200 or be a separate cash register as needed or desired. The money acceptor 212 may be a cash acceptor 214, a cash drawer 216, a magnetic card reader 218, and/or another monetary acceptor/dispenser, as needed or desired. Once the controller 206 has verified the keno ticket 140 and payment has been indicated, the keno terminal 200 may regurgitate the keno ticket 140 through the input 202 (effectively making input 202 also an output, and thus occasionally the input 202 will be referred to herein as an input/output element) with appropriate markings to indicate that it has been sold, or a printer 220 may print a sold ticket as needed or desired. The printer 220 may dispense tickets from a pre-printed roll and/or may be a laser printer, thermal printer, dot-matrix printer, or the like as needed or desired. In embodiments where the printer 220 and the input 202 are present, collectively the two components may be considered an input/output element. The keno terminal 200 also includes a port 222 that allows communication with a remote location. The port 222 may be wireless or wirebased as needed or desired, and should be able to communicate with the keno authority 70 or other designated remote entity. As video content may be delivered through the port 222, a wideband port 222 better facilitates the present invention, but a narrowband port 222 would work where time elapsed during delivery is not an issue. In appearance, the keno terminal 200 may look like keno terminal 32 or it may be different having appropriate video content themed logos and the like to draw the attention of prospective players. If the keno terminal 200 is a self-service keno terminal, then the keno player may input his selections through an appropriate input (such as for example, making the display 208 a touch-screen display or through a keypad 210) and the printer may print the sold keno ticket with appropriate indicia (such as an equivalent to the indicia with mark 148A) thereon indicative of potential pay events selected by the keno player.

The sold keno ticket is provided to the keno player (block 156). While some in the industry refer to this process as providing a keno receipt or duplicate ticket, for the purposes of the present invention, providing a sold ticket to the player is intended to cover all these situations.

The keno game establishment 130 then displays the video content on a video monitor (block 158) such as video monitor 250 of FIG. 11. The video monitor 250 may be any appropriate monitor including a cathode ray tube (CRT) screen, a liquid crystal display, a plasma screen, a projection screen, or the like. Likewise, the size of the video monitor 250 is variable, but, in an exemplary embodiment, is a large screen monitor (greater than forty-six inches (~117 cm) diagonal) for easy viewing at a distance. The video monitor 250 may receive the video content from a number of different sources, two of which are illustrated in FIGS. 12A & 12B. In FIG. 12A, the video content is generated locally. In particular, the video monitor 250 is connected to a media player 258, which in turn is connected to the keno terminal 200, such as through the port 222. While it is expected that the video monitors 250 will be located throughout the keno game establishment 130, it is possible that it may be positioned in a dedicated movie theater and admission charged to the theater for patrons that do not have current keno tickets. It is possible that even current keno ticket holders could be charged for admission to the theater, but such may decrease the number of players as they may perceive that they are being charged twice to enjoy the video content.

As an alternative to the embodiment of FIG. 12A, the embodiment of FIG. 12B removes control of the video content from the keno game establishment 130 and vests such control more directly with the keno authority 70. The keno authority 70 may have a video server (VS) 224 in its central office 72 that stores video content thereon. This video server 224 may act as a video jukebox (such as the Pioneer DRM-3000 FlexLibrary DVD Jukebox) or the like as needed or desired. Keno authority 70 may arrange the video server 224 and other information in any appropriate format such as a database or the like. Keno authority 70 communicates with the monitor 250 and the keno terminals 200 through any suitable transmission medium compatible with the port 222. In an exemplary embodiment, the keno authority 70 broadcasts to the monitor 250 through a proprietary cable network. In such a case the port 222 may be a coaxial port. Alternatively, a wireless broadcast (terrestrial and/or satellite based) in which case the port is a wireless receiver, a proprietary or shared fiber optic network broadcast, an internet broadcast, or other medium based broadcast may be used if needed or desired each with a compatible input port for the keno terminals 200 and the monitors 250. Use of this embodiment may allow synchronized displays of identical video content at multiple locations. If the broadcast is made in some proprietary or specialized format or if the keno monitors 250 are "dumb", a set top box may be necessary to receive the video content from the video server. In such a case, the set top box may be part of the port or have its own ports.

At various times during the video content, potential pay events may occur in the content. Some or all of these potential pay events may be drawn pay events. When a drawn pay event is displayed, a cue is presented (block 160). The presentation of the cue may be concurrent with the drawn pay event or otherwise temporally close to the drawn pay event's display. As illustrated in FIG. 11, a space fight is occurring in the video content and is a drawn pay event. To this end, a pop-up cue 252 is visually presented to the players to alert them that this space fight is a drawn pay event. The pop-up cue 252 states "SPACE FIGHT PAY EVENT!" or the like. The phrase "Space Fight" is effectively an identifier for the pay event marked with a cue, and the cue includes the identifier. Likewise, speakers 254 may provide an audible cue 256 such as "*DING* PAY EVENT!" where the *ding* is a discrete bell tone or the like. While the example uses a descriptive identifier, as noted above, other identifiers could also be used. If potential pay events are similar, the identifiers may become important to help players distinguish between the potential pay events. For example, the potential pay event "Sonny shoots the criminal" compared to "Rico shoots the criminal" are similar. To help distinguish between the two potential pay events, the identifiers may be expanded to recite "Sonny shoots the criminal (EVENT #2347)" and "Rico shoots the criminal (EVENT #8974)". Variations in the type of identifiers used are within the scope of the present invention.

Note that it is possible that a particular segment of the video content may have multiple potential pay events occurring simultaneously. For example, if potential pay events are the presence of Chiggy Von Richtofen, a space fight, and the death of a marine, the instance where Chiggy Von Richtofen kills a marine in a space fight has all three potential pay events in the same segment of the video content. However, zero through three of these potential pay events may be drawn pay events and a corresponding number of cues would be used depending on how many of the potential pay events were drawn pay events. In other words, not every potential pay event is a drawn pay event. If a potential pay event is not a drawn pay event, the potential pay event will not be marked with a cue.

The video content concludes (block 162), and the players may evaluate whether their sold ticket has enough selected pay events to be a winning ticket according to the payout schedule of the particular keno game. The keno player takes the sold keno ticket to the keno booth or kiosk (or provides the sold keno ticket to a keno runner who does the same), and the keno game establishment 130 receives the sold ticket back from the keno player (block 164). The keno game establishment 130 then determines if the sold ticket just received is a winning ticket (block 166) by checking to see if the selected pay events of the ticket correspond to the drawn pay events that were marked with a cue in the video content.

In an exemplary embodiment, the keno game establishment 130 uses the keno terminal 200 to scan the sold keno ticket. The controller 206 then makes a determination as to whether the sold keno ticket is a winning ticket based on information available to the controller 206 and the information on the sold ticket. The keno terminal 200 may communicate with the keno authority 70 to assist in confirming the winning status of a ticket, or may make the decision locally as needed or desired.

If the sold keno ticket is a winning ticket, the keno game establishment 130 may account with the player (block 168) by providing a benefit or payout for the ticket from any suitable cash handling mechanism or benefit providing system. This sort of payout is appropriate for small dollar or low value benefit payouts. Larger value payouts may require the player to present the winning ticket directly to the keno authority 70 or have the proceeds mailed from the keno authority 70. Benefits may include, but are not limited to:

money, products, services, coupons, gift certificates, entries into other games, tokens, chips, credits, and the like. The keno game establishment 130 may then account with the keno authority 70 (block 170) through any conventional mechanism. The accounting between the keno game establishment 130 and the keno authority 70 may include many sets of data, including but not limited to: keno ticket sales, data, including: an indication that a sale has been completed or canceled, what pay events (and/or numbers) were selected for a certain ticket (either by the player or otherwise), what video content was selected for a certain ticket, summary of the number of tickets sold, summary of payouts or benefits given, payouts or rewards passed to the keno authority 70 to redeem (in those instances when the reward is higher than the keno game establishment 130 is authorized to pay or is capable of paying based on current amounts in the till), and the like. In an exemplary embodiment, a wire transfer is effectuated between the keno game establishment's bank and the keno authority 70 once per video content playback, once a day, once a week or other period as needed or desired. Alternatively, a check may be drafted periodically from the keno game establishment 130 to the keno authority 70. The timing of the payments and the reports is not critical to the present invention and other variations on this accounting are also contemplated and within the scope of the present invention.

Setting aside the accounting between the keno game establishment 130 and the keno authority 70, it is readily apparent that the use of video content which has certain potential pay events marked with a cue to designate drawn pay events is more exciting and provides greater entertainment opportunities relative to the conventional static keno monitors 54. Given the breadth of subject matter from which the video content may be drawn, it is probable that video content for any audience may be found to support the video based keno game of the present invention. However, the present invention has numerous variations in how it may be implemented.

The first variation is in the nature of the interaction between the keno player and the keno game establishment 130. As alluded to above, rather than rely on the keno player approaching a keno booth, the keno player may use a self-serve keno kiosk to purchase and redeem keno tickets, but may still use a monitor 250 to watch the video content. As yet another alternative, the keno player may interact with a keno runner to purchase and redeem keno tickets. The keno runner could, in some embodiments, be a waitperson, hostess, host, maitre d'hotel, dedicated keno runner, or the like. The level of service provided by the runner could vary along a continuum. In the simplest embodiment, the runner may just act as a physical courier between the keno player and the keno booth. Thus, the keno runner could provide keno tickets 140, allow the player to mark the keno ticket 140, take the marked keno ticket 140 to the keno booth with the player's wager, return with the sold keno ticket, return winning tickets to the keno booth, and return winnings to the keno player. Alternatively, the keno runner could be equipped with a portable keno terminal and act as a mobile keno booth.

One exemplary portable keno terminal 260 is illustrated in FIG. 13, which has a housing 262 analogous to a personal digital assistant (PDA). The housing 262 delimits an input 264, which may allow a keno ticket 140 marked by the player to be inserted therein and scanned. Alternatively, a keypad 266 may be used to enter data conveyed to the keno runner. That is, the player could recite her choices, and the keno runner could type them in as the player speaks or the keno runner could read a keno ticket 140 and enter the player's choices manually. A display 268 may be used to view the input data, and a printer 272 may be used to print a sold keno ticket 270. Display 268 may be a touch screen allowing elimination of the keypad 266 if desired. Small portable printers are well known in the industry as evidenced by the printers (like the ABC PP-50) that are available for a PALM III and SPT 1500. Thus, a specially programmed PDA might readily accommodate this embodiment. Portable keno terminal 260 is well suited for use by a waitperson or the like that is used to handling money and orders separately and concurrently. The keno runner may then synchronize her portable keno terminal 260 through any conventional technique and account with the keno game establishment 130 much as a waitperson does. This embodiment is particularly well suited for a bar establishment where the waitperson doubles as a keno ticket salesperson, and people play Keno over drinks and food while watching their preferred video content on the video monitors 250 around the bar.

Another alternate embodiment is that the keno player may watch the video content on the keno terminal rather than on a separate keno monitor 250, effectively combining the keno terminal 200 and the keno monitor 250. An exemplary self-serve combination keno terminal 274 is illustrated in FIG. 14. The self-serve combination keno terminal 274 may include a housing 276, which may be a table top structure (not shown), a cabinet structure (shown), a wall-mounted unit (not shown), or the like as needed or desired. The housing 276 includes at least a display 278 on which video content may be displayed. Payment acceptors 280 may be mounted in any convenient location on the housing 276 or in networked peripheral devices (not shown). In an exemplary embodiment, cash acceptor 282 and/or a magnetic card reader 284 are mounted on the housing 276 and function as is well understood. A keypad 286 may be used to provide inputs to the self-serve combination keno terminal 274. For example, prior to the beginning of game play, instructions could be presented on the display 278 and the keno player could provide input to start the game play through the keyboard 286. Alternatively, the display 278 may be a touch screen display and input may be provided directly through the display 278, in which case the keyboard 286 could be eliminated. Once the keno player has selected her potential pay events and placed her wager using the payment acceptor 280, the video content is then presented on the display 278. The keno player may sit on a nearby chair or couch and watch the video content. If the keno player has made a winning selection, the payout may be provided through a hopper 288 or through a cashless receipt printed by printer 290. Alternatively, the printer 290 could print a sold keno ticket that the keno player then takes to a keno booth after the video content has concluded. The keno ticket for the self-serve combination keno terminal 274 may be an electronic ticket only viewable on the display 278, or it could be printed by the printer 290 prior to the presentation of the video content.

Video content for the self-serve combination keno terminal 274 may be stored locally on a hard drive, DVD jukebox, or other memory device as needed or desired. Alternatively, the video content may be stored at the video server 224 of the keno authority 70 and selectively broadcast to the self-serve combination keno terminal 274 on demand through any appropriate communication link as previously described. Though not illustrated, the self-serve combination keno terminal 274 has a processor or controller that controls operation of the self-serve combination keno terminal 274 and, if needed, a receiver to receive the video content from the video server 224.

While the self-serve combination keno terminal 274 is illustrated as a reasonably large cabinet style terminal, other configurations are possible. For example, the self-serve combination keno terminal 274 could be a portable device comparable in size and shape to a portable DVD player. In such an embodiment, the keno player could make a wager at a keno booth, receive a sold keno ticket, check out the portable keno terminal with appropriate video clip stored therein, and then watch the video content at her leisure, returning the keno terminal concurrently with collecting any winnings. Security measures such as those used in retail and library establishments or those disclosed in U.S. Patent Application Publication No. 2002/175818, which is hereby incorporated by reference in its entirety, may be incorporated into the player and/or the video clip.

Figure 15:
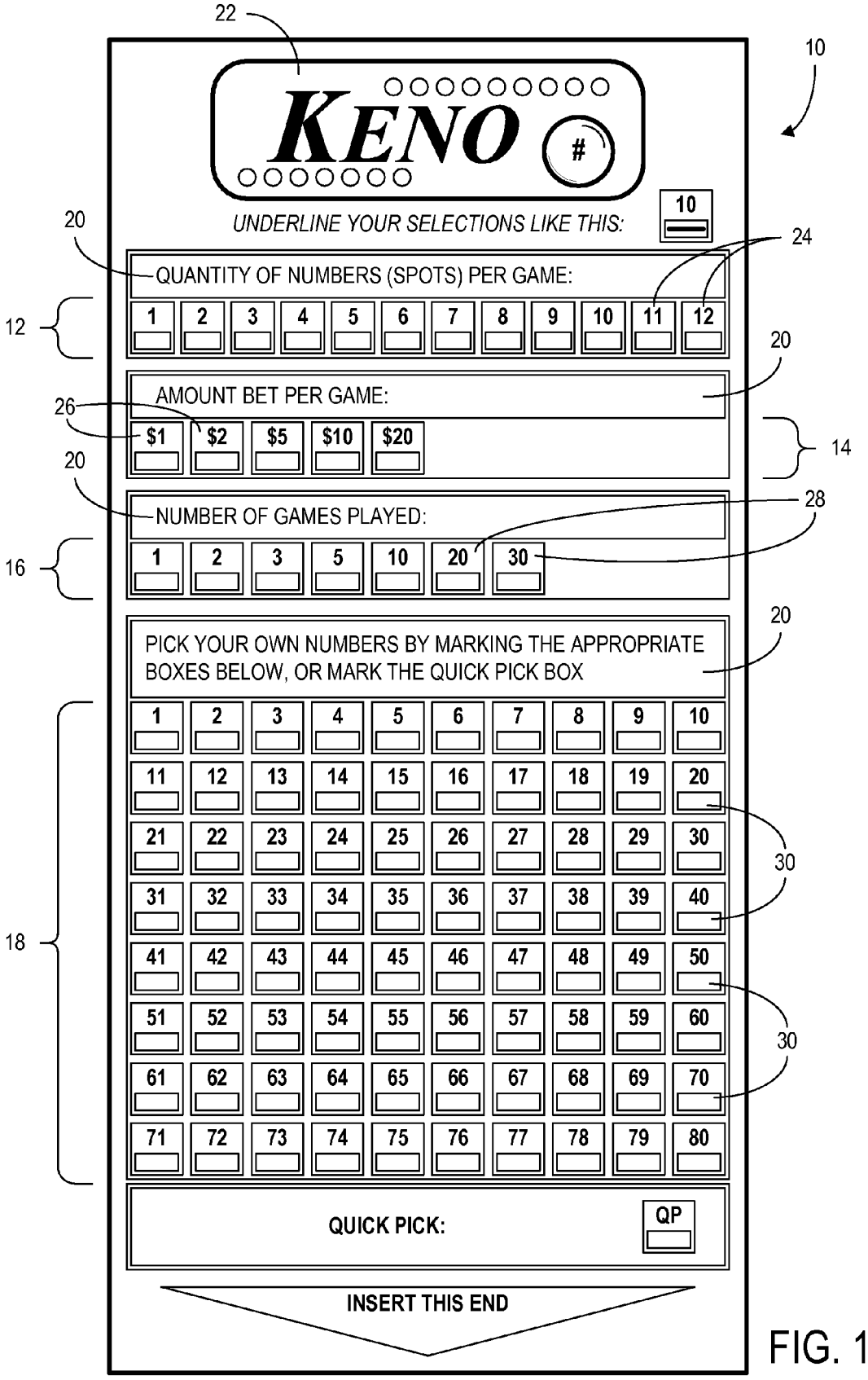
FIG. 15 PRIOR ART
FIG. 15 illustrates a conventional keno ticket.

As yet another portable option, the keno player could download operative software to her own mobile terminal such as a PDA, cellular phone, wristwatch, alphanumeric pager, DVD player, laptop computer, or the like. An exemplary mobile terminal 300 is illustrated in FIG. 15 and includes controller 302, which is, in an exemplary embodiment, a microprocessor. Mobile terminal 300 also includes a wireless port 304, memory 306, keypad 308, and display 310. Other input and output (I/O) devices 312 may also be present. The wireless port 304 may be an antenna and a transceiver adapted to operate in any wireless protocol, including, but not limited to Bluetooth, GSM, EDGE, CDMA, WCDMA, AMPS, D-AMPS, 802.11, and the like. Alternatively, the wireless port 304 may be an optical, infrared, or other frequency port or the like as needed or desired. The display 310 is adapted to present video content to the user. The keypad 308 may be a numeric ten digit plus * and # pad, an integrated touch screen, or a full alphanumeric keypad as needed or desired.

Figure 16:
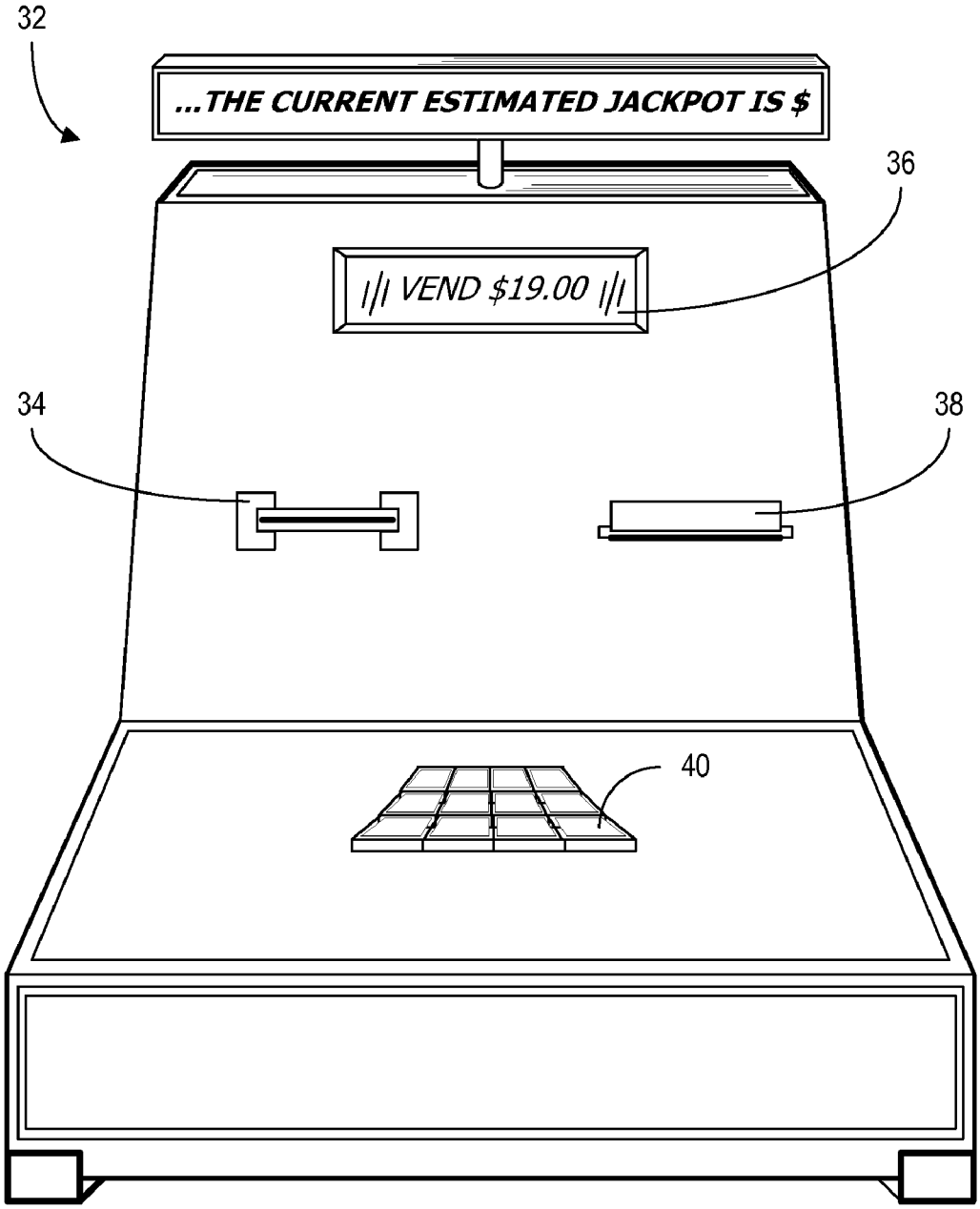
FIG. 16 PRIOR ART
FIG. 16 illustrates a conventional keno terminal.

In practice, the user takes the mobile terminal 300 to a keno game establishment 130 (or other location from which a connection to the keno game can be made). The mobile terminal 300 may communicate with the keno authority 70 directly through a cellular network 314 or indirectly through a wireless network 316 associated with the keno terminal 200 (or other site hardware) as illustrated in FIG. 16. In either case, the user may log in to the keno authority 70 and secure permission to play keno on her mobile terminal 300. The log in process can be any sort of traditional login process, such as that commonly found in hotels or FEDEX/KINKO stores that provide Wi-Fi access. The user may initially pay a fee to download the software or fund a wagering pool, or alternatively, the fee may automatically be applied to a wireless account associated with the mobile terminal (much like making a 1-900 call on a cellular phone). Once the log in is complete, the user may download the software that enables the controller 302 to conduct keno games on the mobile terminal 300. The downloading can take place through the cellular network 314 or wireless network 316 as needed or desired. Alternatively, the keno game establishment 130 may provide docking ports in which the mobile terminal 300 may dock and download the software.

Having downloaded the software, the user may then make a wager on potential pay events through the software using a prefunded account, her mobile terminal's wireless account, or by providing credit card or other account information to the keno authority 70/keno game establishment 130. Instead of filling out a keno ticket 140, the keno ticket may be presented electronically to the user on the display 310 and the user may make selections through the keypad 308 or other input device much like in a self-serve combination keno terminal 274. Depending on the sophistication of the mobile terminal 300, various drop-down menus and graphical or textual user interfaces may be appropriate to facilitate the player's interaction with the mobile terminal 300 in this keno-playing mode. In a first embodiment, the operative software is a thin client, and the mobile terminal 300 is driven by the server either at the keno game establishment 130 or the keno authority 70. In a second embodiment, more robust software is downloaded to the mobile terminal 300 and the controller 302 controls the keno game. The risk of hacking the software in the second embodiment may make such an embodiment less desirable unless appropriate security measures are in place. Once the wager is made, the video content could then be broadcast to the mobile terminal 300 from the cellular network 314 or the wireless network 316. Alternatively, the video content may be downloaded concurrently with the software and stored in memory 306 until the wager is completed. For security purposes, the software and/or video content may have an expiration date after which it self-deletes or is otherwise rendered inoperative. While the above discussion focuses on a cellular type embodiment, it is possible that other devices may be equally or better suited for such activity. For example, the IPOD™ by APPLE® would allow similar sorts of functionality with downloaded video podcasts. As discussed in greater detail below, online video content based keno is also within the scope of the present invention, and the mobile terminal 300 could use such a system as described below.

In some embodiments, instead of downloading software to the mobile terminal 300 (whether it be a cellular phone, IPOD, or other device) and making the wager through the mobile terminal 300, the player may approach a keno kiosk or terminal 200 and make a wager through the keno kiosk, then the player may dock (or otherwise communicatively couple) the mobile terminal 300 to the keno terminal 200 and have the video content downloaded to the mobile terminal 300. The keno terminal 200 stores the player's selected pay events and the wager along with a player identifier and a video content identifier. The video content with the drawn pay events marked by a cue plays on the mobile terminal 300, and the player returns to the keno terminal 200 to recover her benefit earned (if any). In this embodiment, the only keno ticket is an electronic keno ticket kept by the keno terminal 200 and the only function of the mobile terminal 300 is as a playback device. This embodiment may improve security in the wagering process and placate keno game establishments 130 because the player has to visit the keno game establishment 130 to initiate play.

As yet another embodiment, the video based keno game of the present invention may be moved out of the traditional keno game establishment 130 and implemented almost anywhere a monitor can be found. For example, just as a person can order video on demand on their hotel room or home television, a keno player could order video based keno games on demand. The player's input may be accepted through the television or set top box remote control and the television could act as a proxy self-serve combination keno terminal. The wager could be billed to their hotel room or television content provider bill. The user could use any user interface to make menu selections from a menu presented on the display of the television. Alternatively, like some of the DIRECTTV® installations, the set top box may use a phone line to communicate selections from the set top box to the content provider. The wager will show up on the provider's bill just like a pay per view purchase. Payouts could appear as credits on the same bill in the same manner.

Instead of ordering content through a set top box, the player might instead wager in a keno game establishment 130 and then receive a video clip that can be played back at a later time on a media playback device. For example, the keno game establishment 130 might provide the player with a CD or DVD with edited video content thereon. The player's wager is stored with the keno game establishment 130 at the time the video clip is provided. The player watches the video clip on her own playback device at her leisure and returns to the keno game establishment 130 with the video clip and their original keno ticket 140 for any earned benefit. Again, the video clip may have some mechanism for self-expiring. Alternatively, the video clip may only play in authorized devices. For example, as disclosed in U.S. Patent Publication No. 2004/0054594, which is hereby incorporated by reference, it is possible to make a disc that is only playable in the presence of a particular interrogation signal. Thus, the player could only play the video clip on such a disc in an authorized playback device. In still another embodiment, the video clip may be accompanied by software that acts as a client for the keno authority 70 and allows wagers to be made through the software and edited video content to be played from the video clip or sent from the keno authority 70 to the player.

Figure 17:
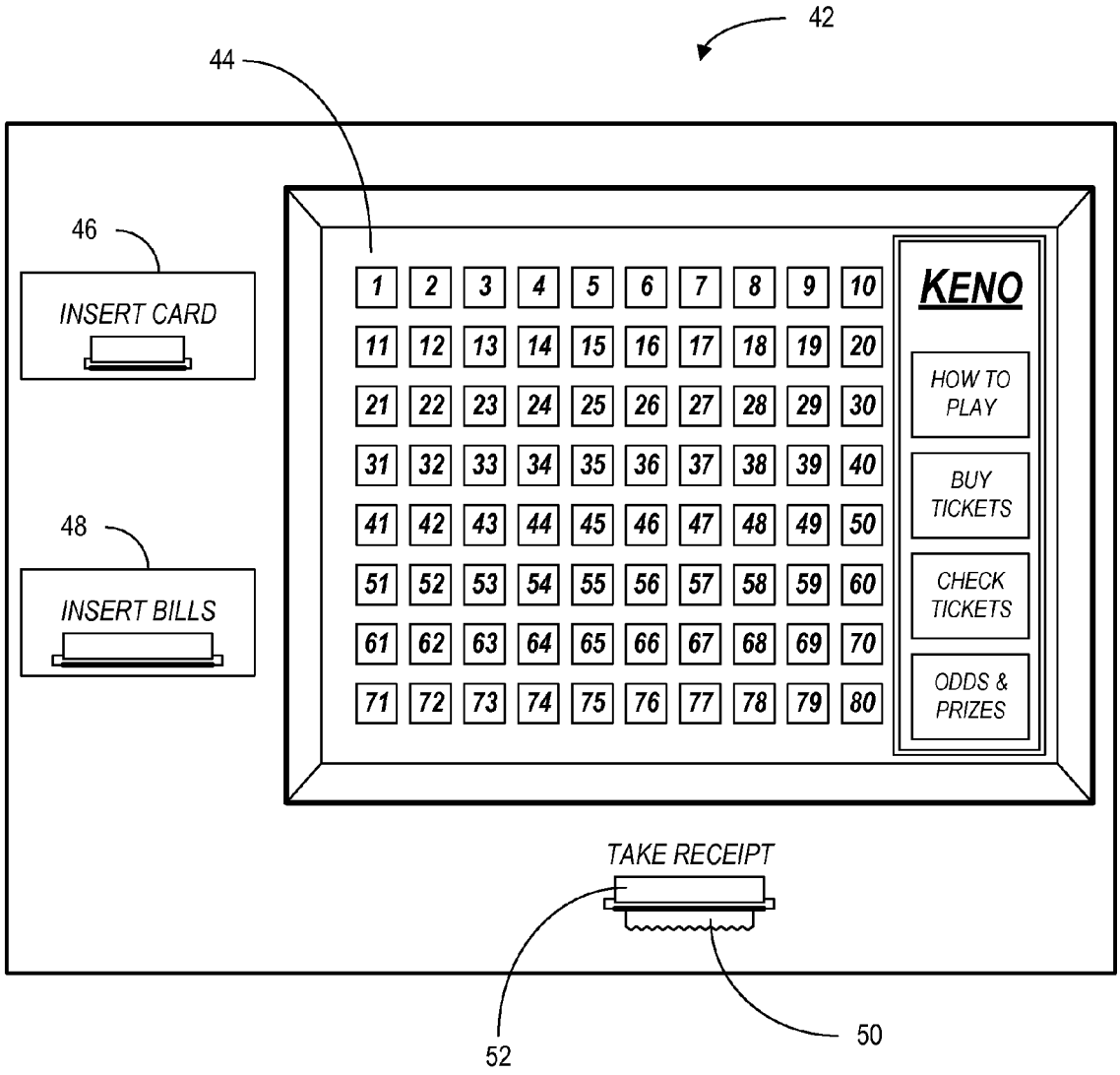
FIG. 17 PRIOR ART
FIG. 17 illustrates a conventional self-service keno terminal.

As yet another variation of the present invention, the present invention may be adapted to an online casino type presentation as illustrated in FIG. 17. A keno player uses a computer 500 equipped with a display 502, a keyboard 504, and internet access (not shown explicitly) to access the internet 506. The computer 500 has browser software such as Internet Explorer™, Netscape Navigator™, Mozilla, or the like installed on the computer and the keno player directs the browser to an appropriate online casino website by providing the browser with a uniform resource locator (URL) in the address line of the browser user interface. The online casino website may be hosted by a sever 508 associated with the online casino 510. The keno player may have to go through an appropriate log in and proof of age process as is well known. The keno player navigates through the website in a conventional web navigation manner and selects a video based keno game. The player may select from a menu of possible video content or the online casino 510 may dictate that certain video content is available at certain times. Either way, the player is presented with an electronic keno ticket or other mechanism through which the player may place a wager relating to the upcoming video based keno game. In an exemplary embodiment, the player may have an online balance associated with the online casino and wagers are deducted from and payouts are credited to this online balance. Once the wager is accepted, a video server 512 may stream video content to the computer 500 through the internet using appropriate video streaming technology as is well understood in the industry. Drawn pay events are marked with a cue during the presentation of this streaming video, and the player can compare her selected pay events to the drawn pay events as previously described. Likewise, the server 508 or other controller of the online casino may determine if the player's wager is a winning wager. If the player has selected enough drawn pay events to have a winning ticket, the online casino may credit the online balance.

In addition to variations in playback locations, there are numerous variations in how the keno tickets can be sold. In particular, it is possible that keno players will be familiar with the video content and may attempt to use this a priori knowledge to assist in selecting the potential pay events on which their wager is based. Thus, a player could know that the episode "The Angriest Angel" featured Chiggy Von Richtofen, the death of a marine, and a space fight and wagers on those potential pay events. To prevent the player's a priori knowledge from being used to win, the keno terminal 200 may randomly assign selected pay events to the keno player when the keno player purchases the keno ticket. In effect, every ticket becomes a quick pick keno ticket, and no player can use any a priori knowledge to select potential pay events. The controller of the keno terminal 200 or the server 508 of the online casino 510 may make this random selection, or if the keno terminal 200 is a dumb terminal, the central office of the keno authority 70 may make the random selection and provide the appropriate instruction to the keno terminal 200.

Figure 18:
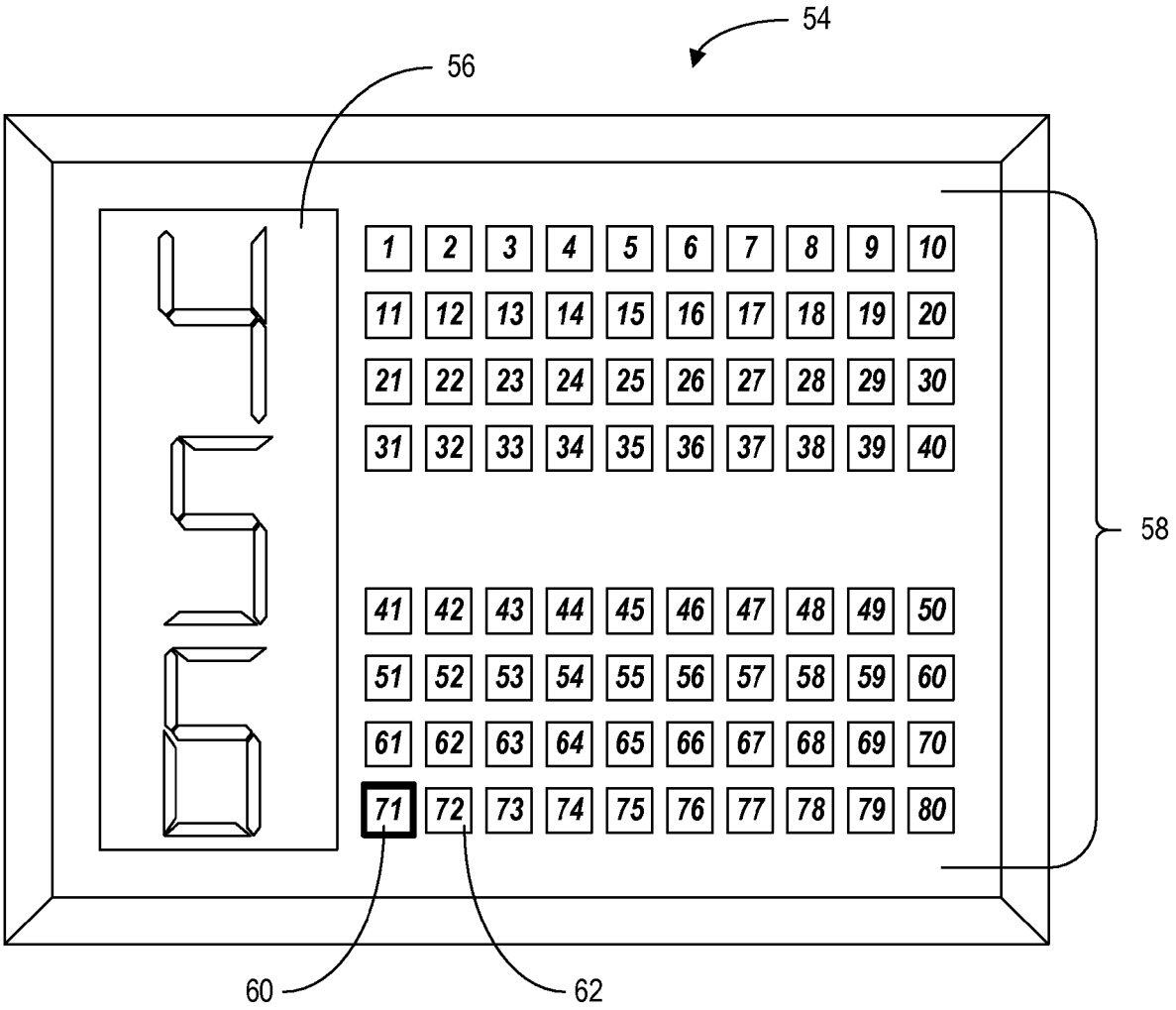
FIG. 18 PRIOR ART
FIG. 18 illustrates a conventional keno monitor.

As a permutation of the random selection of pay events on the keno ticket, the keno ticket could instead be a scratch off keno ticket as illustrated in FIG. 18, which illustrates such a scratch off keno ticket 340. Many elements are similar to the previously described keno ticket 140, but in place of potential pay event indicia 146, the potential pay event indicia 346 are obscured by conventional latex composite scratch off covering material 348. A player takes a coin, eraser, or fingernail and scratches off the covering material over the selections, revealing indicia 346. In FIG. 18, enough of material 348A has been removed to reveal fully the indicia 346 and only part of the material 348B has been removed revealing a fragment of indicia 346A. Such partial scratch offs are likely to be considered full scratch offs. The player effectively chooses how many events on which the wager is based on the number of scratch offs the player makes.

In place of the latex composite scratch off covering material 348, an adhesive could be used to secure obscuring material over the potential pay event indicia 346 and the player could peel off the obscuring material to reveal the indicia 346. In either case, the player may be instructed to not remove the obscuring element until indicated by the video content (e.g., right before the killer's identity is revealed). This embodiment may add suspense to the game, making it more attractive to certain types of players.

Because the player does not know what indicia 346 lies under the material 348 (or other obscuring material), the player cannot use a priori knowledge to affect the outcome. Likewise, some players may be attracted to the game by the scratch off keno tickets as evidenced by the popularity of scratch off lottery tickets.

Figure 19A:
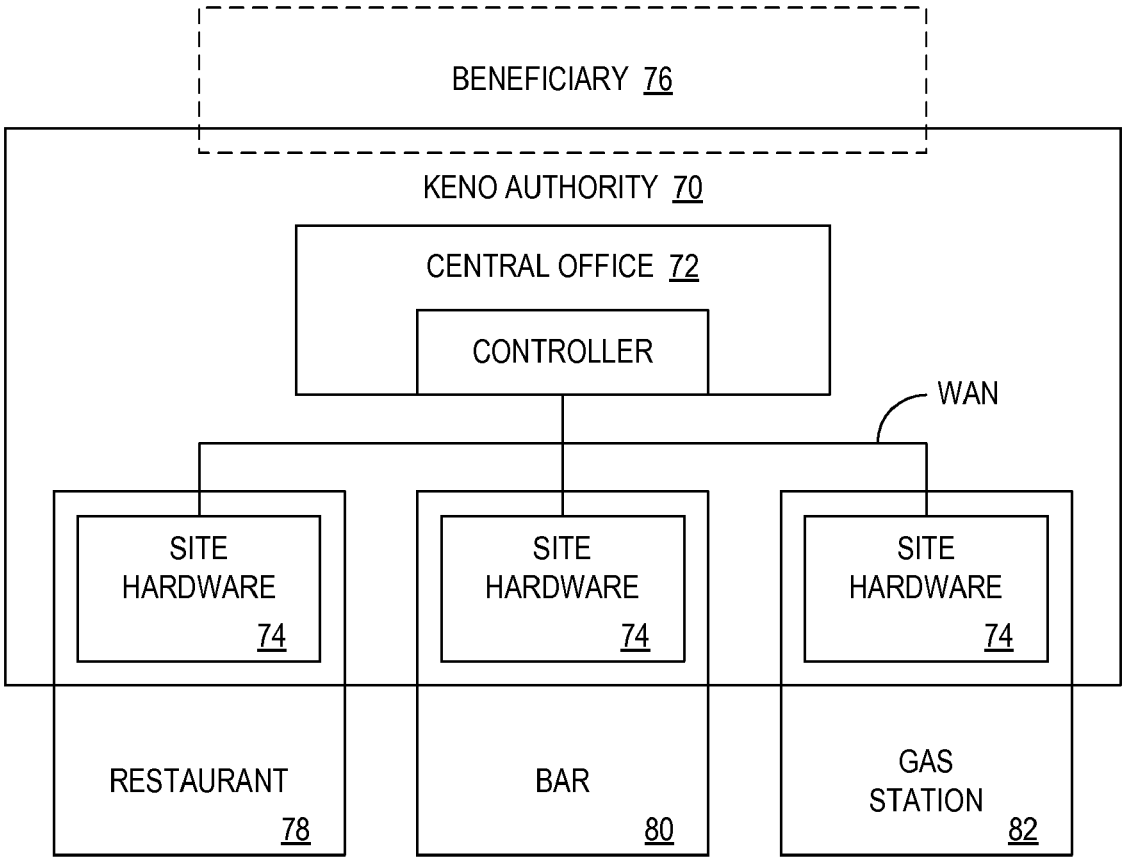
FIG. 19A PRIOR ART
FIGS. 19A and 19B illustrate two conventional keno hierarchies.
Figure 19B:
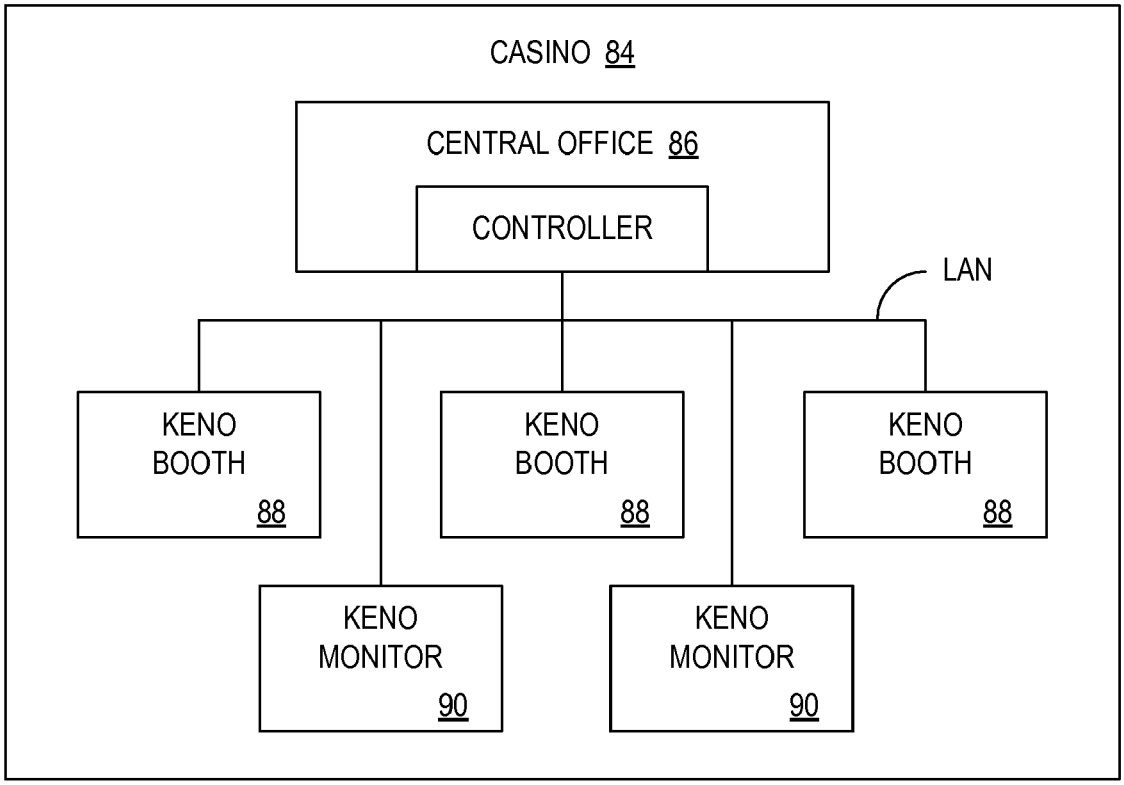
FIG. 19B PRIOR ART

As yet another embodiment, and to help the more conservative keno players become accustomed to a video based keno game, the potential pay events of the keno ticket may be associated with a number. For example, as illustrated in FIG. 19, the keno ticket 350 looks similar to the keno ticket 140, but with the addition of number indicia 352 in association with each of the potential pay event indicia 146. In a first embodiment, every keno ticket 350 has the same number indicia 352 associated with the same potential pay event indicia 146. Thus, in the exemplary embodiment, every ticket 350 would have "ROSALYN PRESENT 8". The cues of the present invention may indicate not only a pay event, but also the number associated with the pay event. For example, the space fight of FIG. 11 may have the cue: "SPACE FIGHT! PAY EVENT 34!" A player wins in this embodiment by matching enough selected pay events with the drawn pay events. The player may refer to the pay event indicia or the number to determine if there is a match. At the end of the game, an auxiliary monitor (not shown) or the keno monitor 250, or the display 278 could show a summary or history of the drawn pay events and the numbers associated therewith much like a traditional keno monitor 54 shows numbers. Instead of the tabular form of keno monitor 54, the numbers could be shown in a ticker format or other format along with advertisements or a count down to the beginning of the next game. Note that this sort of summary of historically drawn pay events may be available in other embodiments, albeit instead of just the numbers, the pay event indicia 146 (with or without the numbers) may be presented. Further note that it is also within the scope of the present invention that such historically drawn pay event information may be available on an auxiliary monitor, keno monitor 250, display 278 or other monitor as a ticker, header, footer, sidebar, or the like for this and the other embodiments.

Figure 20:
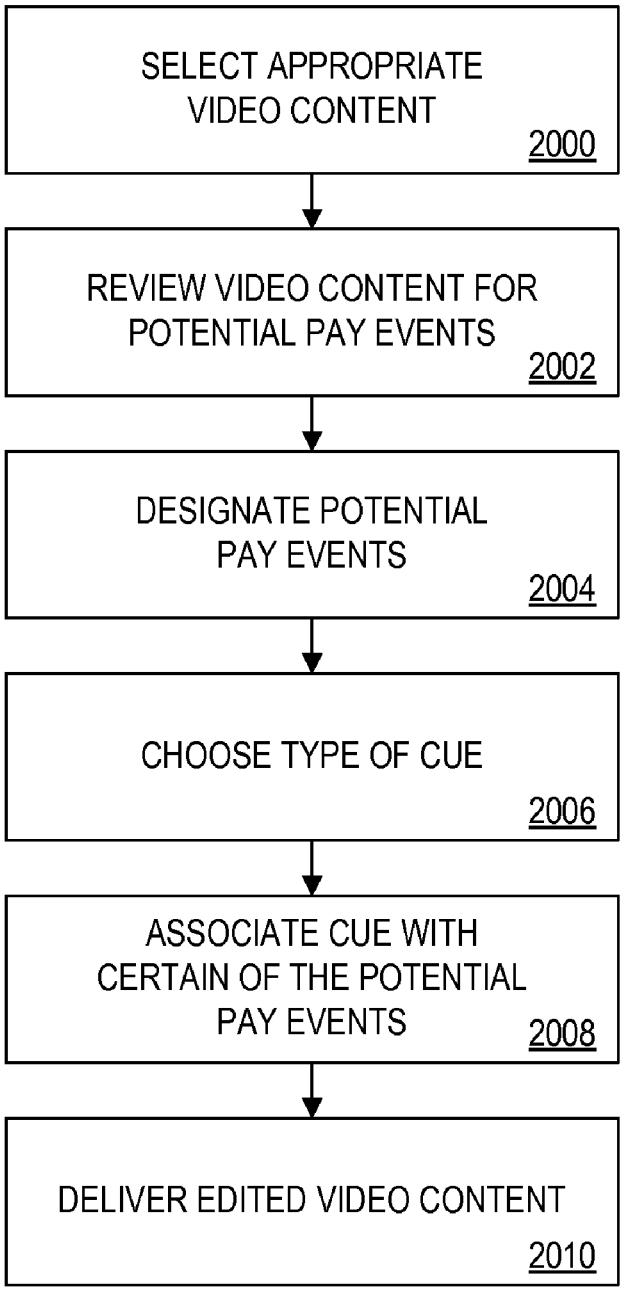
FIG. 20 illustrates a method of creating video content, according to an embodiment of the present invention.
Figure 21:
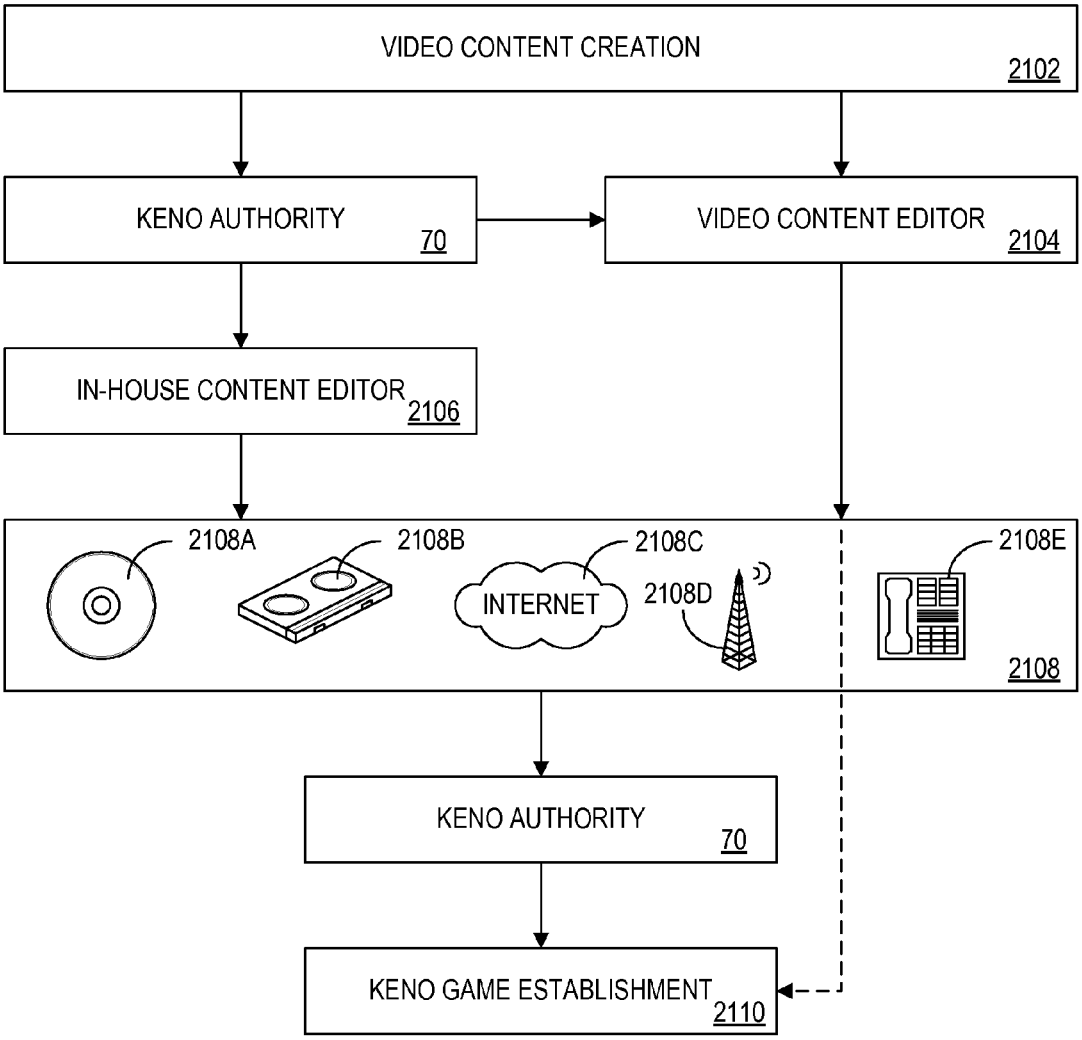
FIG. 21 illustrates exemplary distribution processes for the video content, according to an embodiment of the present invention.
Figure 22:
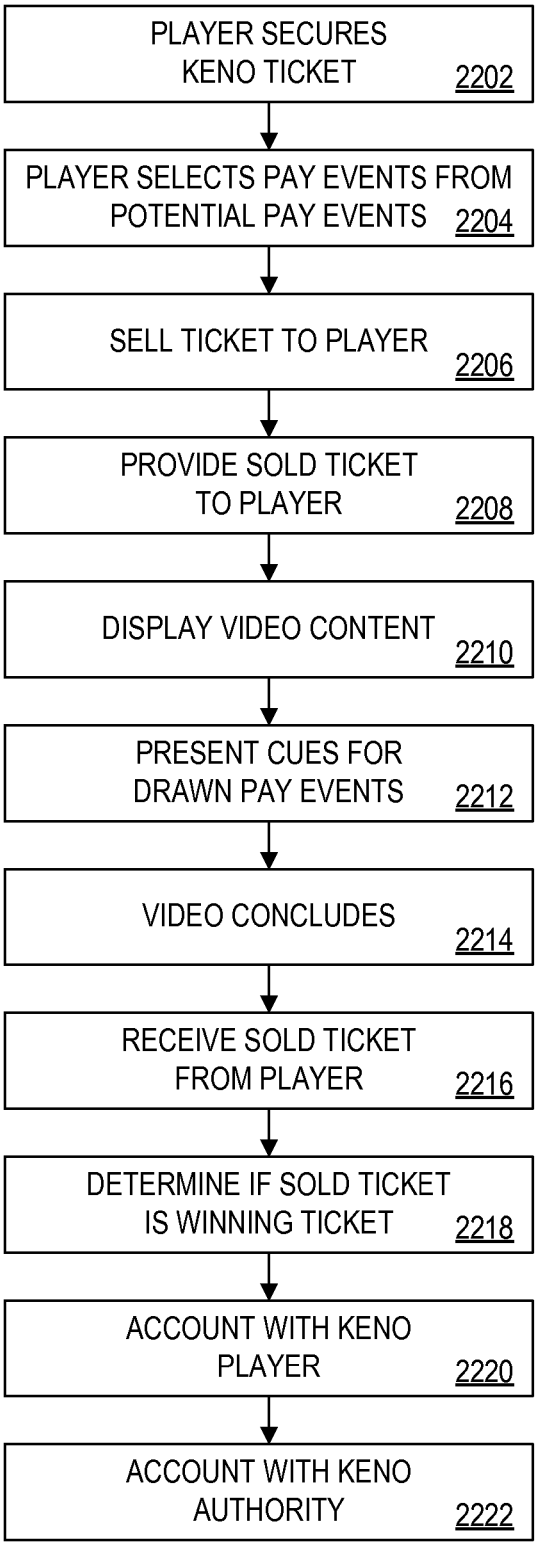
FIG. 22 illustrates an exemplary video content determinative keno game method according to an embodiment the present invention.
Figure 23:
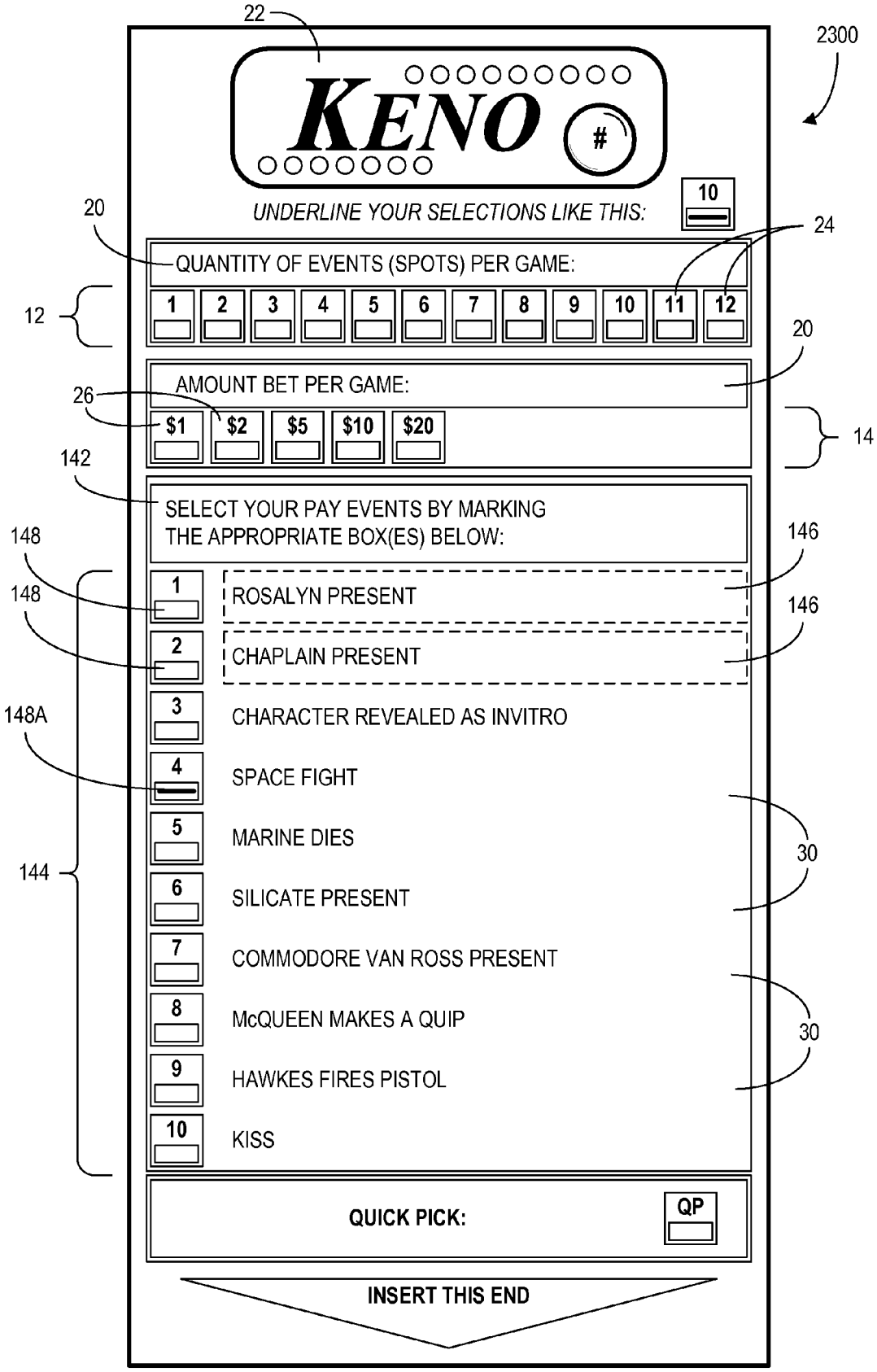
FIG. 23 illustrates an exemplary keno ticket according to an embodiment the present invention.
Figure 24:
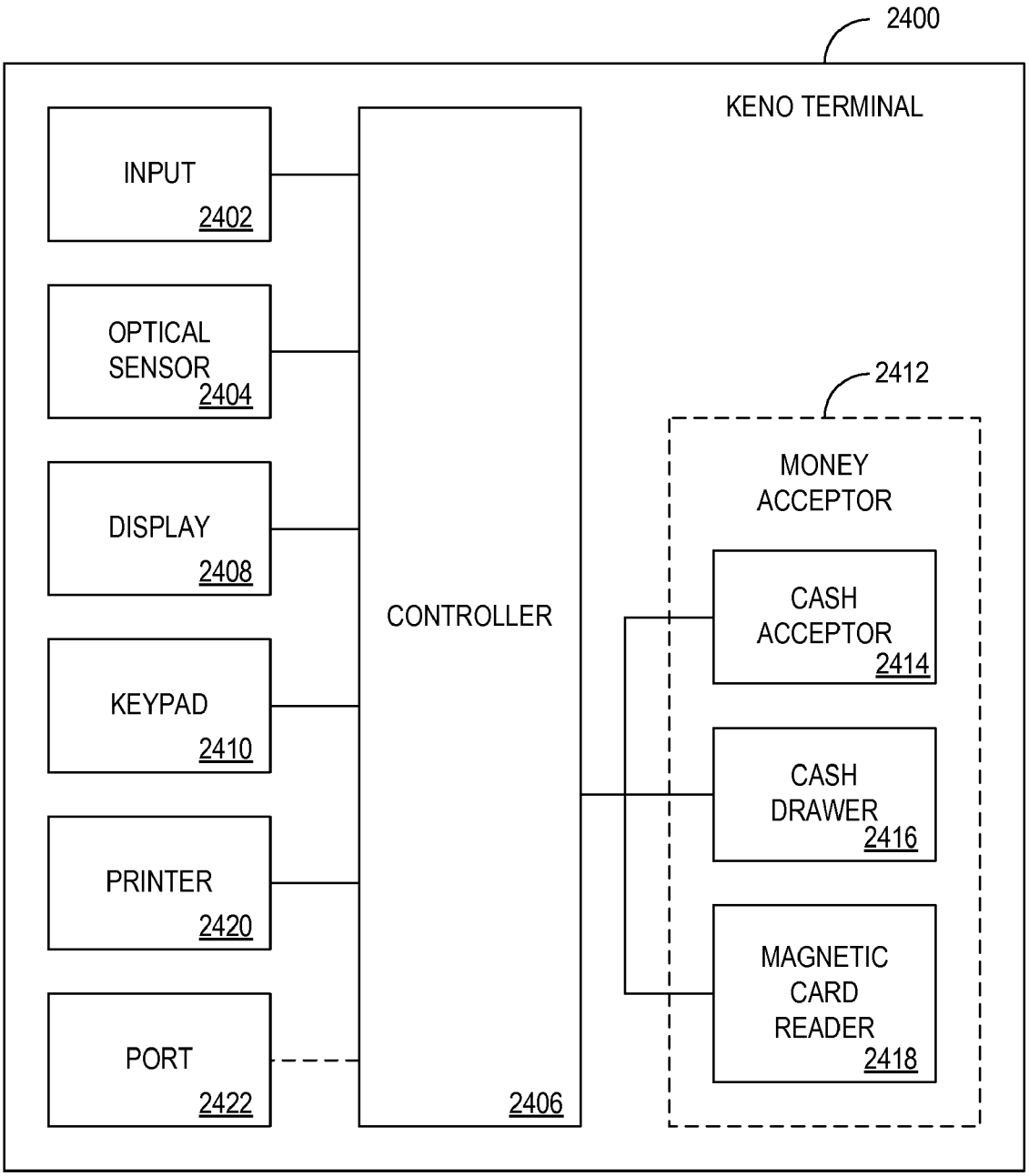
FIG. 24 illustrates as a block diagram an exemplary keno terminal according to an embodiment of the present invention.
Figure 25:
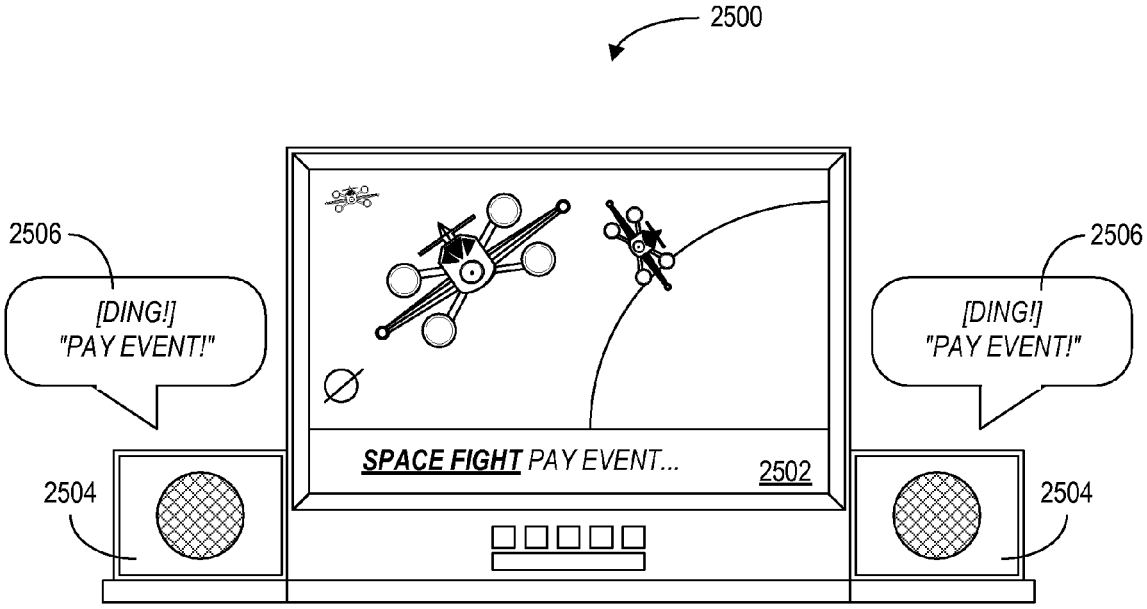
FIG. 25 illustrates video content being displayed on a keno monitor according to one embodiment of the present invention.
Figure 26A:
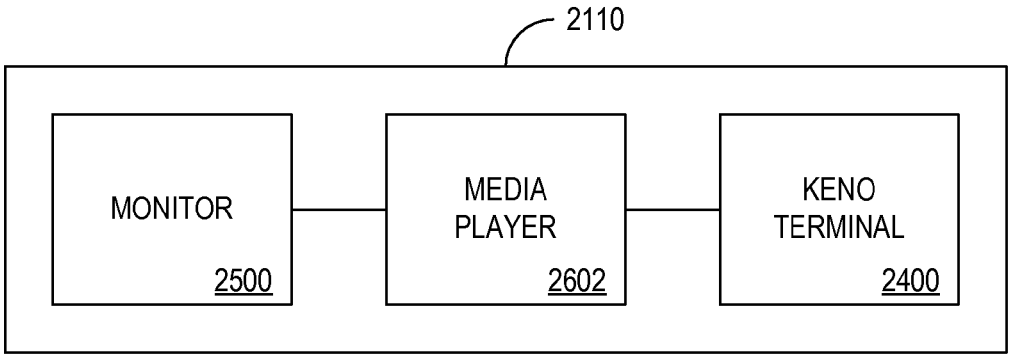
FIGS. 26A and 26B illustrate alternate video content storage options according to embodiments of the present invention.
Figure 26B:
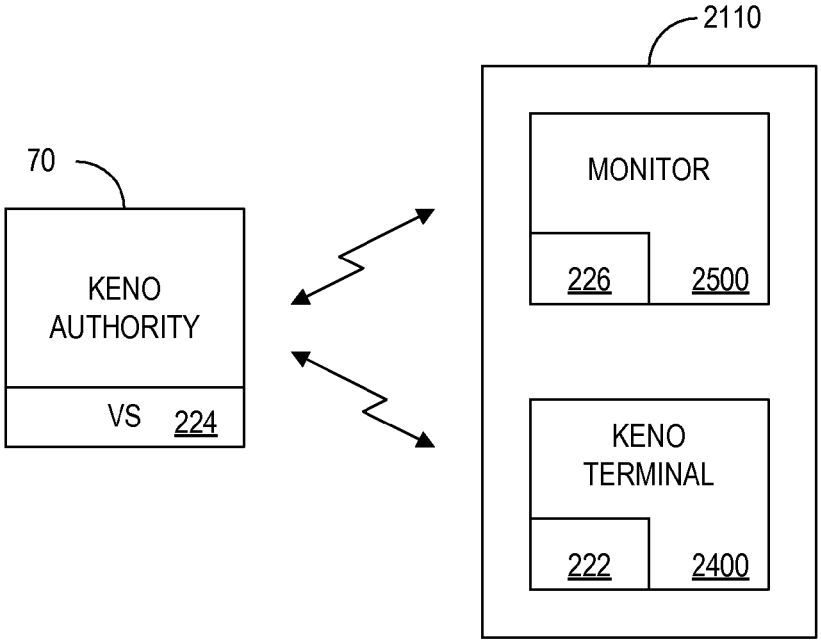
Figure 27:
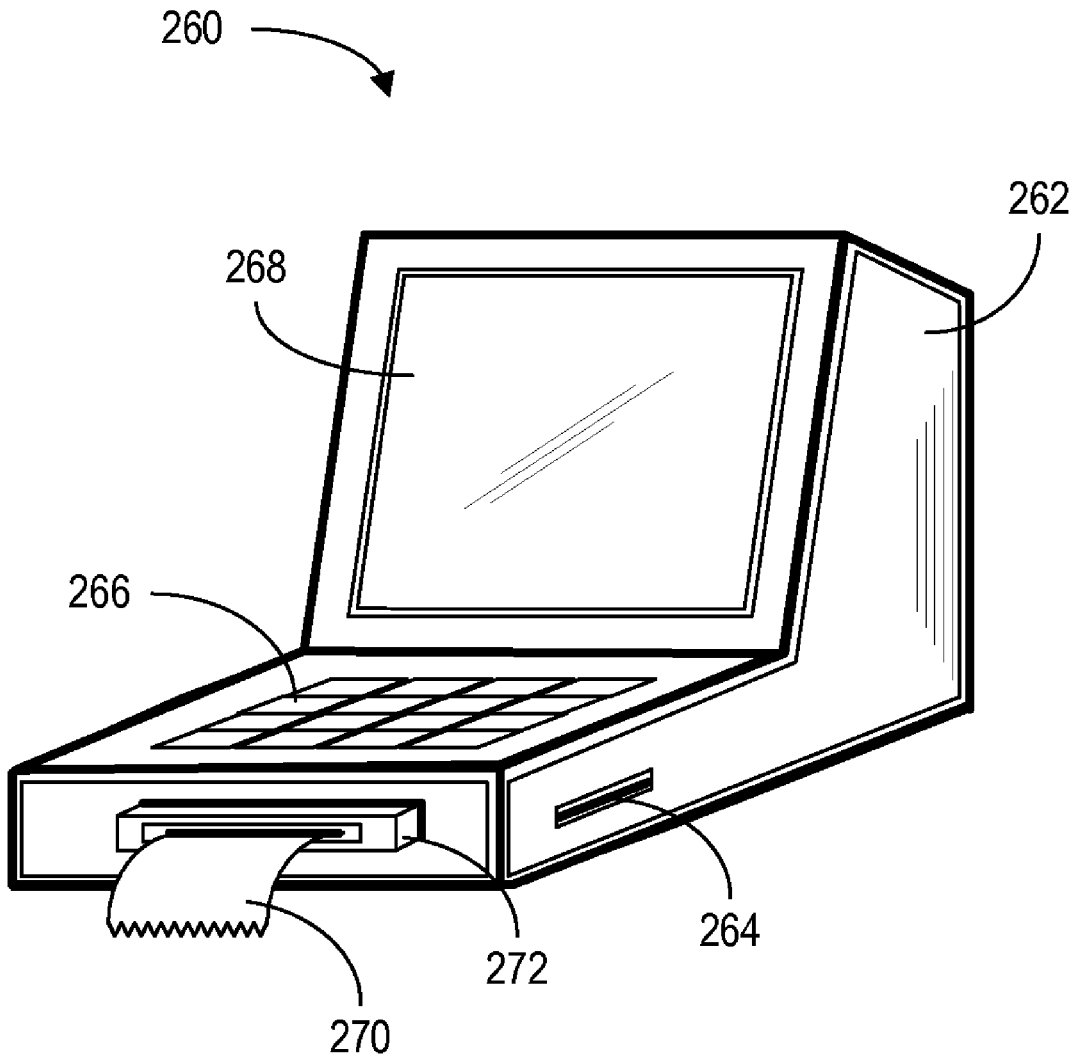
FIG. 27 illustrates an embodiment of a portable keno terminal suitable for use by a roaming keno attendant.
Figure 28:
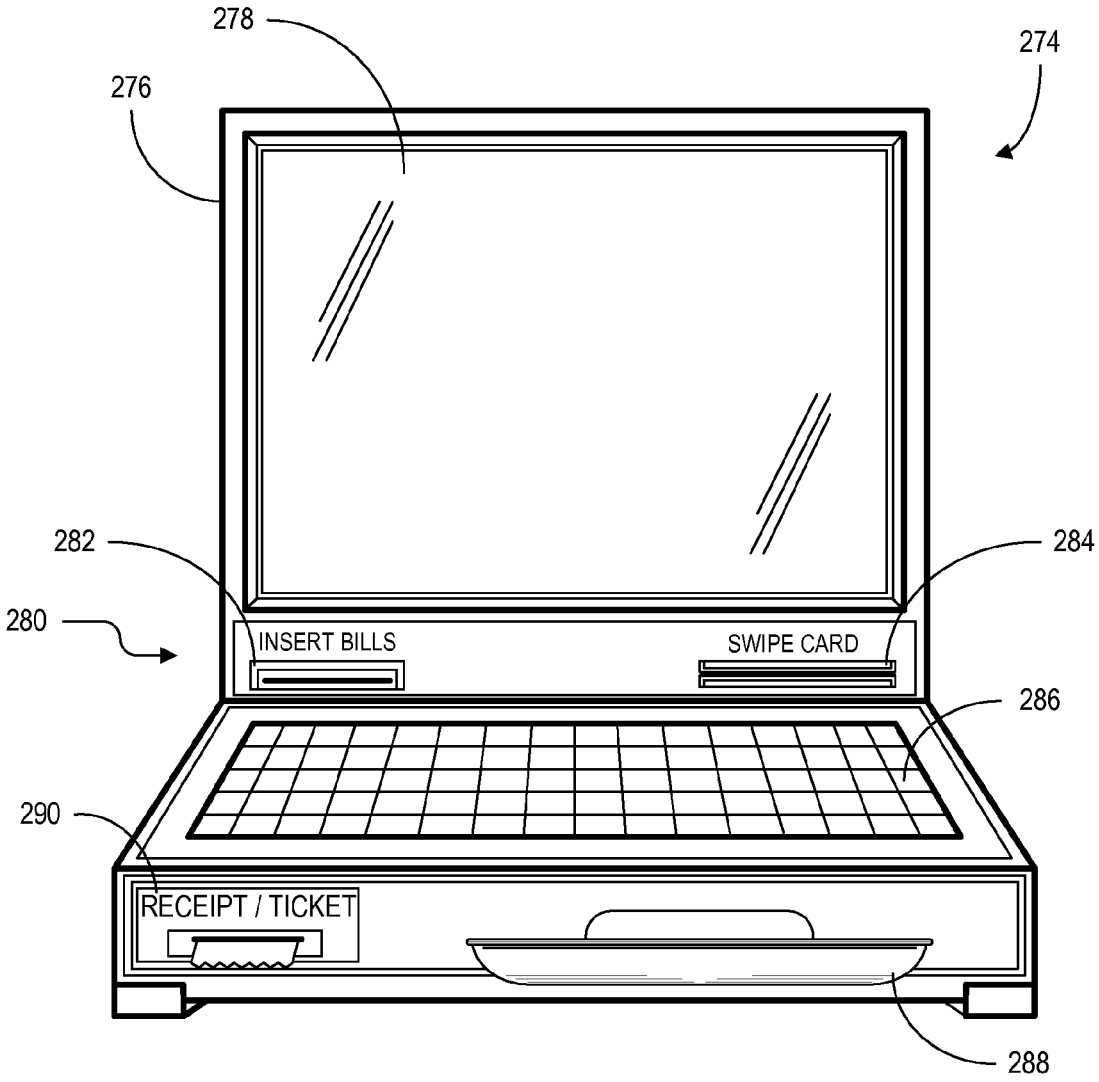
FIG. 28 illustrates an embodiment of a keno terminal incorporating a video content display.
Figure 29:
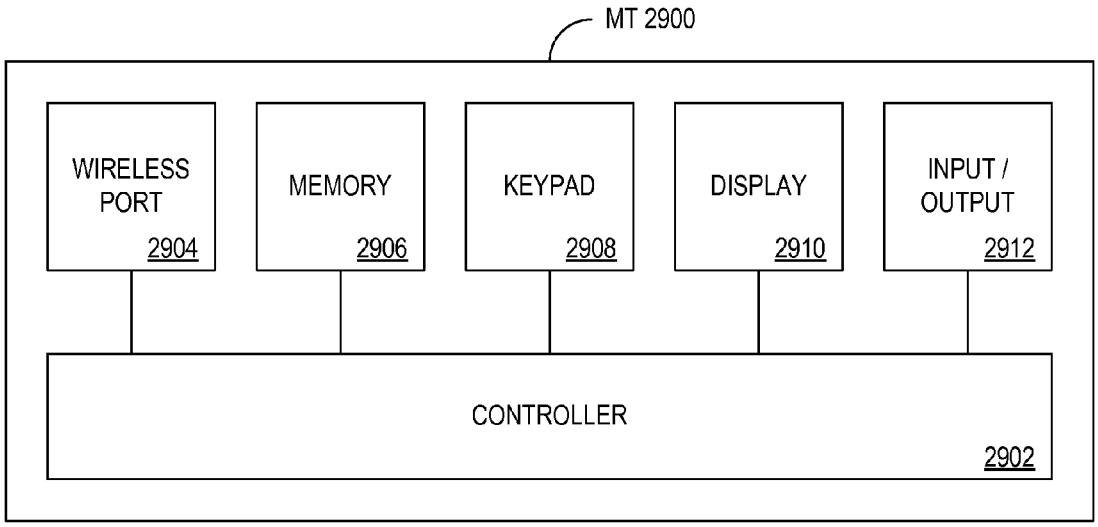
FIG. 29 illustrates an exemplary mobile terminal suitable for use with at least one embodiment of the present invention.
Figure 30:
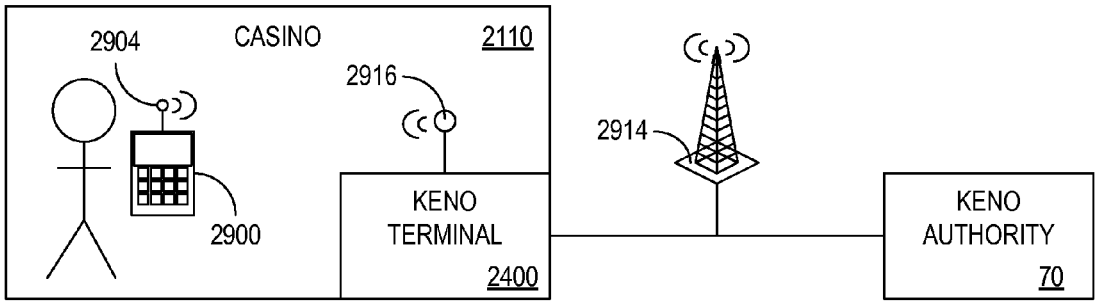
FIG. 30 illustrates an exemplary mobile terminal operating as a keno terminal according to one embodiment of the present invention.
Figure 31:
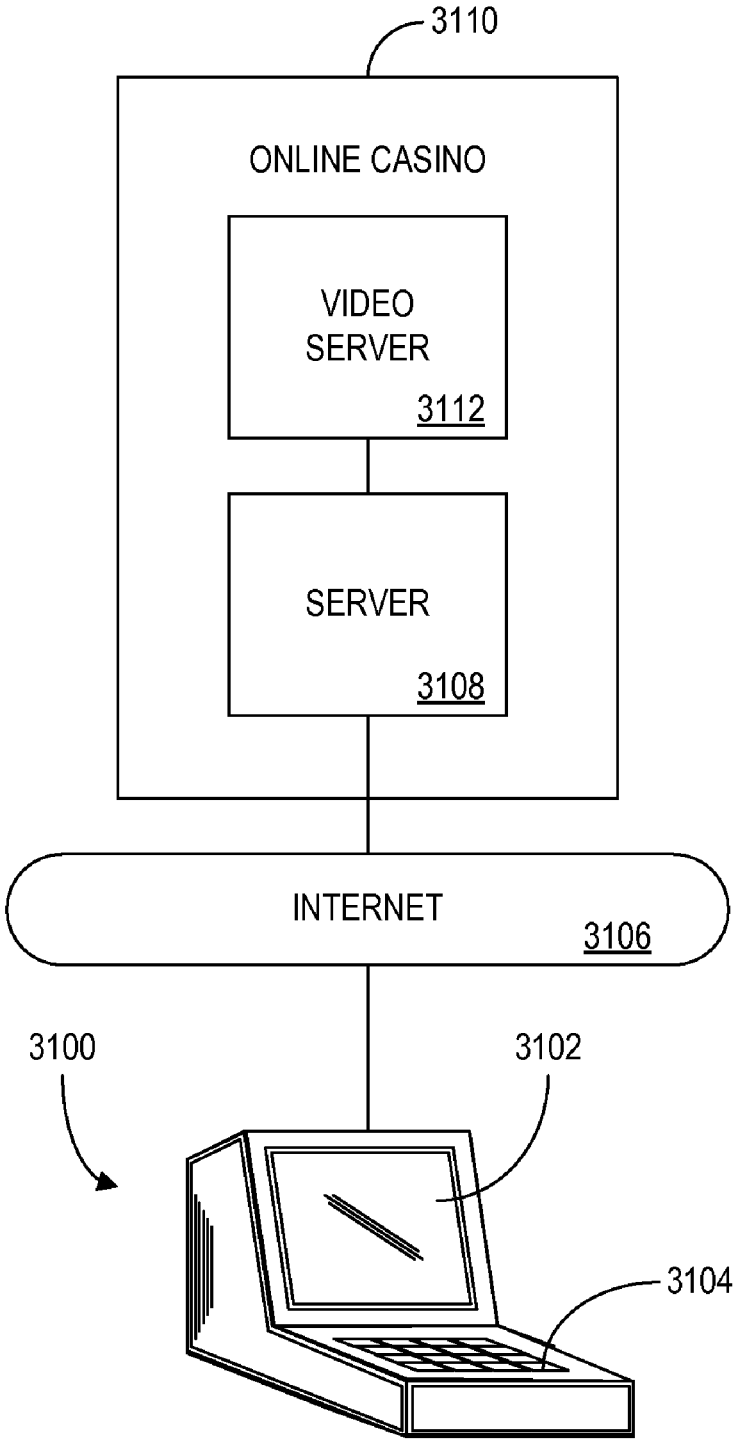
FIG. 31 illustrates an online video based keno game according to an embodiment of the present invention.
Figure 32:
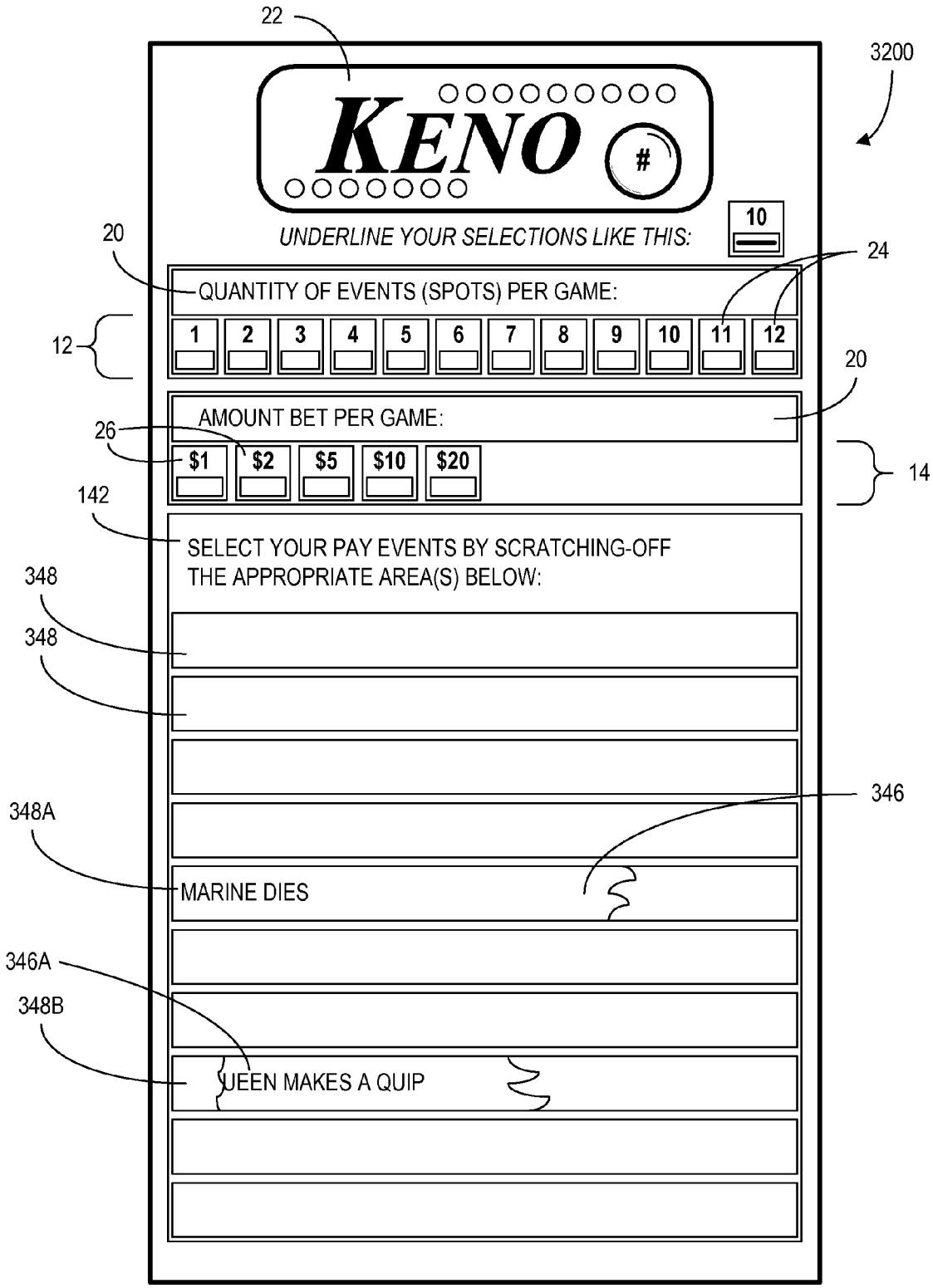
FIG. 32 illustrates an alternate embodiment of a keno ticket according to the present invention.
Figure 33:
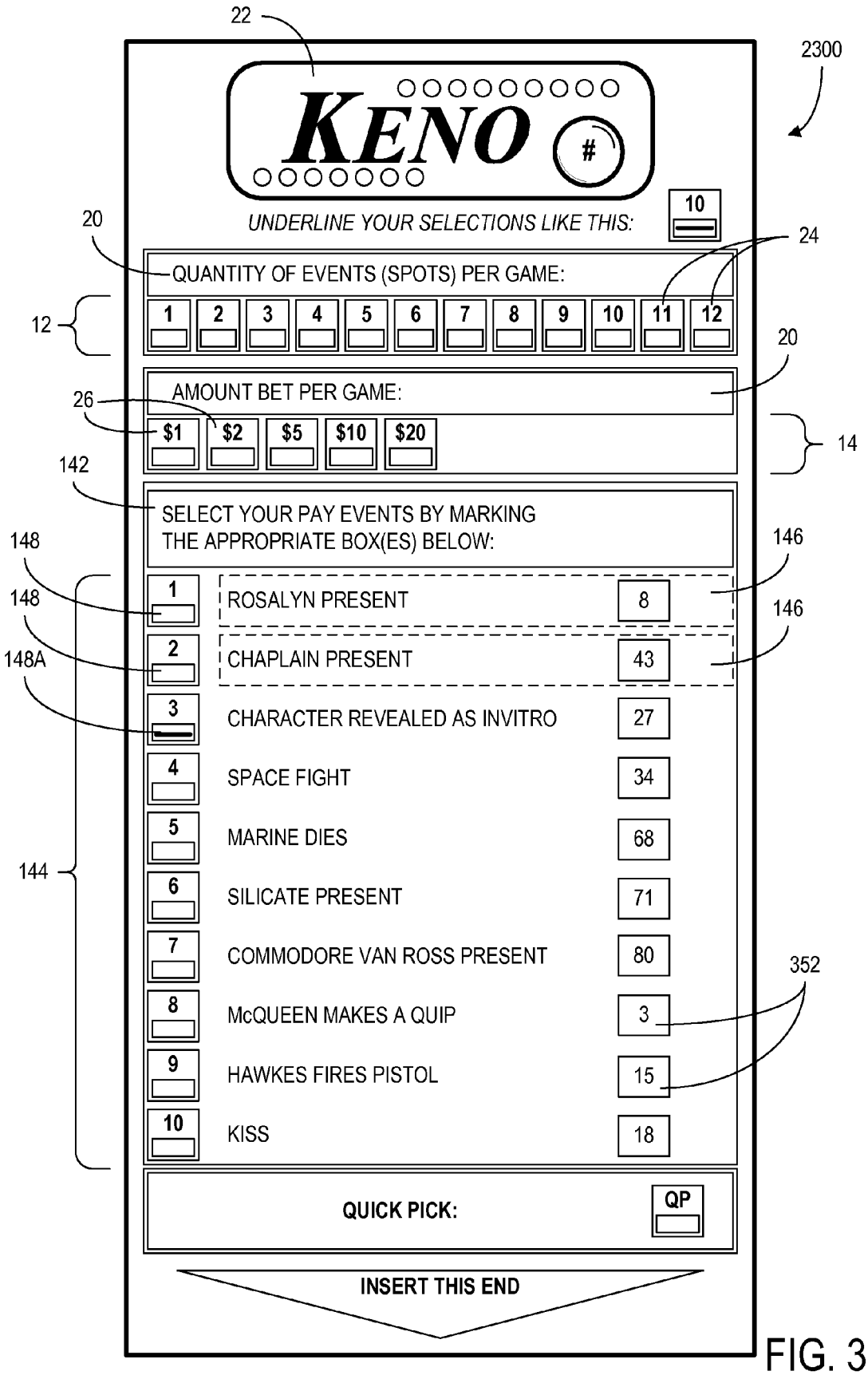
FIG. 33 illustrates another alternate embodiment of a keno ticket according to the present invention.
Figure 34A:
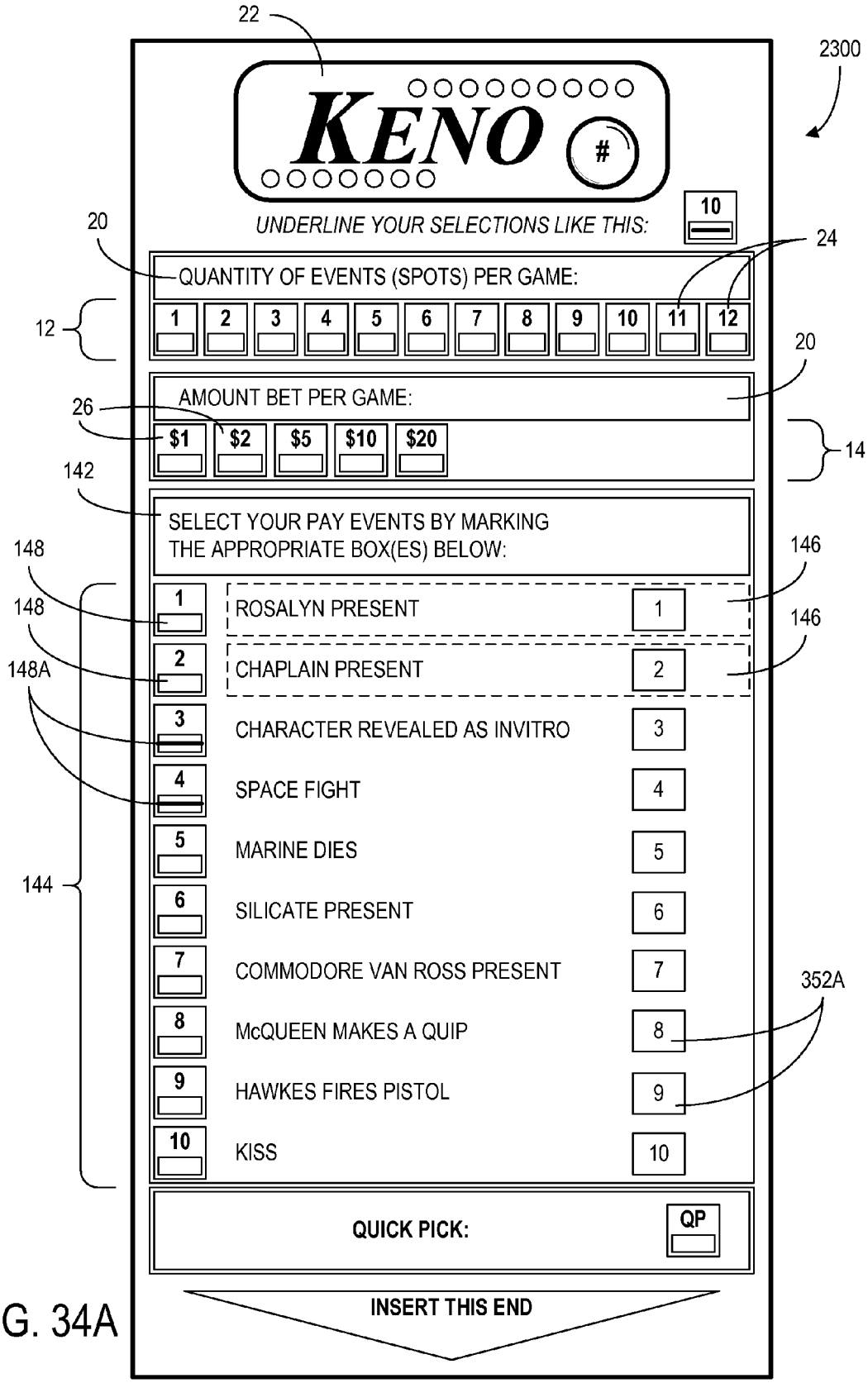
FIGS. 34A and 34B illustrate still another alternate embodiment of a keno ticket according to the present invention.
Figure 34B:
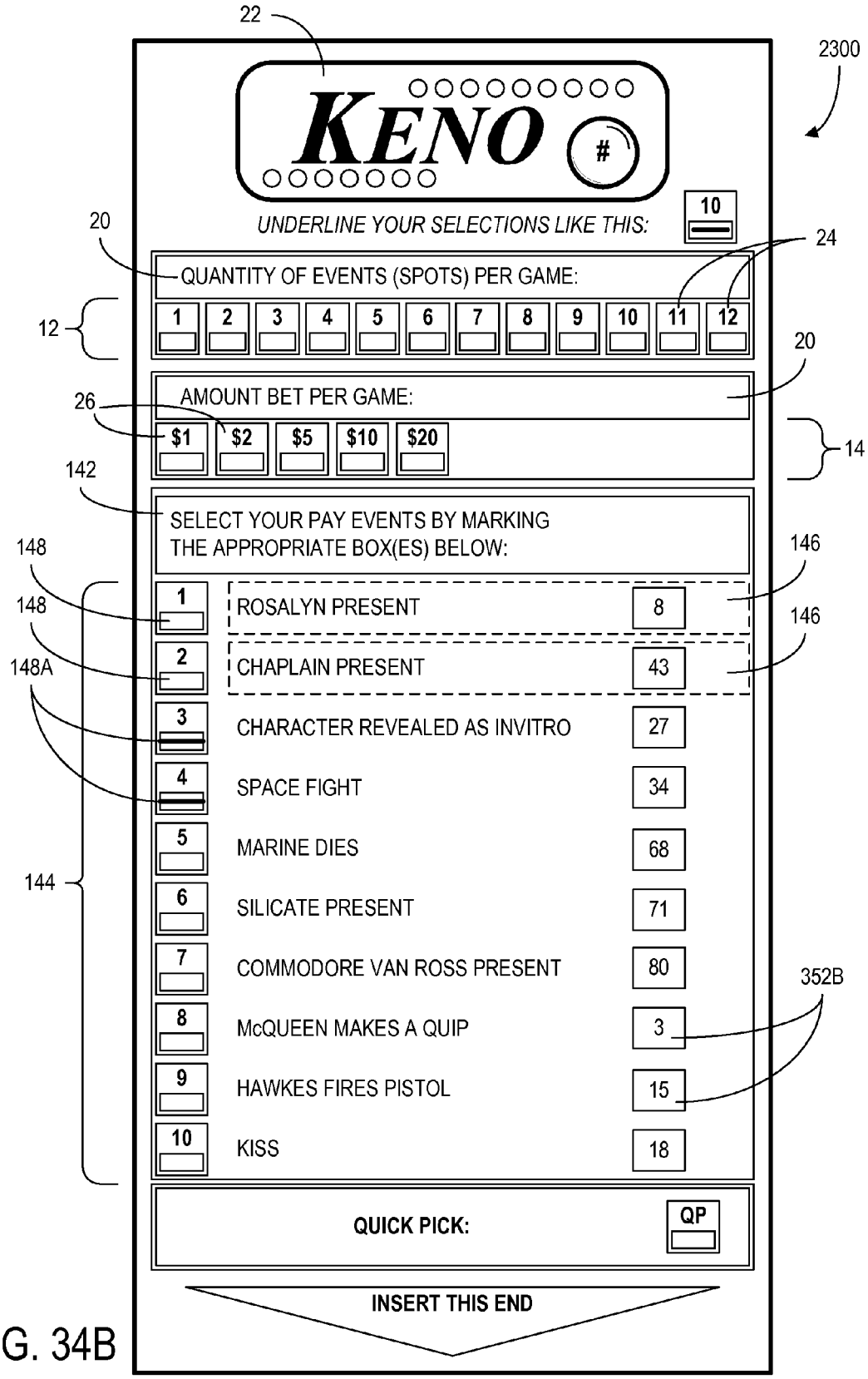

As an alternative to the embodiment of FIG. 19, the number indicia may vary from ticket to ticket. Thus, as illustrated in FIGS. 20A & 20B, the same potential pay events 146 have differing number indicia 352A & 352B. For the player to have a match, the player must not only match the drawn pay event, but also the number of the drawn pay event. Thus, in the example where the cue states "SPACE FIGHT! PAY EVENT 34!" only the ticket of FIG. 20B would have a match. Even though the player of the ticket of FIG. 20A marked the space fight potential pay event, the mismatch on the number makes the ticket of FIG. 20A a loser. If later there is a pay event with the cue "MECHANIC IS AN INVITRO! PAY EVENT 5" neither ticket is a match, even though both have selected the potential pay event of: CHARACTER IS REVEALED AS AN INVTRO. In this embodiment, the identifier used in the cue is important to help differentiate between possible pay events.

This embodiment also helps combat a priori knowledge by introducing the added complexity of matching the numbers. Thus, even if a player knows that a potential pay event will occur in the video content, the player does not necessarily know what number will be associated with the potential pay event.

As alluded to earlier, the uncertainty factor can be further heightened by randomizing which of the potential pay events in the video content are drawn pay events. Thus, if a video clip has eighty potential pay events in its video content, perhaps only twenty of the potential pay events will be drawn pay events and marked with a cue according to the present invention. That way, even if a player knows that a potential pay event occurs in particular video content, the player is not guaranteed that the potential pay event is a drawn pay event. In a first embodiment of this variation, the drawn pay events are static from presentation to presentation of the video content. That is, if episode five of SPACE: ABOVE AND BEYOND™ has a certain set of drawn pay events and cues in its first showing, then subsequent showings will have the same drawn pay events and cues. This variation is obviously open to some abuse if players can determine when and where the next showing of that video content will be held. To combat this potential abuse, a second embodiment varies which of the potential pay events are drawn each time the video content is displayed.

In keeping with the last variation, there are variations in which the drawn pay events are selected from amongst the potential pay events. In a first embodiment, and as described above, the video editor makes the decision as to which of the potential pay events are drawn pay events. This arrangement is suitable when the drawn pay events are static and will not change from showing to showing. In a second embodiment, the keno authority 70 receives the edited video content with tags or other information identifying potential pay events, and the keno authority 70 makes the decision. The keno authority 70 provides an auxiliary information file identifying which tags within the video content indicate drawn pay events. The keno authority 70 then delivers the edited video content with the auxiliary file such that when the two are used by a keno game establishment 130, the appropriate cues are presented on the keno monitor 250 (or other keno terminals such as the hotel room television, the mobile terminal, or the like) for a single showing. This embodiment is well suited for content delivery from a video server 224 at the keno authority 70 to dumb keno terminals 200. When a second showing is desired, the keno authority 70 makes a new random selection of drawn pay events from amongst the set of potential pay events and redelivers the auxiliary file to the keno game establishment 130 (or other keno terminal as previously mentioned). This embodiment ensures a great deal of control by the keno authority 70 over the content and the drawn pay events.

As still another embodiment, the keno game establishment 130 may make the decision as to which of the potential pay events are drawn pay events. In this embodiment, the site hardware for the keno game establishment 130 selects the drawn pay events and inserts the appropriate cues when the tags occur during presentation. A variation of this is prompted by the variations in the keno terminal possibilities. That is, for hotel television viewing, the set top box or television acts as a keno terminal, in which case the step top box may have a controller or processor that is capable of making the decisions as to which of the potential pay events are going to be drawn pay events.

As still another embodiment, the video content may be edited to include the tags and/or cues later in the process or the editing and delivery process may be expanded to include live events. For example, someone or something at the keno game establishment 130 could receive a broadcast of video content from a remote location and could identify drawn pay events on the fly much like close captioned text is created on the fly for live broadcasts. If the video content is being supplied to a hotel television or other self-service combination keno terminal, then the set top box or other receiver could perform this on the fly editing. Obviously, there may be some issues about impartiality if a human editor performs the drawn pay event selection and programming, so pattern recognition software could be used with the video content to help identify potential pay events and insert the appropriate cues for drawn pay events. Alternatively, instead of pattern recognition software, an audio threshold software mechanism could be used to detect audio track volume thresholds and designate pay events based on the volume exceeding this threshold. Thus, fights and laugh tracks would likely be designated as potential pay events because such events are likely to have higher volumes associated therewith. Alternatively, if the audio level fell below a certain threshold, that fact could cause the software to designate a potential pay event. For all the editing, the editing can be manual (as is generally assumed throughout the preceding examples) or automatic, such as by companies like Sportvision of 4169 North Ravenswood, Suite 304, Chicago, Ill. 60640 or Princeton Video Imaging of 561 Seventh Avenue 4th Floor, New York, N.Y. 10018.

For automatic editing, the editing can be performed by a controller at the keno authority 70, the keno terminal 200 or 242, the video server 224, a set top box acting as a keno terminal, or other intermediate location as needed or desired.

As yet another embodiment, the video content and/or cues may be edited to reflect the win/loss status of tickets sold. That is, because the wagering is likely to be closed before the video content is displayed, the keno game establishment 130 has knowledge of what tickets have been sold and what potential pay events players have selected. Thus, when a drawn pay event matches a selected pay event, a cue could be inserted into the video content by the keno game establishment 130 that is specific to the tickets sold and/or highlights the winning or losing status of a ticket. For example if no one picked the death of a marine potential pay event, but the death of a marine occurs and is a drawn pay event, the cue could state "No one picked this pay event! Shame on you!" or some other admonitory phrase. Likewise, if a ticket has a particularly high payout, then the cue might say "Ticket 13487 has just matched seven of eight spots! Congratulations!" The cue could also state whether there were multiple winners on a particular drawn pay event, the cumulative winning tickets, or cumulative benefit that will be provided amongst all ticket holders. If the ticket was purchased in such a manner as to identify the player to the keno game establishment, the cue could be more personalized. "John Smith, you just matched ten pay events! Congratulations!" Instead of a player name, a player number or player screen name could also be used. The cue could also be more prospectively positive based on a player missing the drawn pay events. For example, "Joan Smith, you missed the last pay event, and have one more you need to win. Let's see if the Chaplain is present." Other cues with other sorts of promotional, inspirational, or congratulatory information may also be used as needed or desired.

Another way to vary information provided to the players based on keno tickets sold does not necessitate changes to the cues. Rather, the additional information presented to the players is added as part of an additional editing process. Text may be added in such a manner as to overlay the video content on the display. VCRs commonly display tracking information in such an overlay fashion. Thus, the cues are presented as described above, and the information described in the previous paragraph such as congratulatory or admonitory information may be presented through this tertiary information avenue. The tertiary information avenue may be added by a set top box or other device immediately prior to display of the video content or other location as needed or desired.

A permutation of varying the content of the cue is varying the purpose of the cue. For example, as noted above, the cue could alert a particular player or ticket holder that they were a winner. If the cue were a pause in the video content, the pause could be inserted to allow time for players to check their tickets to see if they selected the drawn pay event. Alternatively, a pause could be inserted when a winning ticket has been completed so that the winner could stand up for acknowledgment or to receive some additional benefit. For pauses, the pause could be for a set amount of time or require some interaction to resume play. As one option, the keno attendant could resume play with the press of a button. As another option, if the player is watching the content alone, the player could press a resume button. Instead of a pause, the pay event could repeat itself, perhaps in slow motion, so as to highlight the occurrence of the pay event.

As still another variation of the present invention, the present invention could be implemented on several channels. To play, the player may need to purchase a different keno ticket 140 for each channel, or the keno tickets 140 may be generic enough to operate across multiple instances of video content. The greater the number of channels over which the player desires the keno ticket 140 to operate, the higher the wager the player may have to make. Note that in such a multi-channel embodiment, the pay events may occur simultaneously or at different times on the various channels.

As yet another variation, the video content to be aired at a particular keno game establishment 130 may form the basis of a game of chance in and of itself. The players could bid on which video content from amongst various channels and/or episodes is played on a particular monitor, with the highest bid paying the keno game establishment 130 the winning bid and the video content being presented. Alternatively a more democratic vote system could be used, with the losers receiving a consolation benefit (or not). This selection variation could have differing levels of granularity including the genre, the series, or the particular episode of video content. Players may also vote in interactive movies such as choosing from amongst available video on demand and/or choose your own adventure style movies.

As still another variation, the drawn pay events may be selected based on the keno tickets sold. As noted above, because the wagering may stop before the presentation of the video content, the keno game establishment 130 knows a priori on which potential pay events wagers have been made. Based on expected payout, the drawn pay events may be selected. Much like in horseracing, odds may be posted as wagers are made to help inform the players of the nature of the wager. Note that in such embodiments, if two players have "jackpot" style winning tickets, they may have to share the jackpot. Note further, that this jackpot or prize winning sharing concept could be extended to other embodiments of the present invention.

As still another variation, the odds of a particular pay event occurring may be varied or have differing benefits associated therewith. For example, McQueen only utters his quip about the Commodore's mother once in the entire series. Thus, the likelihood of this being a drawn pay event is small. To reflect the slim chance of it being drawn, it may have an increased or bonus reward associated with it. Alternatively, some potential pay events may occur multiple times in the same video content. For example, there are several episodes where multiple marines die. If a keno player selects "Marine dies" as a selected pay event from amongst the potential pay events, and the marine dies pay event is a drawn pay event multiple times, then the benefit for that selection may be increased or varied. For example, a multiplier could be applied to a payout.

Another variation in the present invention is where the video content is stored. While the various embodiments propose various locations, the following provides a brief summary of the most likely storage locations. It should be appreciated that other locations are possible and within the scope of the present invention. The video content may be stored with the keno authority 70, either in its own storage facility or in a video server 224 that directly transmits video content to the various keno monitors 250 (or other displays). This allows centralized control of the video content and makes it easy to add, update, or change the video content. This arrangement also allows the video monitors to be less complex (because they do not have to have storage capacity) and thus less expensive. Alternatively, the video content can be stored in the keno monitors (including set top boxes for converted keno terminals like the hotel television). Each set top box may include a disc changer (e.g., a 100 disc changer) or hard drive with the video content stored thereon. This arrangement causes the set top box and keno monitors 250 to be more expensive, but may make sense where the keno terminal/set top box only plays a limited selection of movies (e.g., one movie per terminal) and has dedicated advertising for this limited selection. As yet a third alternative, the video content may be stored on a portable medium such as a DVD. The player may obtain the DVD and/or player from a keno register or standard location, and take the DVD to the keno monitor 250 or other DVD player. Another example would be a keno attendant/bartender obtaining the DVD from the keno authority 70 and plays the DVD at a certain time on the keno monitor 250 of the keno game establishment 130. The storage medium may be stored in a conventional or proprietary format so that it can only be played in certain locales if desired or required by law.

While automatic video editing has been discussed above, there are a few other permutations on the concept that are provided here. Automatic video editing may be particularly useful for embodiments in which video content is replayed and the drawn pay events are selected randomly immediately prior to or during playback. Likewise, automatic editing is useful in editing live feeds. The automatic editing may be in the video server 224, the controller at the keno authority 70, the step top box, the keno terminal 200, or in some intermediate location as needed or desired. Note that automatic editing can occur on video content that has been stored in memory of the editing device before editing commences or the editing may take place on video content that is being received over a communication network (e.g., terrestrial broadcast television, satellite television feed, cable television feed, streaming video from the internet, or the like). The editing process may add a small delay as the editing occurs. However, a delay of approximately ten seconds is contemplated and acceptable for most applications. While ten seconds is specifically contemplated, other delays of longer or shorter delays are also within the scope of the present invention.

The automatic editing may automatically determine drawn pay events and insert an appropriate cue based on the video content directly or based on a set of potential pay events that have already been designated (such as by a tag) for the video content. In this case, the editor may perform a random selection of a subset of the set of potential pay events.

To create the set of potential pay events, it should be appreciated that the set of potential pay events will likely be much larger than the set of drawn pay events marked with cues on which an outcome of a keno game is based. The larger set of potential pay events allows different sets of pay drawn pay events to be used in different presentations of the video content. The set of potential pay events may be created each time new video content is added to the video content storage location. Again, the creation of the set may be automatic or manual. During receipt of live video content, a person similar to a closed-caption stenographer, sports statistician, or the like may tag potential pay events or input information useful for tagging potential pay events. This person may be on the video creation side before broadcast or on the receiving side and still be within the scope of the present invention. Alternatively, players or other people may indicate prospective potential pay events. These people may be paid individuals using a technique known as digital piecework and as exemplified by U.S. Pat. No. 6,093,026, which is hereby incorporated by reference in its entirety, or may be volunteers. Pay may be in the form of free play, comps, cash, or the like as needed or desired. As yet another alternative, and as described above in the originally disclosed embodiment, the tags that mark potential pay events may be stored with the original video content. Alternatively, the list of tags may be in a separate file having timestamps and associated cue descriptions.

The randomness of the drawing of pay events may be effectuated in a number of different ways. For example, all potential pay events within the set of potential pay events may be equally likely. This embodiment works best if there is only one potential pay event associated with each descriptor. That is "Marine dies" is a bad option for the example series since marines tend to die in batches during the series. A better option would be characters uttering unique lines of dialog as each one will only occur once during each presentation of video content. This embodiment is simple in that the players do not need to have the odds explained to them. Alternatively, certain potential pay events may have a greater or lesser likelihood of being drawn than others. As noted above, these pay events may have changed benefits associated with them based on their likelihood. This embodiment adds complexity to the game. Complexity in and of itself is neither good nor bad, but it may affect the nature of the players attracted to the game. Still another method of creating randomness is to vary the number of pay events that are drawn from the set of potential pay events. This determination may be made at the keno authority 70, the set top box, the keno terminal, or other location as needed or desired. As yet another alternative, the drawings of the pay events may not be random. Rather, the drawing may move through the set of potential pay events in round-robin fashion to ensure that all potential pay events occur on a regular basis. However, this embodiment has implications in terms of potential player abuse. To avert this issue, the tickets may need to be generated randomly.

While the discussion above contemplates that the cues will be edited directly into the video content, other arrangements are possible. The cues may be stored in separate video files in conjunction with the video content. Again, the storage can be at any of the previously recited locations. As yet another alternative, the cues may be generated as needed by the editor for on the fly editing. This embodiment is particularly useful when other parameters are being inserted into the cues. That is, the content of the cues may be changed dynamically to indicate the winnings of particular players as drawn pay events happen or other circumstances require.

In several locations of the current disclosure, the disclosure mentions a set top box being a possible implementation option. To summarize what is intended by those discussions, a set top box may be an electronic device that outputs video content to a display. The set top box may be integrated into a keno terminal, integrated into a keno monitor, or other device, but usually will be a peripheral device that may allow a conventional display to be adapted for use in the video based keno game of the present invention. Set top boxes according to the present invention may also be embodied in cable television receivers, satellite television receivers, digital video recorder devices (such as TIVO®), video game consoles, and the like. Alternate examples are specialized VCR or DVD players that take edited video clips and present the edited video content with cues to the playback device. In most examples, these devices are adapted to receive the video content from a remote location, but in the latter two examples, the specialized media discussed above may be utilized.

In some embodiments, the set top box may insert the cues and/or tertiary information channel into the video content. The cues and/or tertiary information may be generated by the set top box or may be received from a remote location with or without out the video content (such as in a second channel) and then inserted by the set top box. The cues may be inserted based on tags if such are present in the video content.

With respect to from where the tags come, the set top box may receive the tags from various sources. In a first embodiment, the set top box may receive the tags along with the video content from the same communication network. In a second embodiment, the tags may be transmitted to the set top box in a communication network different from the one in which the video content is transmitted. As yet another embodiment, the tags may be generated internally by an editor within the set top box. The set top box may receive the tags prior to the start of video playback or during video playback. As alluded to above, the transmission of the video content and/or tags may be secured to prevent interception and use by players or insertion of fraudulent tags by players. One solution is to authenticate the transmission of tags and the video content with a cryptographic hash such as MD5 or SHA-1 hash functions. Alternatively, the entire transmission may be encrypted, albeit at the expense of requiring more decryption computing power at the receiving set top boxes. Some delay may be generated during authentication or decryption without departing from the scope of the present invention.

Numerous examples of selling the keno ticket have been presented, a summary of these is provided here. The sold keno ticket can be secured by the player from a cash register adapted to dispense such, a vending machine (the self-serve keno terminal 274), a keno terminal 200, a set-top box (such as in the player's hotel room), the portable keno terminal, the mobile terminal 300, and the like. The player must pay for the wager associated with the keno ticket. This payment may be made by providing consideration such as cash, chips, tokens, comp points, alternate currency, a payment identifier (credit card number, debit card number, financial account number, hotel room number, cell phone/mobile terminal account number), smart card or the like as needed or desired. Alternatively, as noted above, the keno ticket may be provided as some form of compensation to the player or otherwise provided for free as a comp or promotion if needed or desired.

At several locations, the disclosure has indicated that the keno sales location (such as keno terminal 200) may randomly select pay events for the keno player. There are several permutations for this activity. The controller of the keno sales location may randomly select the pay events locally. The controller of the keno authority 70 may randomly select the pay events and transmit the selected pay events to the keno sales location for printing onto the keno ticket. Alternatively, the controller of the keno authority 70 may transmit a list of a set or subset of the potential pay events to the keno sales location and the keno sales location randomly selects the pay events and prints them on the sold keno ticket. As yet another embodiment, the controller transmits a random subset of the list of potential pay events to the keno sales location, and the player selects from this random subset.

Several electronic keno tickets have been discussed, such as those at self-serve combination keno terminals 274, the mobile terminal 300, the set top boxes, the IPOD, and the like, but it should be appreciated that such electronic tickets may also be written to a computer readable medium such as a USB flash drive, a compact disc, or the like. Still further, the keno ticket could be or come with an inexpensive dongle/fob that makes sounds, lights up, or otherwise generates an alarm when a pay event occurs or the player wins. This embodiment would require an output device such as a speaker or LED and an RFID transponder. The transponder could power the output from the energy of an RFID interrogator or have a battery associated with the device. Each transponder could have a unique frequency and the keno game establishment 130 could transmit only on the frequencies of the winning tickets, or the devices could be addressable and a processor in the device read addresses from the interrogator before deciding to generate the alert if appropriate. Alternatively, much like restaurants generate alarms for waiting patrons with a paging system, a similar paging system could be used for the present invention. Still another technique would be to program a processor in the device to go off at certain times when drawn pay events are known to occur during the presentation of the video content. As yet another option, the device could have a microphone that listens for audio cues (whether these are cues for pay events or not) in the video content and processes the same so as to generate the alert. This last embodiment is relatively processor intensive and less likely to be available inexpensively, but it remains an option.

While several methods are discussed above for determining if the player has a winning ticket, a few more options are available in terms of that determination or ways benefits could be provided. Keno tickets according to the present invention could be of the "play and stray" variety, where so long as appropriate identifying information about which video content was the basis of the wager is provided, the keno ticket may be valid for a predefined period of time (such as a year), and the player merely presents the ticket to a keno attendant/keno terminal at a later time to ascertain if it is a winning ticket. Alternatively, a phone line, website or the like could be provided similar to current state lottery postings. The player could be prompted by an interactive voice recognition unit to enter a game ticket identifier, which would be matched in a database against known winning tickets to ascertain whether the player had a winning ticket. Even if the player does not have enough matches to win conventionally, certain pay events may be instant winners. For example, where a consumer product placed within the video content serves as a potential pay event on which the player has made a wager, the presence of the consumer product may instantly turn the ticket into a coupon redeemable towards the purchase of that product. Credits and rebates could be substituted for coupons if needed or desired. Pay events may have multiplying effects. For example, if a drawn pay event occurs between the first and second commercial break, the drawn pay event doubles the benefit, but if the drawn pay event occurs at some other time, it may have a different, lower multiplier. Note that this could be expanded into whether the drawn pay event is a drawn pay event at all. For example, the player may wager that the potential pay event occurs between the first and second commercial breaks, but if the potential pay event occurs after the second break, then the player's selection is a losing selection. Likewise, the potential pay events may be specific to consumer products or the like. The player may have to choose between the following two potential pay events: character drinks a COKE® or character drinks a PEPSI®. Depending on which one on which the wager is made and the video content, the player may be a winner. Note that this could be combined with the previous couponing embodiment such that if a player wagers on COKE®, but loses, then the ticket turns into a coupon subsidized by COCA COLA as compensation for betting on COKE®.

Benefits can also be varied by timing factors. For example, the player may have a decaying benefit. That is, if the player redeems the winning ticket quickly, the benefit is larger. This promotes the player immediately realizing the value of the game (and hopefully playing again) or having more money to spend in the casino. The player may also get a benefit enhancer for purchasing a ticket early or a benefit reduction for delayed purchase of the ticket. For example, tickets may be able to be purchased after the start of the video content, but the prize prorated based on how much of the video has been presented.

Particularly contemplated aspects of the present invention are disclosed herein. One aspect of the present invention is a method comprising preparing video content for use in a keno game by associating a cue with a potential pay event in the video content, wherein the cue is adapted to inform a keno player that the potential pay event is a drawn pay event. This method is expanded by packaging the video content in a manner suitable for distribution to a keno game establishment, keno authority, or the like. This method is expanded by delivering the video content to a keno game establishment, a manufacturer of keno game terminals, a keno authority, or the like. This method is expanded by associating a tag with the potential pay event and associating the cue with the tag. The tag may store information in an auxiliary channel associated with playback of the video content such as the vertical blanking interval of the video content. The cue may be an audible cue such that the keno player hears that the pay event has occurred when the video content is played to keno player. The cue may be a visual cue such that the keno player sees that the pay event has occurred when the video content is played to the keno player. The method is expanded by identifying potential pay events within the video content, such as by receiving from a third party an indication of potential pay events within the video content. The third party may be the creator of the video content.

Another aspect of the present invention is a video clip comprising a cue associated with a potential pay event in the video clip, wherein the cue designates the potential pay event as a drawn pay event to a keno player when the video clip is displayed in conjunction with a keno game. The video clip is adapted for delivery to a keno game establishment, a keno authority, a manufacturer of keno game terminals, and the like. The video clip may include a tag that is adapted to trigger the cue when the video clip is played. The tag may be stored in the vertical blanking interval of video content. The cue for the video clip may be an audible or visual cue.

Another aspect of the present invention is a keno terminal adapted to process keno tickets comprising an input/output element adapted to manipulate a keno ticket for processing and a controller adapted to process indicia on the keno ticket, wherein the indicia is indicative of a pay event potentially occurring in associated video content of a video based keno game. The input/output may be adapted to print the keno ticket such that the keno ticket displays the indicia indicative of the pay event potentially occurring in the associated video content of the video based keno game. The input/output may be adapted to receive from a keno player the keno ticket with keno player generated markings thereon selecting certain pay events. The keno terminal may further comprise a printer adapted to print a keno receipt reflecting pay event choices made by the keno player for an upcoming video based keno game. The input/output may be adapted to receive from a keno player the keno ticket with indicia thereon and the controller processes the indicia to determine if the potentially occurring pay event occurred in the associated video content. The keno terminal may further comprise a prize dispenser adapted to authorize the provision of a prize to the keno player if the controller determines that the potentially occurring pay event occurred in the associated video content.

Another aspect of the present invention is a keno terminal comprising a display adapted to present to a keno player video content having drawn pay events marked with a cue; an input adapted to accept input from the keno player; and a controller adapted to conduct a keno game on the keno terminal. The input may be adapted to accept input from the keno player selecting pay events from amongst a set of potential pay events associated with the video content. The input may be adapted to accept wager information from the keno player. The keno terminal may comprise an output adapted to authorize provision of a benefit to the player. The controller may randomly select pay events from potential pay events for the keno player.

Another aspect of the present invention is a keno ticket comprising indicia indicative of a potential pay event in a video based keno game. The indicia may comprise text describing the potential pay event. The text may be an identifier. The indicia may comprise a number associated with the potential pay event. The keno ticket may comprise a scratch off coating or be formed from an adhesive element. The keno ticket may be adapted to be presented on an electronic display.

Another aspect of the present invention is a method of conducting a keno game comprising conducting the keno game by displaying video content with cues designating drawn pay events associated therewith; and presenting the cues to a player of the keno game to alert the player that a pay event has occurred. The method may be expanded by selling tickets for the keno game. The method may be expanded by letting the player select pay events from a set of potential pay events. The method may be expanded by randomly selecting pay events from a set of potential pay events. The cues may be presented audibly or visually. The method may be expanded by associating a different number with each of the pay events. The method may be expanded by randomly selecting numbers to associate the different number with each of the pay events. The method may be expanded by randomly selecting pay events from a set of predetermined potential pay events associated with the video content such that selected pay events determine if the player is a winner. The method may be expanded by receiving a ticket from the player after the keno game has completed and determining if the ticket has indicia relating to presented cues of the video content. The method may be expanded by providing an award for a winning ticket received from the player. The method may be expanded by accounting with a third party for keno ticket sales. The method may be expanded by accounting with a third party for keno ticket winnings.

Another aspect of the present invention is a system for conducting a keno game comprising a display adapted to present video content to keno players; and video content suitable for presentation on the display and having one or more pay events contained therein and designated by corresponding cues, wherein the pay events are adapted to be presented to the keno players during playback of the video content such that particular pay events being present in the video content controls how winning tickets are determined.

Rules of Interpretation

Numerous embodiments are described in this patent application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

Neither the Title (set forth at the beginning of the first page of this patent application) nor the Abstract (set forth at the end of this patent application) is to be taken as limiting in any way as the scope of the disclosed invention(s).

The term "product" means any machine, manufacture and/or composition of matter as contemplated by 35 U.S.C. §101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present application, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate) may alternatively be used in place of the single device or article that is described. Accordingly, the functionality that is described as being possessed by a device may alternatively be possessed by more than one device or article (whether or not they cooperate).

Similarly, where more than one device or article is described herein (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this patent application and the title of this patent application are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining and the like.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software A "processor" means any one or more microprocessors, CPU devices, computing devices, microcontrollers, digital signal processors, or like devices.

The term "computer-readable medium" refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media include DRAM, which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during RF and IR data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Bluetooth™, TDMA, CDMA, 3G.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models and/or distributed databases) could be used to store and manipulate the data types described herein. Likewise, object methods or behaviors of a database can be used to implement various processes, such as the described herein. In addition, the databases may, in a known manner, be stored locally or remotely from a device that accesses data in such a database.

Some embodiments can be configured to work in a network environment including a computer that is in communication, via a communications network, with one or more devices. The computer may communicate with the devices directly or indirectly, via a wired or wireless medium such as the Internet, LAN, WAN or Ethernet, Token Ring, or via any appropriate communications means or combination of communications means. Each of the devices may comprise computers, such as those based on the Intel® Pentium® or Centrino™ processor, that are adapted to communicate with the computer. Any number and type of machines may be in communication with the computer.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present disclosure.

What is claimed is:

1. A method for providing a lottery game comprising:

selecting audio/video content;

identifying a content event that occurs in the selected audio/video content;

defining first payout criteria based on the identified content event;

associating the first payout criteria with a first payout;

defining second payout criteria based on an event that does not occur in the audio/video content;

associating the second payout criteria with a second payout;

providing a copy of the audio/video content to a player;

providing, via a first lottery terminal, a play slip to the player, in which the play slip indicates the first payout criteria for the identified content event and the second payout criteria for an event that does not occur in the audio/video content;

receiving, by a second lottery terminal, an identifier that identifies the play slip;

determining, via the second lottery terminal based on the received identifier, the first payout criteria are satisfied by the audio/video content; and providing the first payout to the player.

2. The method of claim 1, in which the identifier comprises a bar code.

3. The method of claim 1, in which the identifier uniquely identifies the play slip.

4. The method of claim 1, in which determining the first payout criteria are satisfied by the audio/video content comprises retrieving information from a database based on the identifier, the information indicating that the play slip is associated with the first payout and a redemption status of the play slip.

5. A method comprising:

selecting audio/video content;

reviewing the audio/video content for potential pay events;

designating at least one potential pay event in the audio/video content;

associating, via a managing authority controller device, at least one payout with at least one of the designated at least one potential pay events in the audio/video content; and providing the audio/video content to a lottery player via a game terminal.

6. The method of claim 5, in which providing the audio/video content comprises:

providing an unedited copy of the audio/video content to the lottery player.

7. The method of claim 5, further comprising:

modifying the audio/video content to include a respective cue for at least one of the potential pay events, and in which providing the audio/video content comprises:

providing the modified audio/video content to the lottery player.

8. The method of claim 5, further comprising:

providing a play slip to the lottery player, the play slip indicating at least one of the designated potential events.

9. The method of claim 5, further comprising:

generating a play slip for a lottery game, the play slip including an indication of at least one of the designated at least one potential pay events, each of the designated at least one potential pay events being defined by a respective first attribute and a respective second attribute.

10. The method of claim 9, in which the first attribute of one potential pay event describes at least one word of dialogue potentially occurring in the audio/video content.

11. The method of claim 10, in which the first attribute of one potential pay event describes at least one prop potentially utilized in the audio/video content.

12. The method of claim 10, in which the second attribute of one potential pay event describes a character.

13. The method of claim 10, in which the first attribute of one potential pay event describes at least one word of dialogue potentially spoken in the audio/video content, and the second attribute of the potential pay event describes a character potentially speaking the at least one word of dialogue.

14. The method of claim 10, in which the first attribute of one potential pay event describes at least one word of dialogue potentially spoken in the audio/video content, and the second attribute describes a character potentially speaking the at least one word of dialogue.

15. The method of claim 10, in which the second attribute of one potential pay event describes a particular portion of the audio/video content.

16. The method of claim 5, in which at least one of the designated at least one potential pay events comprises occurrence of a symbol.

17. The method of claim 5, in which at least one of the designated at least one potential pay events comprises occurrence of a prop.

18. The method of claim 5, in which at least one of the designated at least one potential pay events comprises an appearance of a character.

19. The method of claim 5, in which at least one of the designated at least one potential pay events comprises occurrence of a hand of cards.

20. The method of claim 5, in which at least one of the designated at least one potential pay events comprises a television game show outcome.

21. The method of claim 5, in which at least one of the designated at least one potential pay events comprises a play in a sports game.

22. The method of claim 5, in which at least one of the designated at least one potential pay events comprises a bingo card.

23. The method of claim 5, in which at least one of the designated at least one potential pay events comprises a drawing in a bingo game.

24. The method of claim 5, in which at least one of the designated at least one potential pay events comprises a number of draws in a bingo game.

25. The method of claim 5, in which the audio/video content is embodied as a DVD;

a CD-ROM;

a floppy disk;

a VHS tape;

a flash memory;

a mobile terminal;

a portable viewing device; or a portable audio device.

* * * * *